United States Patent [19]

Borchardt

[11] Patent Number: 4,950,114

[45] Date of Patent: Aug. 21, 1990

[54] METHOD FOR COMBINING AT LEAST TWO CONTAINER UNITS COMPRISING ISO CONTAINERS TO FORM A TRANSPORTATION UNIT, AS WELL AS THE TRANSPORTATION UNIT FORMED

[76] Inventor: Dieter Borchardt, Rissener Dorfstr. 45, 2000 Hamburg 56, Fed. Rep. of Germany

[21] Appl. No.: 139,665

[22] Filed: Dec. 30, 1987

[51] Int. Cl.[5] ..... B60P 7/13

[52] U.S. Cl. ..... 410/82; 410/77; 24/287

[58] Field of Search ..... 410/32, 68, 71–86, 410/90, 91; 206/503, 504, 505, 509; 220/1.5; 24/287

[56] References Cited

U.S. PATENT DOCUMENTS

| | | | |
|---|---|---|---|
| 3,052,941 | 9/1962 | Abolins et al. | 24/287 |
| 3,556,456 | 1/1971 | Lunde | 410/84 |
| 3,578,374 | 5/1971 | Glassmeyer | 24/287 X |
| 3,691,595 | 9/1972 | Backteman et al. | 24/287 |
| 3,711,902 | 1/1973 | Eggert, Jr. | 24/287 |
| 3,718,218 | 2/1973 | Shields | 410/78 X |
| 3,722,714 | 3/1973 | Morris et al. | 410/82 X |
| 3,734,442 | 5/1973 | Lunde | 410/77 |
| 3,752,511 | 8/1973 | Racy | 410/82 X |
| 3,776,169 | 12/1973 | Strecker | 410/77 |
| 4,082,052 | 4/1978 | Looks | 410/82 |
| 4,419,034 | 12/1983 | DiMartino | 410/77 X |
| 4,431,368 | 2/1984 | Katz et al. | 410/78 X |
| 4,626,155 | 12/1986 | Hlinsky et al. | 410/82 |

FOREIGN PATENT DOCUMENTS

| | | | |
|---|---|---|---|
| 3538892 | 5/1986 | Fed. Rep. of Germany | 410/82 |

*Primary Examiner*—Margaret A. Focarino
*Assistant Examiner*—Joseph D. Pape
*Attorney, Agent, or Firm*—Cushman, Darby & Cushman

[57] ABSTRACT

For combining several containers (1, 1', 2, 2', 3, 3') to form a transportation unit, they are detachably connected to constitute container units (1, 1', 2, 2', 3, 3') and an uneven number of such container units (1, 1', 2, 2', 3, 3') is detachably coupled together in the vicinity of their side walls, the locking openings in the upper surface of the central container unit (1, 1') being left free for engaging the locking heads of lifting equipment.

77 Claims, 37 Drawing Sheets

Fig 1
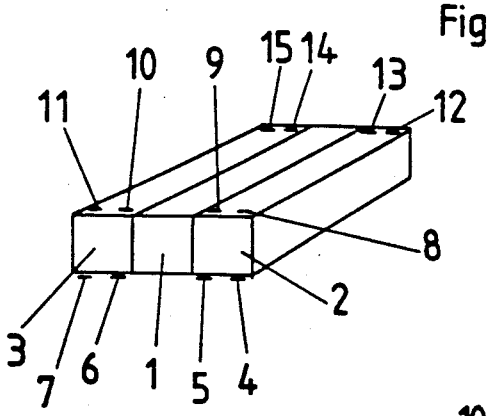
Fig 2
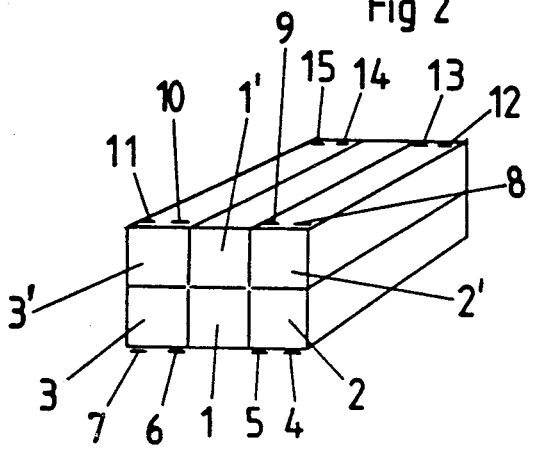
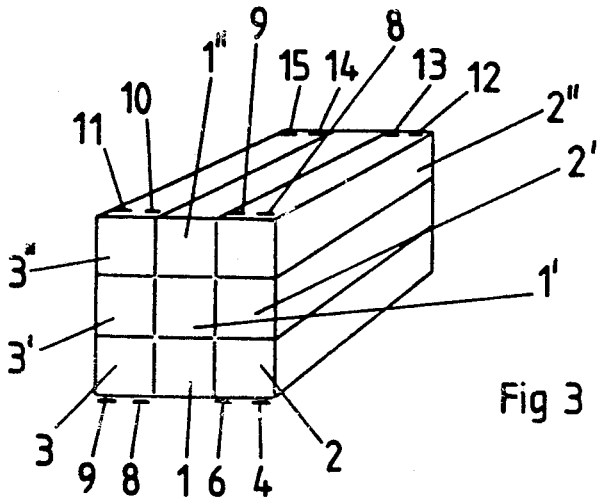
Fig 3

Fig.10A
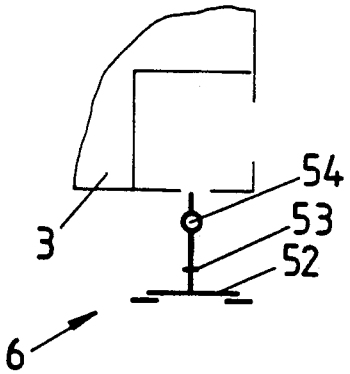
Fig.10B
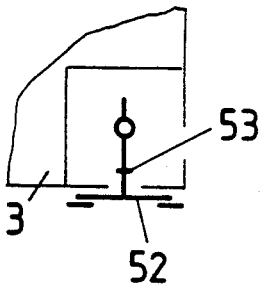
Fig.10C
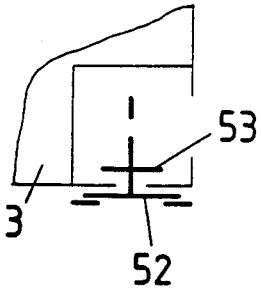
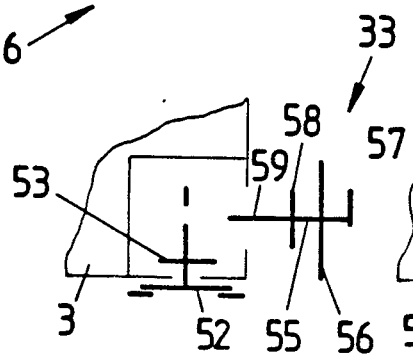
Fig.10D
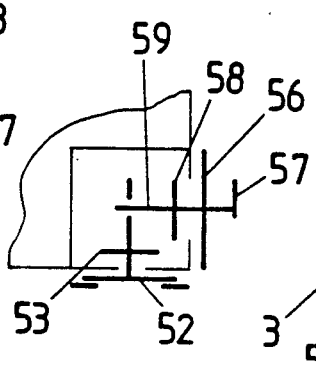
Fig.10E
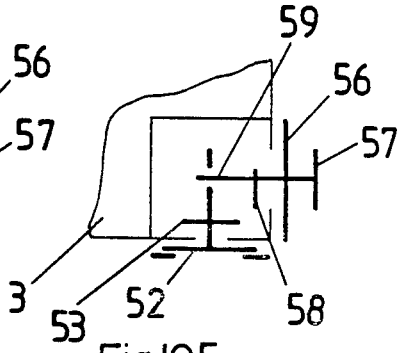
Fig.10F
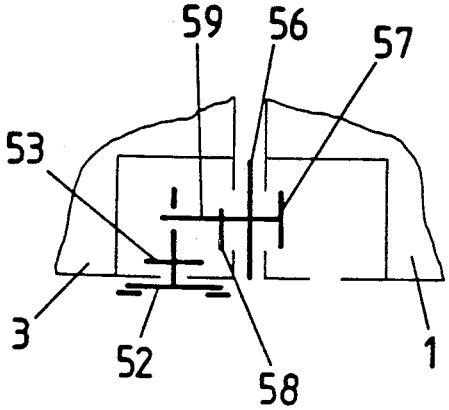
Fig.10G
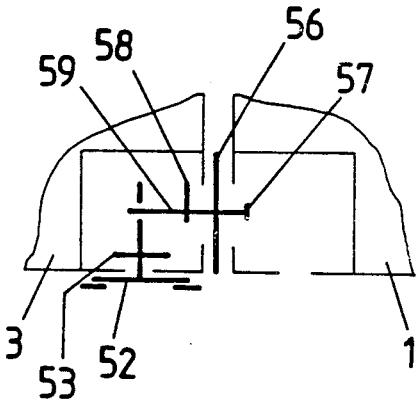
Fig.10H Fig.11A
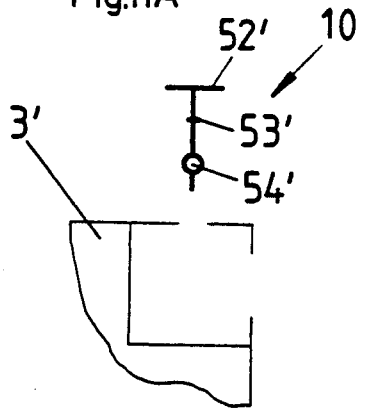
Fig.11B
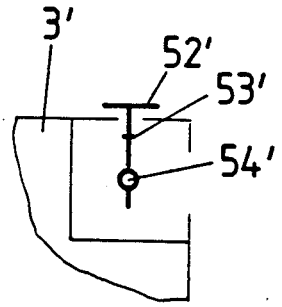
Fig.11C
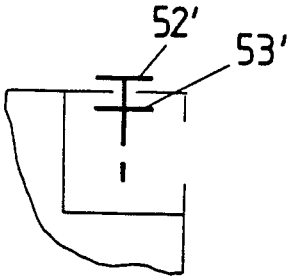
Fig.11D
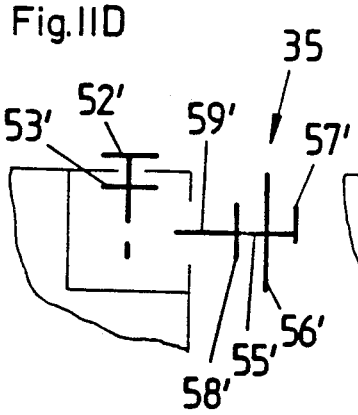
Fig.11E
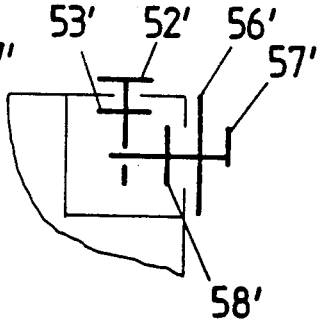
Fig.11F
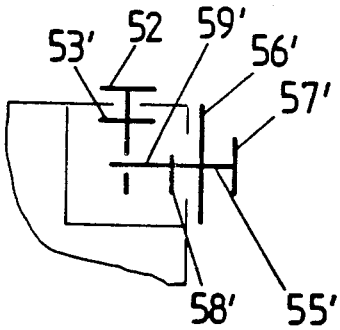
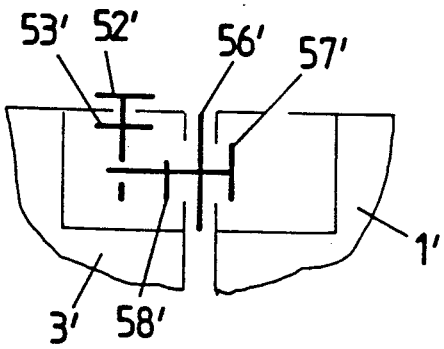
Fig.11G
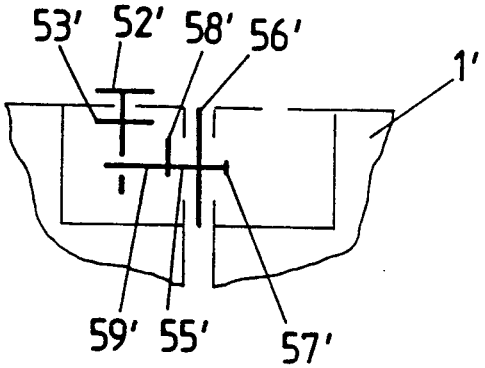
Fig.11H Fig.13A
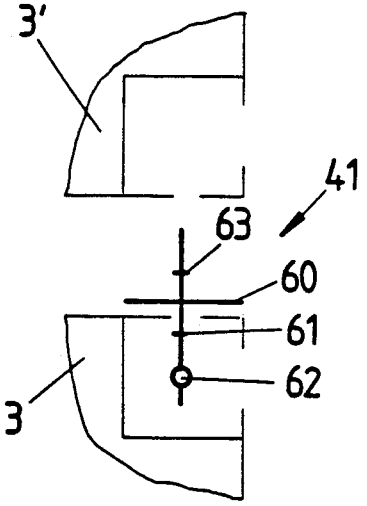
Fig.13B
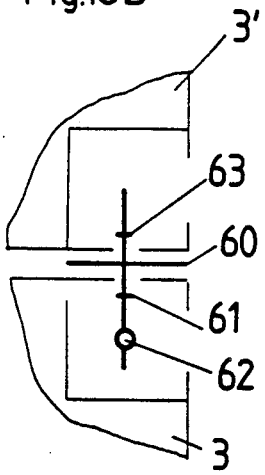
Fig 13C
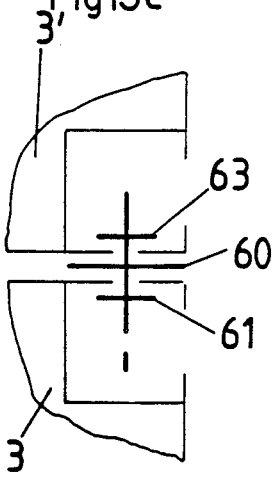
Fig. 13D
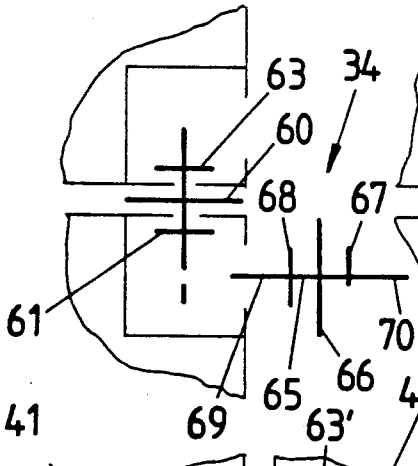
Fig.13E
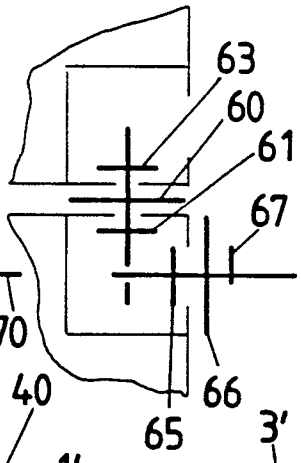
Fig.13F
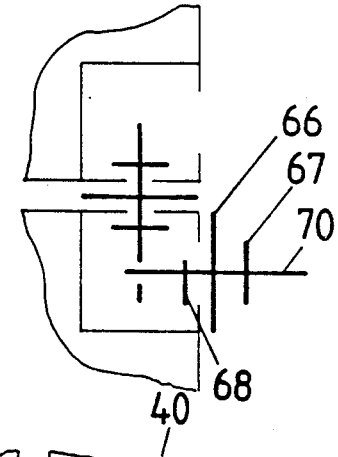
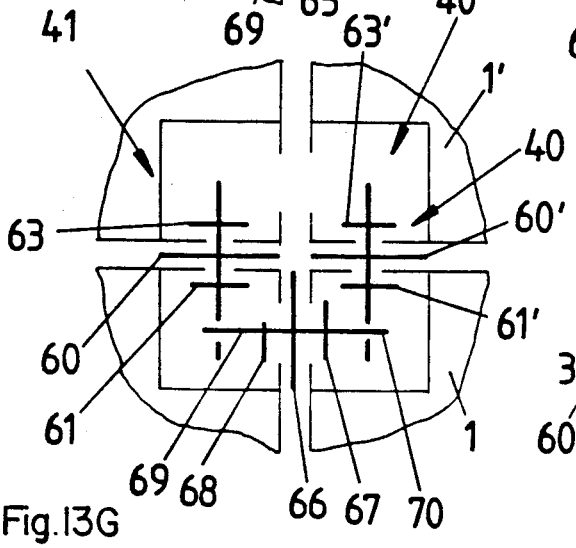
Fig.13G
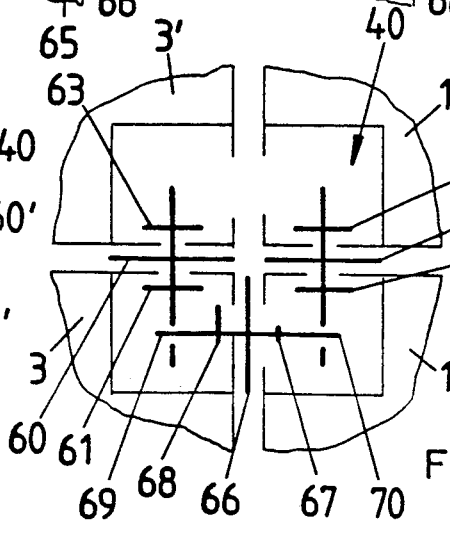
Fig.13H Fig. 14A
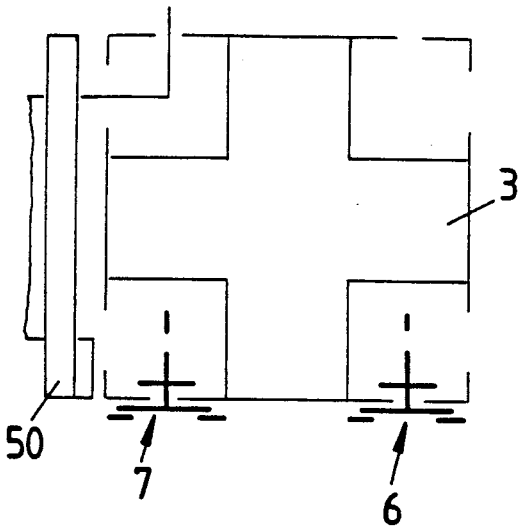
Fig. 14B
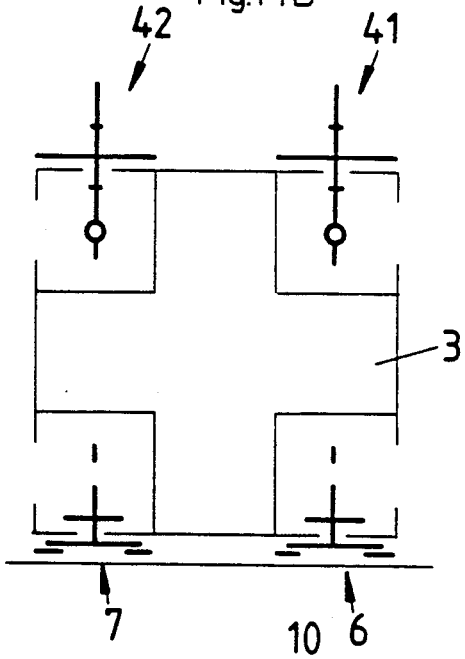
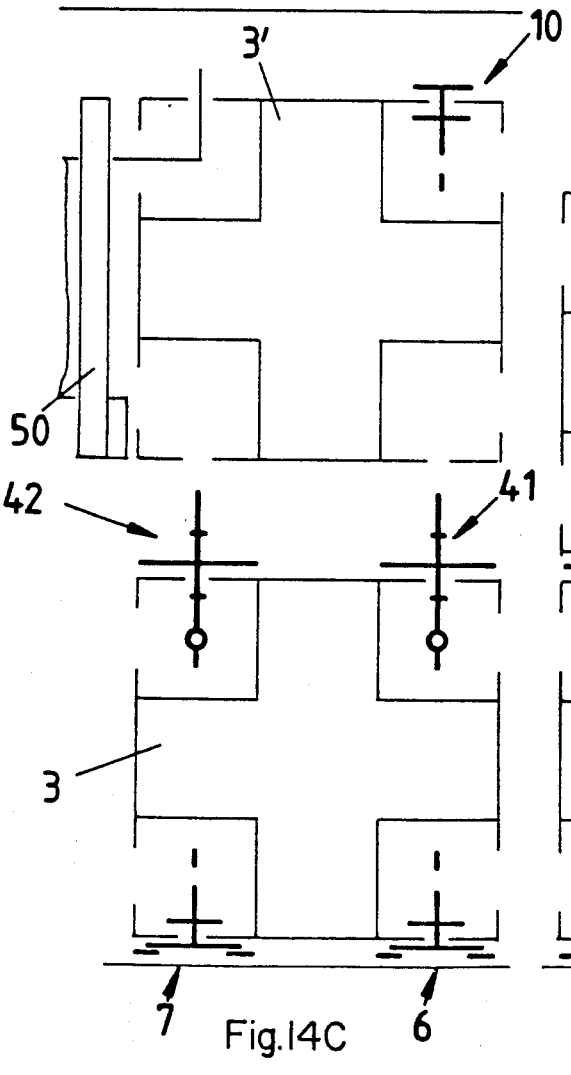
Fig. 14C
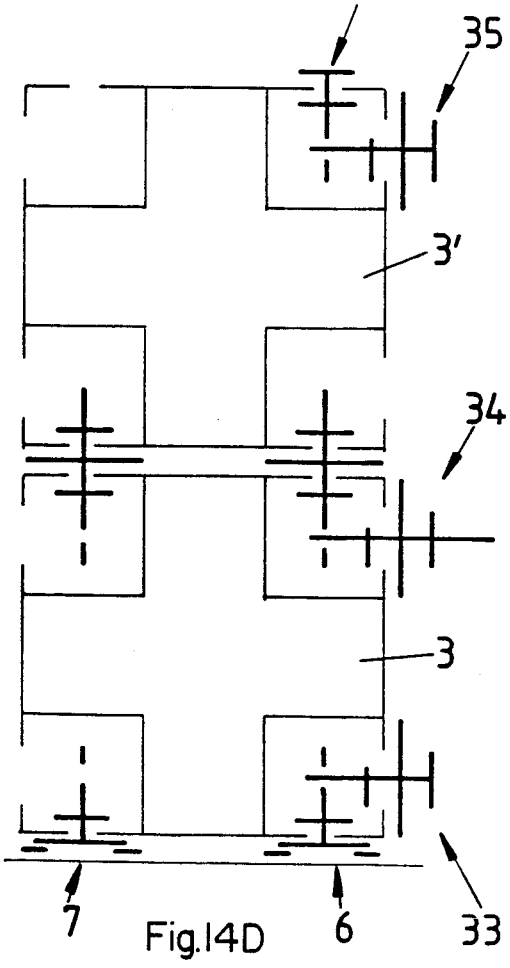
Fig. 14D Fig.14E
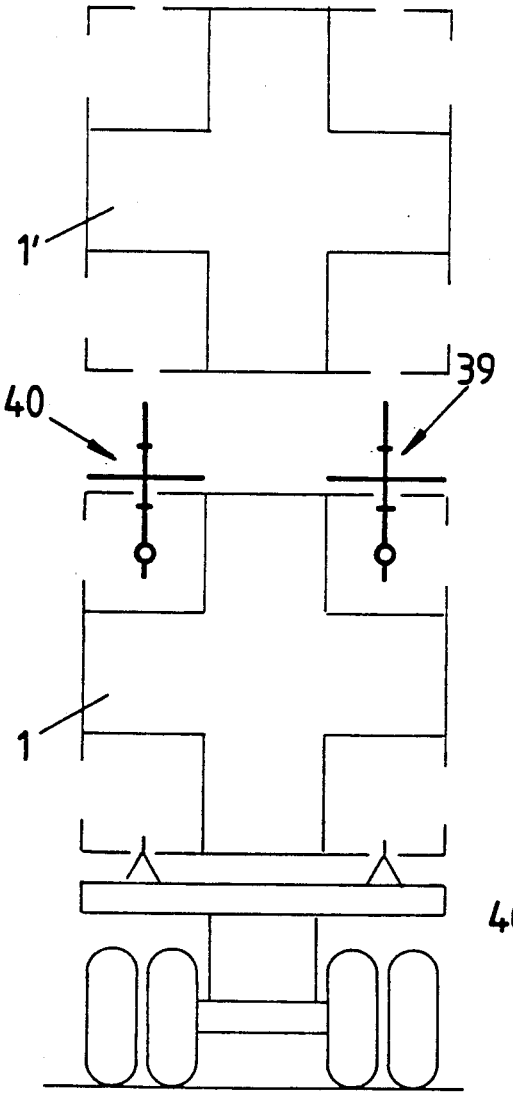
Fig.14F
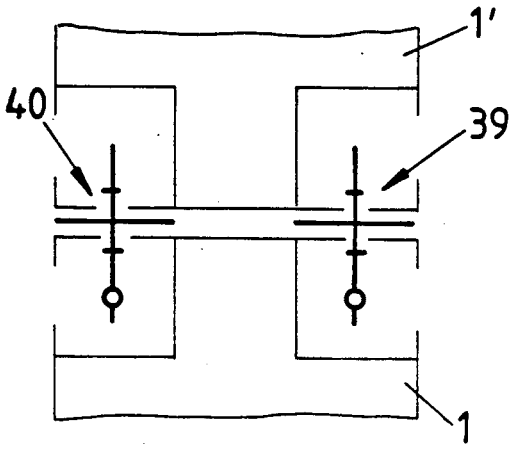
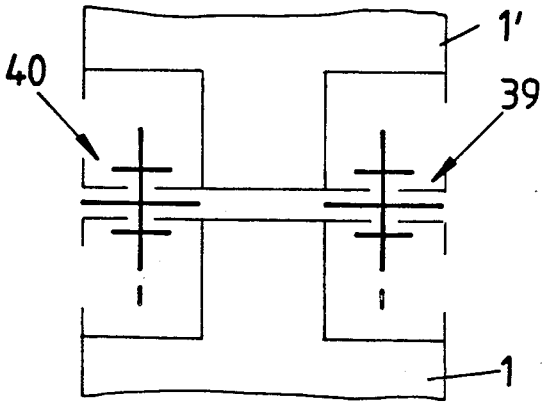
Fig.14G Fig 16
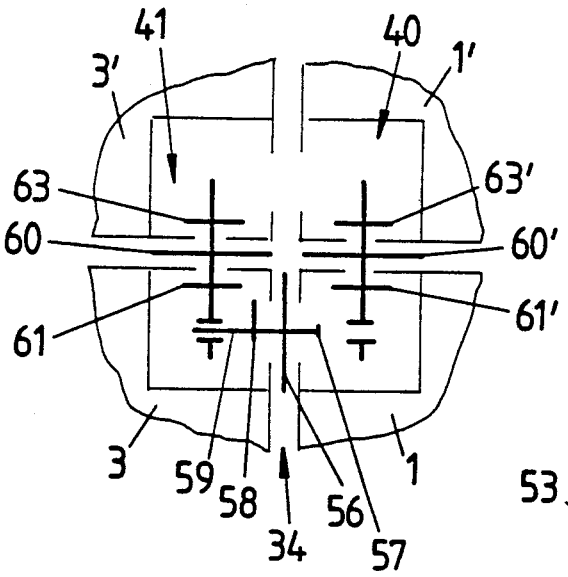
Fig 17
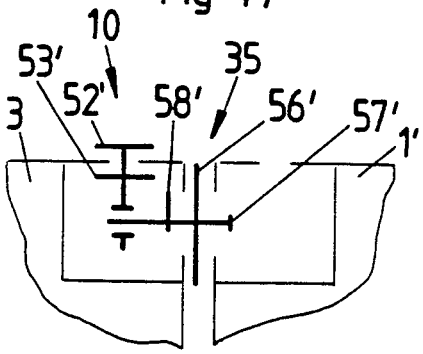
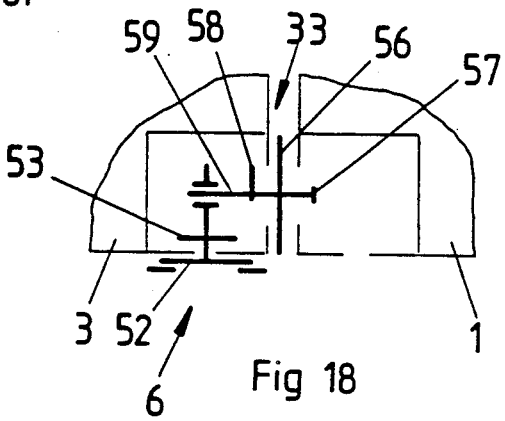
Fig 18
Fig 19
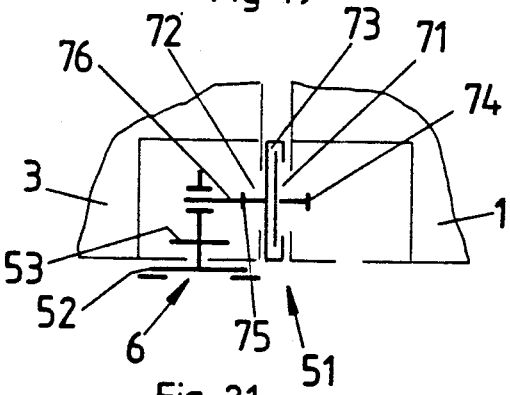
Fig 21
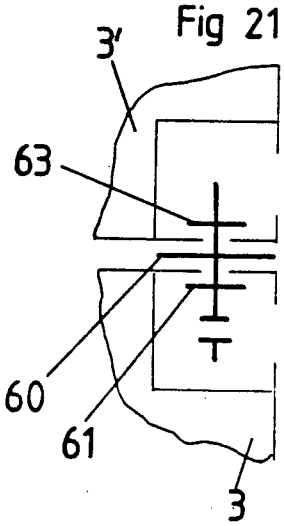
Fig 20
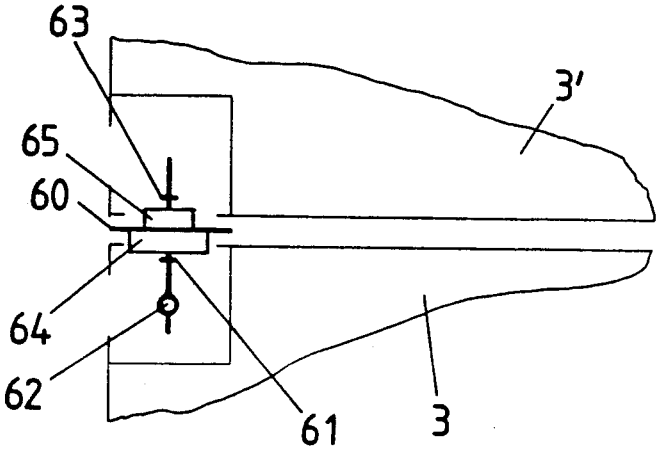

Fig 22
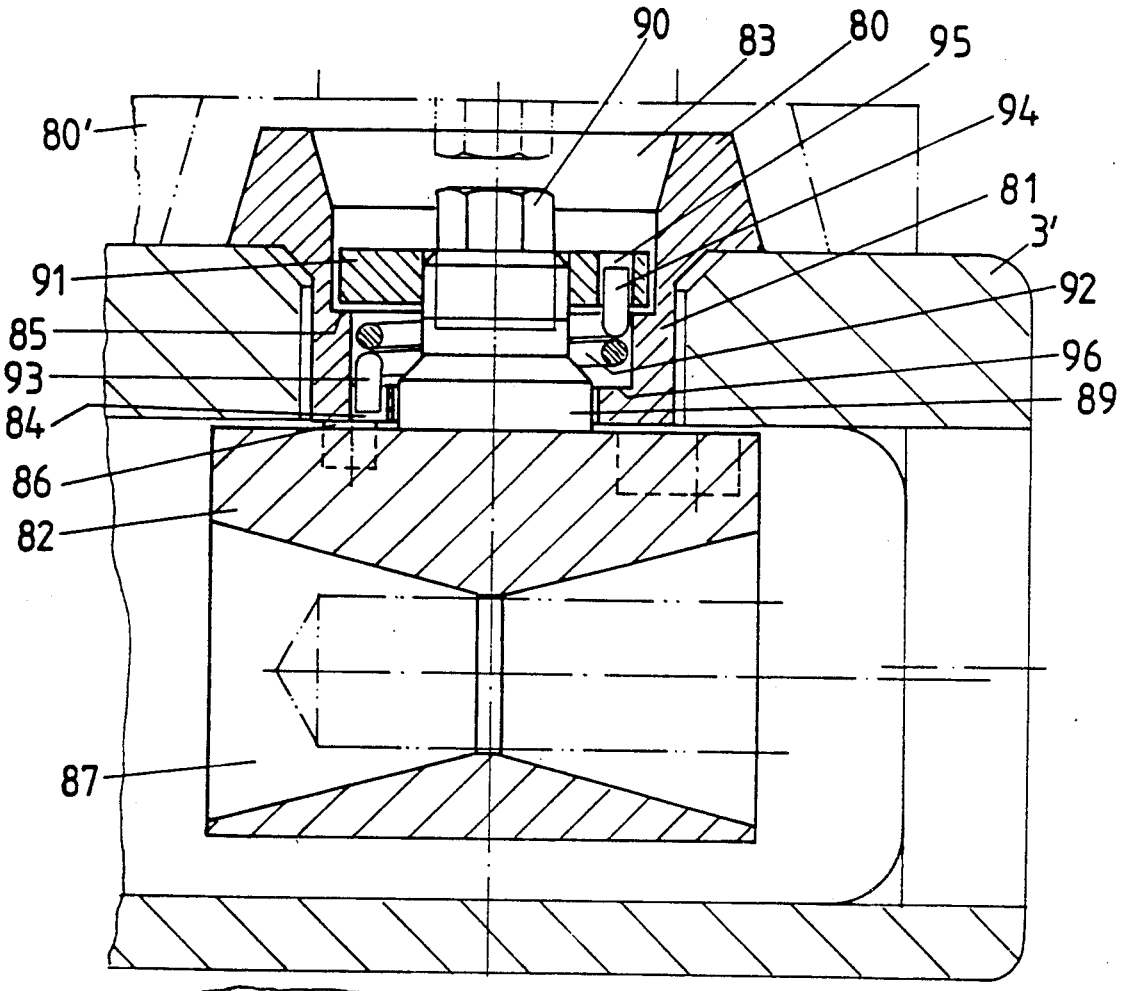
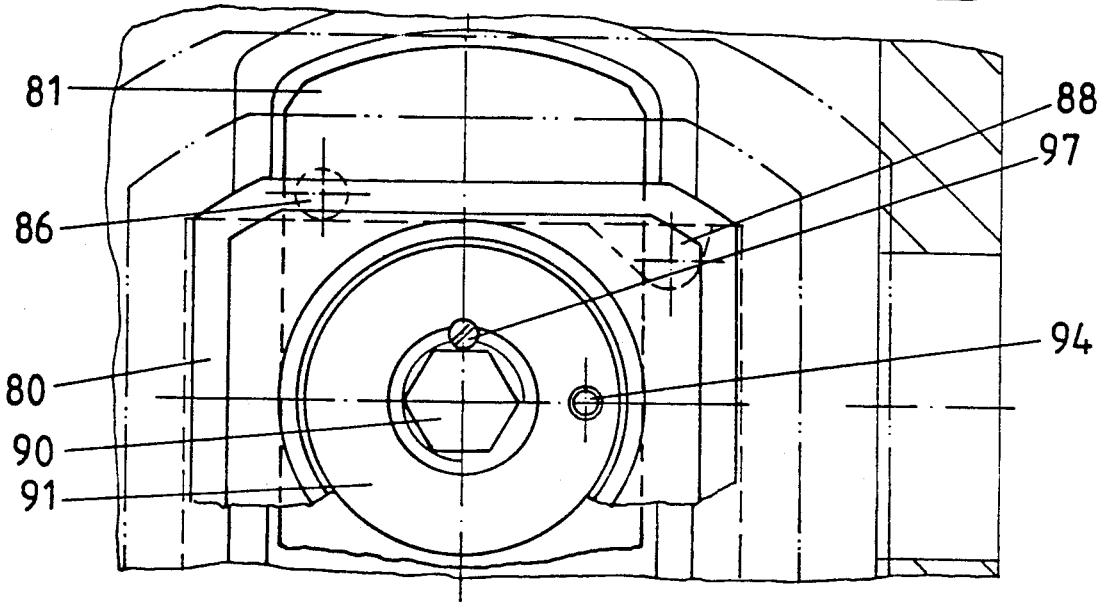
Fig 23

Fig 40
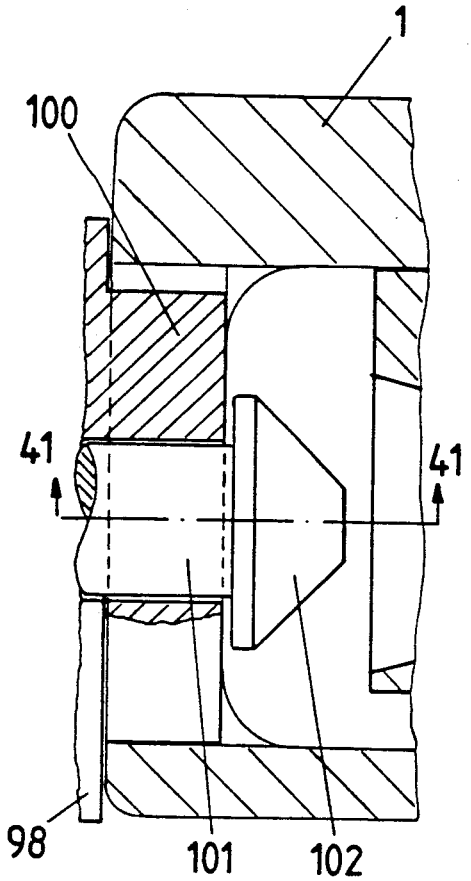
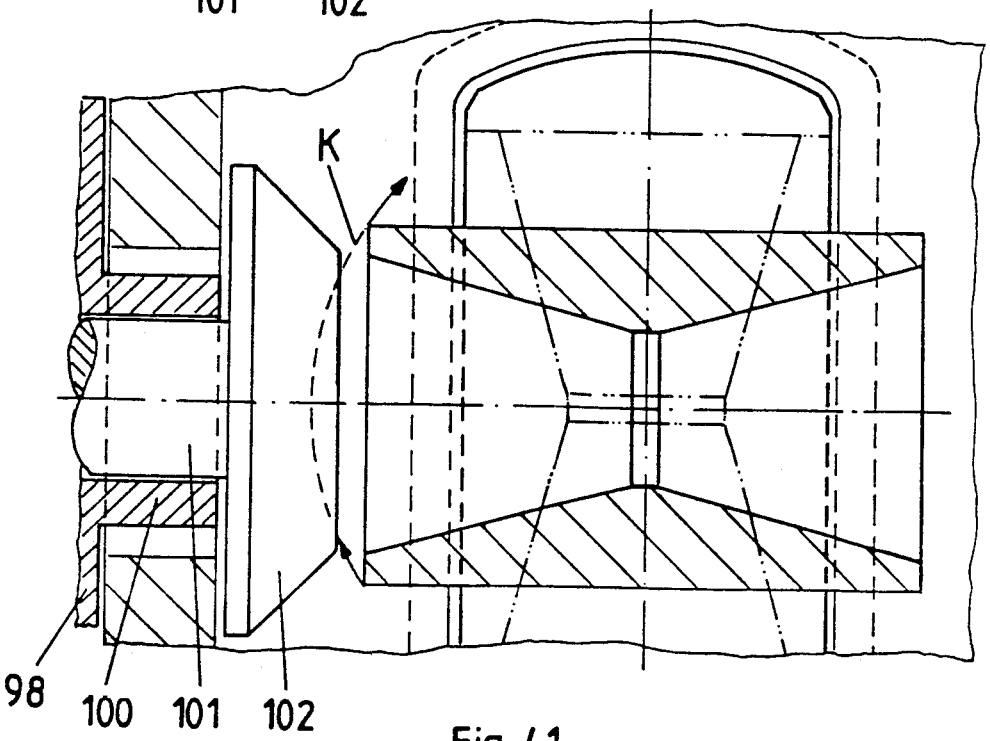
Fig 41

3
132
131
130
133
130a
137
1
142
144
141
140
143
138
129
130
131
132
130a
133
43
43
147
148
146
3

1'
40
192
180
1
3'
41
192
180
3
1
51'
3
182
188
184
186
190
3'
1'
192
180
55
3
55
1
1'
3'
187
191
183
185
189
193
181
3
1

METHOD FOR COMBINING AT LEAST TWO CONTAINER UNITS COMPRISING ISO CONTAINERS TO FORM A TRANSPORTATION UNIT, AS WELL AS THE TRANSPORTATION UNIT FORMED

The present invention relates to a method for combining at least two container units comprising ISO containers by the detachable coupling of corner fittings in the vicinity of two adjacent container units, whose side walls are juxtaposed, by means of coupling elements extending into anchoring openings, as well as to such a transportation unit.

It is already known German Patent No. (2 242 116) to couple together two ISO containers by means of the anchoring openings provided on their end faces, so that e.g. two 20′ containers can be confined into a single unit having the length and width dimensions of a 40′ container. This function is served by coupling elements in the form of twist locks, in each case connected to one of the two containers by separately operable elements. The twist locks are initially inserted in a container and undetachably coupled thereto, after which the coupling to the other container can take place.

In the known method using the aforementioned twist locks only two smaller standard containers can be end face interconnected in such a way that the dimensions of the resulting transportation unit, particularly with respect to the position of the anchoring openings in the upper surface, are such that the corresponding transportation unit can be grasped and moved by means of a conventional stacker or loader. However, this means that either only two 20′ containers or one 30′ container and a 10′ foot container can be combined into a transportation unit corresponding to the dimensions of a 40′ foot container, or that two 10′ containers can be combined into a transportation unit which then has the dimensions of a 20′ container. In this way it is not possible to interconnect 40′ or 30′ containers, because the resulting units cannot be handled by existing loaders or stackers, which are set up for standard container dimensions.

In another known method German Patent No. (3 048 718), in which use is made of containers with specially constructed container corners, the connection of two adjacent containers takes place by means of transverse elements in the form of screwed or bolted joints, the aim being to also permit the lateral coupling of adjacent containers.

It is also known to arrange several containers in juxtaposed form and combine them in that they are placed on a rigid support frame and fixed thereto. However, for this purpose it is necessary to have a specially constructed and very bulky support frame, which also increases the dimensions of the combined containers. Therefore this method has not been adopted for practical purposes.

A problem associated with existing container transportation is that at certain points a large number of containers are collected, which are discharged at such points and must them be transported therefrom to other points as empty containers, where loading again takes place. For this purpose, at present, these containers are handled in the same way as loaded containers and the object of the present invention is to provide a method enabling several containers to be combined in such a way that a transportation unit is obtained, which can be easily handled, so that as a result, particularly empty containers, can be transported inexpensively back to a starting point.

SUMMARY OF THE INVENTION

For achieving this object a method of the aforementioned type is inventively developed in such a way that an uneven number of container units is coupled together whilst leaving free at least all the anchoring openings present in the upper surface of the central container unit so as to permit the engagement of locking heads of lifting equipment and that in openings, located at one level, of adjacent containers of container units double function transverse elements are used, which allow a limited displacement of the containers coupled by them in a direction parallel to the longitudinal extension of the side wall thereof.

Thus, in the method according to the invention, an uneven number of container units is coupled together with their side walls adjacent, so that in each case there is a central container, whose upper container surface, including the corners having the anchoring openings, has the standard dimensions of an ISO container, i.e. can be gripped by a conventional loader or stacker, so that the complete transportation unit is raised essentially in the vicinity of its centre of gravity and can be moved from one stacking area to another, e.g. from a harbour quay to a container freighter. For this purpose, the anchoring openings in the upper surface of the central container unit are left free for the engagement of the locking heads.

In the case of combining container units in this way, it has been found that difficulties can occur because the spacings of anchoring openings of ISO containers can differ within the scope of the permitted tolerances. Thus, if two containers or container units are to be coupled together, in which in particular the spacings of the lateral openings in the direction of the longitudinal extension of the container on the one hand have a minimum and on the other a maximum within the tolerance range, it can prove difficult to join them by coupling with ordinary transverse elements between said anchoring openings, particularly if within the permitted tolerances the upper anchoring openings are also displaced in the direction of the longitudinal extension of the container with respect to the lower anchoring openings. Thus, according to the invention, use is made of double function transverse elements for coupling the container units, said elements in the inserted state permitting a limited displacement of the containers coupled by them in a direction parallel to the longitudinal extension of their side walls. The degree of possible displacement is obviously chosen in such a way that it eliminates the tolerance problems and permits an adaptation to the different positions of anchoring openings. It is possible to use double function transverse elements comprising reciprocally displaceable parts, or which engage with clearance and/or displacement in the anchoring openings in such a way that they do not impede the intended amount of displacement.

The invention also relates to a method of the aforementioned type, which is characterized in that an uneven number of container units is interconnected, whilst leaving free at least all the anchoring openings in the upper surface of the central container unit so as to permit the engagement of the locking heads of lifting equipment, that anchoring areas in the upper surfaces of the container units positioned laterally of the central container unit are blocked against the entry of locking heads of lifting equipment, for which purpose preferably the upper anchoring openings are at least partly closed and/or that between the lower surfaces of the container units positioned laterally of the central container unit and the placement surface for the transportation unit substantially non-displaceable supporting elements are provided in the plane of the lower surface of the container units.

If, using this method, an uneven number of container units is combined, as was described hereinbefore, there is a risk that during transportation the transportation unit will not be raised in the vicinity of the central container unit and therefore substantially in the vicinity of its centre of gravity but that instead the loader or stacker may be unintentionally engaged with a laterally positioned container unit. In order to prevent such misuse, anchoring areas in the upper surfaces of the container units positioned laterally of the central container unit are blocked against such an engagement, e.g. the upper anchoring openings are at least partly closed and for example blind twist locks can be placed in said anchoring openings. However, blocking can e.g. also be brought about in that a transverse element coupling an adjacent container extends so far into the upper container corner fitting of an outer container, that the space below the upper anchoring opening is no longer sufficiently free for the engagement of the locking head of lifting equipment.

Since in addition the transportation unit is anchored to a placement surface preferably with the lower surface of its central container unit, e.g. by means of a twist lock and for which purpose the lower anchoring openings of the central container unit are left free, the container units positioned laterally of the central container unit can be supported by the supporting elements, which can e.g. be blind twist locks. The supporting elements are kept substantially non-displaceable with respect to the lower surfaces of the container units and their height roughly corresponds to the thickness of the plate of the anchoring twist lock of the central container unit. These supporting elements also bridge diverging spacings between container stacking areas, such as on ships.

It is pointed out that there is no need to provide supporting elements for all lower anchoring openings of lateral container units. In particular, e.g. the lower anchoring openings of the outer container units furthest from the central container unit can be kept free from supporting elements.

As has already been stated, the anchoring opening provided in the lower surface of the central container unit preferably remains free, so that anchoring elements can be inserted, by means of which the transportation unit can be anchored on a stacking area or the like.

On combining the containers the transverse elements are conventionally inserted in the anchoring opening of one container unit and the latter is then moved up to the other container unit to be coupled to it in such a way that the free ends of the transverse elements enter the corresponding anchoring openings of the container unit kept stationary. To ensure that the inserted transverse elements, prior to entering the anchoring openings of the adjacent container unit, do not drop out again from the receiving anchoring openings of the ISO container or containers of the container unit to be moved and in order to keep them in an appropriately aligned position suitable for insertion into the anchoring openings of the stationary container unit, at least in the vicinity of a container unit coupled by such transverse elements can be brought into positive engagement with an auxiliary element extending through an anchoring opening of the same corner fitting at least in the vicinity of a container unit coupled by them. As will be explained hereinafter, such auxiliary elements can e.g. be blind twist locks and also, when forming container units from more than one container, by middle twist locks connecting the containers within a container unit.

According to a further development of the invention, the inventively used double function transverse elements can be inserted in the lower lateral anchoring openings, so that there is an adaptation to the different positions of said lateral anchoring openings.

In order to obtain a clearly defined connection between adjacent container units, additionally lateral anchoring openings of the containers coupled by the double function transverse elements can be coupled together by twist locks lockable with at least one end in an anchoring opening.

In order to additionally secure the connection of the container units within the transportation unit, it is possible to fit to the front faces of the container units tensile stress-absorbing coupling elements, such as lashing bars and/or clamps in a sloping (i.e. inclined) and/or horizontally positioned manner.

The invention also relates to a transportation unit of the aforementioned type, which is inventively characterized by an uneven number of interconnected container units, in which at least all the anchoring openings in the upper surface of the central container unit are left free so as to permit the engagement of locking heads of lifting equipment and in that in anchoring openings of adjacent containers of the container units located at one level there are transverse elements located having the form of double function transverse elements, which allow a limited displacement of the containers coupled by them in a direction parallel to the longitudinal extension of the side walls thereof.

Thus, the inventive transportation unit is constructed in the manner described hereinbefore in connection with the inventive method and contains double function transverse elements, which on the one hand bring about a coupling of adjacent containers and on the other permit the displacement thereof in a direction parallel to the longitudinal extension of their side walls, so that as a result the problems caused by the permitted tolerances of the positions of the container anchoring openings are simply eliminated.

The invention also relates to a transportation unit of the aforementioned type, which is inventively characterized by an uneven number of interconnected container units, in which at least all the anchoring openings in the upper surface of the central container unit are left free so as to permit the engagement of locking heads of lifting equipment, whilst in the plane of the upper surfaces of the container units positioned laterally of the central container unit upper anchoring areas are blocked against the entry of the locking heads of lifting equipment, e.g. in that upper anchoring openings are at least partly closed and/or supporting elements are inserted in the anchoring openings located in the plane of the lower surfaces of the container units positioned laterally of the central container unit.

The advantages of such a construction of an inventive transportation unit have been described hereinbefore in connection with the corresponding method.

In the case of an inventive transportation unit, which contains double function transverse elements and optionally transverse elements in the form of twist locks, it is possible to use a transverse element which, at least on one side and in an extension of its longitudinal axis, has a projecting pin, which extends into a bore in the head of a blind twist lock, so that the head of the blind twist lock is prevented from turning as a result of this positive engagement and consequently a removal of the blind twist lock is prevented with the transverse element inserted, whilst the transverse element is also kept in clearly defined alignment in the lateral anchoring opening.

To simplify the insertion of the pin into the bore in the blind twist lock head, the bore can taper from the opening side facing the transverse element towards the centre of the head.

When the transverse element has been inserted and its pin engages with the bore in the blind twist lock head, the longitudinal axis of the transverse element should extend parallel to the plane of the base surface of the container unit, so that all transverse elements engaging with blind twist locks are identically aligned or oriented and can consequently be inserted without difficulty into the lateral anchoring openings of the other container unit. This can be achieved in that the longitudinal axis of the bore in the head of the inserted twist lock is in each case somewhat deeper than the centre of the adjacent lateral anchoring opening. This arrangement ensures that the transverse element is not so tilted by the weight of its portion projecting from the container unit that said projecting portion is deeper than the inserted portion.

If double function transverse elements comprising two reciprocally displaceable portions are used for coupling adjacent container units, one portion of the double function transverse element can engage with its head behind the upper edge region of the anchoring opening receiving it and can be supported with a substantially horizontal bearing surface on a step on the head of the blind twist lock located in the locking position.

Thus, through the cooperation of the double function transverse element portion and the blind twist lock it is ensured that the element is kept reliably in a locking position for as long as the blind twist lock is in its locking position.

To ensure in such an arrangement that the blind twist lock is secured against accidental removal, such a double function transverse element with an axially displaceable pin can engage with a recess in the head of the blind twist lock. Following the insertion of the blind twist lock and the double function transverse element portion engaging therewith in the corresponding anchoring openings, said pin can be engaged with the recess in the head of the blind twist lock, so that it cannot be moved out of said engagement position following the coupling of the thus prepared container unit with another container unit. Only when the container units are separated again, can the pin of the double function transverse element be disengaged from the recess in the blind twist lock head.

If each container unit of the transportation unit comprises at least two superimposed containers, they can be interconnected by middle twist locks through anchoring openings provided on all four corners in their upper and lower container surfaces. Each middle twist lock can have a lower head constructed in accordance with the head of a blind twist lock.

In the case of such a transportation unit in order to also prevent accidental opening of those middle twist locks which are in a container unit which is not an outer container unit and e.g. which represent the middle twist locks of the central container unit, the head of the middle twist lock and that of the transverse element on at least one side can have a construction such that the head of the transverse element in the fitted state projects into the circumferential twisting circle of the middle twist lock head. This transverse element head is inserted into the lateral anchoring opening when the associated middle twist lock has already been inserted, so that the inserted head prevents a twisting of the middle twist lock head into a position in which the middle twist lock can be drawn out of the anchoring opening.

In order to permit a limited displacement of e.g. the upper container of a container unit comprising at least two containers for coupling with another container unit and thereby achieve an adaptation to the dimensional differences within the tolerance range, the collar of the middle twist lock adjacent to the lower head can have a greater width and length than that of the collar adjacent to the upper head, so that the middle twist lock is fixed in its position by the relatively accurate adaptation of the lower collar to the dimensions of the upper anchoring opening of the lower container, i.e. has a very accurately defined position with respect to the lower container, whereas the upper container is displaceable due to the smaller dimensions of the upper collar with respect to said collar and therefore with respect to the lower container.

If the container units in each case comprise two or more containers, preferably the lower containers of adjacent container units are coupled via all four lateral anchoring openings and the upper containers of adjacent container units via their two upper lateral anchoring openings, so that the main forces are absorbed by means of the four anchoring systems in the vicinity of the lower container, whereas the coupling via the two upper lateral anchoring openings generally only has to absorb relatively limited forces.

In order to make the coupling of the inventive transportation unit stronger and more reliable, it is possible to horizontally or slopingly fit to the front faces of adjacent container units tensile stress-absorbing coupling elements, such as lashing bars and/or clamps and the ends thereof can be inserted in frontal anchoring openings of the container.

It is pointed out that the ISO containers to be handled are those which are presently conventionally used and which fall within series 1 according to ISO 668. The container shapes and dimensions, as well as the position, shapes and dimensions of the anchoring openings therein are e.g. shown in the Ozean Service & Reparatur GmbH catalogue "Container and Trailer Lashing Systems".

A blind twist lock for performing the inventive method or for an inventive transportation unit has, as is conventionally the case for twist locks, a collar whose dimensions are adapted to those of the anchoring opening provided in the upper or lower container surface and with which are coupled a plate and head engaging on the outer edge region surrounding the anchoring opening. According to the invention, when the blind twist lock is inserted, this head can be pressed by spring tension into its locking position, so that it is prevented from dropping out.

In order to turn the head of the inserted blind twist lock back into the insertion position and in this way permit the blind twist lock to be removed from the anchoring opening, the head can be rotatably coupled with the collar and have an engagement element extending in the direction of the collar and plate which is accessible from the outside through a central opening in said plate and which can be engaged with an actuating element. The engagement element can e.g. comprise a screw head-like portion located in the central opening of the plate.

It is also possible to construct the head, collar and plate of the blind twist lock in one piece and to provide in a recess in the collar a supporting lever pivotable in limited manner about a vertical axis in the fitted state and which with the blind twist lock inserted presses same into the locking position and is supported on the boundary wall of the anchoring opening.

Such a blind twist lock has a particularly simple construction and by pivoting the supporting lever can be very simply inserted and then removed again from the anchoring opening without there being any risk of it being released therefrom in the inserted, locked state.

In order to be able to lock an inserted blind twist lock by means of the projecting pin of a transverse element, the head of the blind twist lock can have a bore extending at right angles to its rotation axis. This bore is preferably constructed as a through-bore, which tapers in funnel-shaped manner from both sides towards the centre.

Through the construction as a through-bore, the blind twist lock can be inserted in either of its two alignments into the anchoring opening and in each case the transverse element pin can be inserted in the bore in the blind twist lock head, insertion being facilitated by the funnel-shaped constriction.

In order to form a support for a portion of a double function transverse element which is yet to be described, the head of the blind twist lock can have between its free end and the collar a supporting face located in a plane at right angles to the rotation axis and whose surface normal is directed towards the free end of the head.

In order to be able to stack on top of one another identically constructed, inventive transportation units, a blind twist lock for insertion into an anchoring opening on the underside of a container can have in the supporting surface of its plate a recess, whose depth is substantially the same as the thickness of the plate and whose extension at right angles to the rotation axis in the case of a blind twist lock inserted in an anchoring opening is in at least one direction larger than the dimension of the anchoring opening in said direction. The recess of the plate of such a blind twist lock then receives the entire plate of a blind twist lock inserted in an anchoring opening on the top surface of a container of a transportation unit, so that the distance between the upper surface of the lower transportation unit and the lower surface of the upper transportation unit is the same as the standard height of the plate of a conventional twist lock. Obviously this construction of the blind twist lock plates can also be interchanged.

For joining two or more containers to form a container unit, it is possible to use middle twist locks, whose two heads are rigidly fixed to the end of a rotatable shaft extending through the plate and the two collars. The collar adjacent to the lower head in the inserted state has a greater width and length than the collar adjacent to the upper head.

If such a middle twist lock is inserted in an anchoring opening provided in the upper surface of a container, its collar fits relatively accurately, i.e. with a minimum undersize in said anchoring opening, so that the middle twist lock is substantially non-displaceable in the plane of the upper surface of the container. The upper collar of the middle twist lock is, however, much smaller, so that the upper container can not only be relatively easily placed on the four middle twist locks inserted in the upper surface of the lower container, but for adapting to dimensional tolerances with respect to the lower container can be displaced in the plane of its lower surface.

The lower head of the middle twist lock in the inserted state has a bore preferably extending at right angles to the axis and which can be a through-bore tapering in funnel-shaped manner towards the centre from both sides. As described hereinbefore in connection with the blind twist lock, into said bore can extend a pin of a transverse element, so that the middle twist lock is locked in the inserted state.

The transverse element for joining two container units within the transportation unit can be constituted by a twist lock, whose heads are rotatable with respect to the plate, said twist lock carrying on at least one head a pin extending coaxially to the rotation axis of the head and also beyond the same. In the inserted state, said pin can extend into the bore in the head of a blind or middle twist lock and lock same in its inserted position.

It is also possible to provide pins on both heads which extend beyond the same, said pins preferably then having different lengths. However, such twist locks are only used for locking adjacent middle twist locks.

A double function transverse element for the inventive method or transportation unit can have two portions, which can in each case be engaged with a lateral anchoring opening of a container, as well as being couplable or coupled to one another in such a way that they can be displaced in a limited manner relative to one another towards the longitudinal extension of the container coupled by them in the inserted state.

As stated hereinbefore, such a double function transverse element permits an adaptation of the position of adjacent containers or container units to be coupled to the different spacings of anchoring openings within the permitted tolerance ranges.

The portions can be coupled together by means of a dovetail guide and in order to non-detachably connect the portions, the receiving guide can be at least partly closed at its ends.

A locking head rotatable in a limited manner can be provided on one portion.

On the other portion can be provided a supporting part which, in the case of a portion inserted in a lower lateral anchoring opening, engages behind the upper edge of the anchoring opening and which in its area remote from the guide has a supporting surface, whose surface normal is directed downward when a portion is inserted in a lateral anchoring opening. If, with the portion inserted, said supporting surface is supported on a supporting surface provided on the head of an adjacent blind twist lock, the portion is locked in its position within the anchoring opening and can only be released by removing the blind twist lock from the anchoring opening.

In the other portion of the double function transverse element can be provided a locking pin, which extends parallel to the rotation axis of the locking head when the portions are engaged and is axially displaceable between a release position and a locking position, so that in the locking position it extends into an opening in the head of the adjacent blind twist lock and fixes same in its locking position. Thus, the blind twist lock can only be removed from the anchoring opening when the locking pin moves into the release position and then the head of the blind twist lock is rotated in its insertion position.

The locking pin can be in screw engagement with the supporting part of the portion, so that it can be moved between the release position and the locking position by corresponding rotation.

In the front faces of the container units of the transport unit are provided with diagonal lashings by means of lashing bars, ropes, etc. and/or transverse or cross lashings by means of clamps, an anchoring of the adjacent transport units by means of transverse elements is still appropriate, but it can be sufficient to couple them to transverse elements having a plate, on whose two sides are provided collars for insertion in lateral anchoring openings of adjacent container units. On one collar is provided a pin-like projection which, on insertion into an anchoring opening, extends into the interior of the associated container, whilst a locking head is provided adjacent to the other collar.

Such a transverse element is initially inserted in a lateral anchoring opening of a lateral container unit and is locked with its locking head in said anchoring opening. If the transverse element is then engaged with a lateral anchoring opening of an adjacent container unit, the collar further from the locking head is in the area of said anchoring opening and its projection extends into the interior of the container, so that the transverse element brings about a reciprocal alignment of the adjacent container units, whilst absorbing vertical and horizontal forces acting in the plane of the particular container side wall, the separation of container units being prevented by diagonal and/or cross lashings.

BRIEF DESCRIPTION OF THE DRAWINGS

The invention is described in greater detail hereinafter relative to embodiments and the attached drawings, wherein show:

FIG. 1: Perspectively a transportation unit comprising three container units, each container unit comprising one container.

FIG. 2: In a representation corresponding to FIG. 1, a transportation unit comprising three container units, in which each container unit comprises two interconnected containers.

FIG. 3: In a representation corresponding to FIGS. 1 and 2, a transportation unit comprising three container units, in which each container unit comprises three interconnected containers.

FIGS. 10A to 10H: Diagrammatically successive steps in the insertion of a lower blind twist lock, the insertion of an adjacent transverse element in the form of a twist lock and the insertion of the twist lock into the anchoring opening of an adjacent container.

FIGS. 11A to 11H: In representations corresponding to FIG. 10 the insertion of an upper blind twist lock and an adjacent transverse element in the form of a twist lock.

FIGS. 12A to 12D: The formation of a transportation unit from three container units, constituted by in each case one container, with the steps according to FIGS. 10 and 11.

FIGS. 13A to 13H: The insertion of a middle twist lock and the adjacent transverse element in the form of a twist lock, as well as the insertion of the twist lock into an anchoring opening of an adjacent container unit, with the connection of the twist lock to a middle twist lock of an adjacent container unit.

FIGS. 14A to 14I: The formation of a transportation unit constituted by three container units, each container unit comprising two containers and in which assembly is in accordance with FIGS. 10, 11 and 13.

FIG. 16: The arrangement of two middle twist locks and one twist lock serving as a transverse element and having a different construction to the twist lock of FIG. 13.

FIG. 17: The twist lock of FIG. 16 engaging with an upper blind twist lock.

FIG. 18: The twist lock of FIG. 16 engaging with a lower blind twist lock.

FIG. 19: A double function transverse element engaging with a lower blind twist lock.

FIG. 20: The construction of the collar of a middle twist lock.

FIG. 21: The middle twist lock of FIG. 20 in a view turned by 90°.

FIG. 22: In part section a blind twist lock inserted in the upper anchoring opening.

FIG. 23: In a partial representation a plan view of the blind twist lock of FIG. 22.

FIG. 40: In partial representation the head of a twist lock according to FIG. 31, carrying no locking pin, in a position relative to the head of an adjacent middle twist lock.

FIG. 41: A part section along line 41—41 of FIG. 40.

DETAILED DESCRIPTION OF PREFERRED EMBODIMENTS

Figure 4:
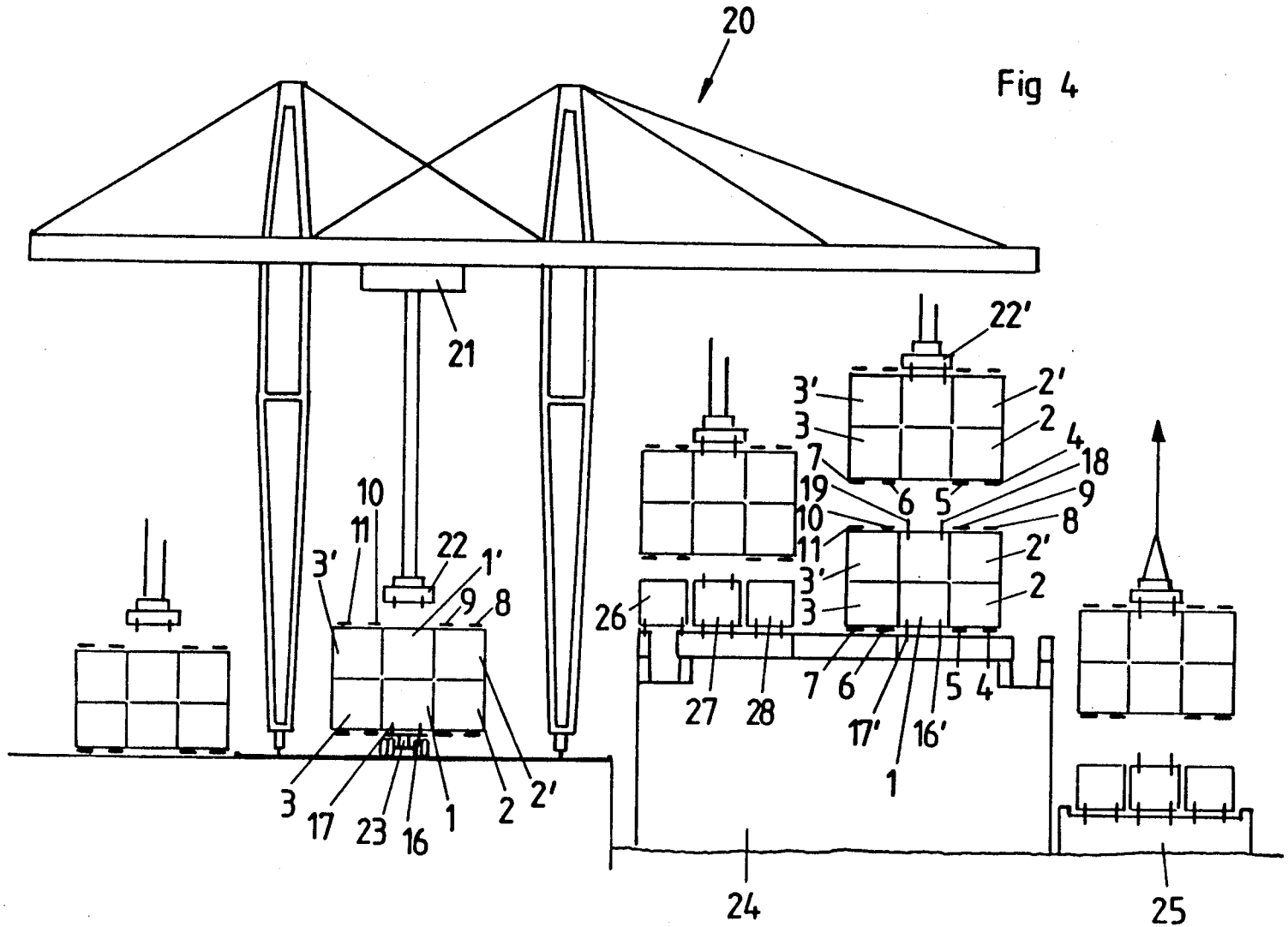
FIG. 4: A general view of identically constructed transportation units according to FIG. 2 in different transportation and handling stages.

FIG. 1 shows a transportation unit comprising three container units 1, 2, 3, each container unit being an individual ISO container, such as a 40′ container. The three containers 1, 2, 3 are adjacent to one another by their side walls, so that their upper and lower surfaces are in one plane and in not shown, but subsequently described manner they are detachably coupled together by means of anchoring openings provided in adjacent side walls and can also be coupled in part by means of anchoring openings provided in the upper and/or lower container surfaces.

Blind twist locks 4, 5, 6, 7, 8, 9, 10, 11, 12, 13, 14, 15, as yet to be described, are inserted in the anchoring openings provided in the lower and upper surfaces of the outer containers 2 and 3, so that all the upper and lower anchoring openings of the outer containers 2, 3 are closed, whilst the anchoring openings in the upper and lower surface of the central container 1 are open.

The transportation unit shown in FIG. 2 substantially corresponds to that of FIG. 1 and the same parts are given the same reference numerals. However, diverging from the transportation unit of FIG. 1, each container unit comprises two superimposed, detachably interconnected containers, i.e. the central container unit comprises the detachably interconnected containers 1, 1′ and the two outer container units comprise in each case the detachably interconnected containers 2, 2′ and 3, 3+.

The basic construction of the transportation unit according to FIG. 3 corresponds to those of FIGS. 1 and 2 and the same parts are given the same reference numerals. However, in this case each container unit comprises three superimposed and detachably interconnected containers, so that the central container unit comprises containers 1, 1′, 1″ and the two outer container units in each case containers 2, 2′, 2″, 3, 3′, 3″.

FIG. 4 diagrammatically shows a container ship loader 20 on a harbour quay and which carries a travelling winch 21, on which is attached a so-called spreader 22. Such a spreader can be engaged with the upper anchoring openings in the corner fittings of a container, following engagement the gripping elements automatically locking in the anchoring openings provided in the upper surface, thus permitting a raising of the container.

Below the spreader 22 hanging on travelling winch 21 is located a transportation unit according to FIG. 2, whose lower container 1 of the central container unit 1, 1′ rests on a diagrammatically indicated vehicle 23 and is fixed thereto in conventional manner by twist locks 16, 17, which are in locking engagement with anchoring openings in the lower surface of container 1, so that container 1 and therefore the complete transportation unit is firmly, but detachably connected to vehicle 23.

As is readily apparent, the transportation unit only rests on the vehicle by the lower container 1 of the central container unit 1, 1′, whilst the lateral container units 2, 2′ and 3, 3′ project over the vehicle in the lateral direction without any bottom support. It is appropriate to provide within the transportation unit a weight distribution such that there is no risk of tipping and in general empty containers are combined into a transportation unit such that said empty containers, after combination, can be particularly easily and inexpensively handled, i.e. there is no need to handle each individual container of such a transportation unit.

As indicated, by engagement of spreader 22, the transportation unit positioned below it can be engaged with the anchoring openings in the upper surface of container 1′ of the central container unit, whereas no such engagement is possible with the anchoring openings in the upper surfaces of containers 2′ and 3′ of the lateral container units 2, 2′, 3, 3′, because said anchoring openings are closed by the blind twist locks 8, 9, 10, 11. Thus, if spreader 22 is engaged with container 1′ and then twist locks 16, 17 are released, then the transportation unit can be raised from vehicle 23 by spreader 22 and e.g. can be set down to the left on the harbour quay surface. In this case the transportation unit rests on the lower blind twist locks 4, 5, 6, 7 (FIG. 2). However, it is also possible to place the transportation unit by means of spreader 22 on three containers 26, 27, 28 anchored by means of twist locks on the deck of a ship 24, the lower container 1 of the central container unit 1, 1' being coupled in the same way as with vehicle 23 via twist locks to container 27, whilst the outer container units engage on containers 26 and 28 with the blind twist locks located on the lower surfaces of the lower containers 2, 3.

As indicated in FIG. 4 a transportation unit can be directly stacked and fixed on the deck of a ship 24, the anchoring of the lower container 1 of central container unit 1, 1' taking place in conventional manner by using twist locks 16', 17' and the lateral container units 2, 2' and 3, 3' then rest on the deck with their blind twist locks 4, 5, 6, 7. As shown, a further transportation unit can be placed by means of spreader 22' of container ship loader 20 on said anchored transportation unit following the insertion of conventional twist locks 18, 19 in the anchoring openings in the upper surface of the central container. On stacking the additional transportation unit, twist locks 18, 19 engage with the anchoring openings in the lower surface of the lower container of the central container units and can then be locked, whilst the blind twist locks 4, 5, 6, 7 of the upper transportation unit engage round and are supported on the blind twist locks 8, 9, 10, 11 of the lower transportation unit. An example for the way in which these blind twist locks cooperate will be described hereinafter relative to FIGS. 22 and 24.

As can be gathered from FIG. 4 a transportation unit can be further transported in unchanged form, e.g. placed on containers or raised therefrom, which are anchored on the deck of a lighter 25. Stacking and removal take place in the manner described hereinbefore.

Thus a transportation unit comprising at least three container units can be handled in the same way as an individual container, which greatly reduces the costs for container handling.

The assembly of a transportation unit according to FIG. 2 can take place in the manner represented in FIGS. 5A to 5E.

Figure 5A:
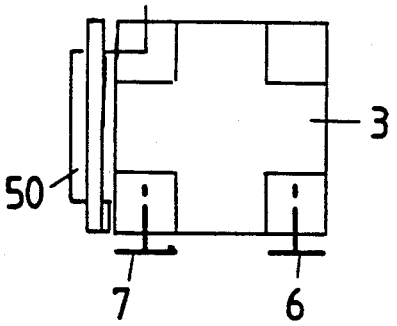
FIGS. 5A to 5E: Successive stages in the production of a transportation unit according to FIG. 2.
Figure 24:
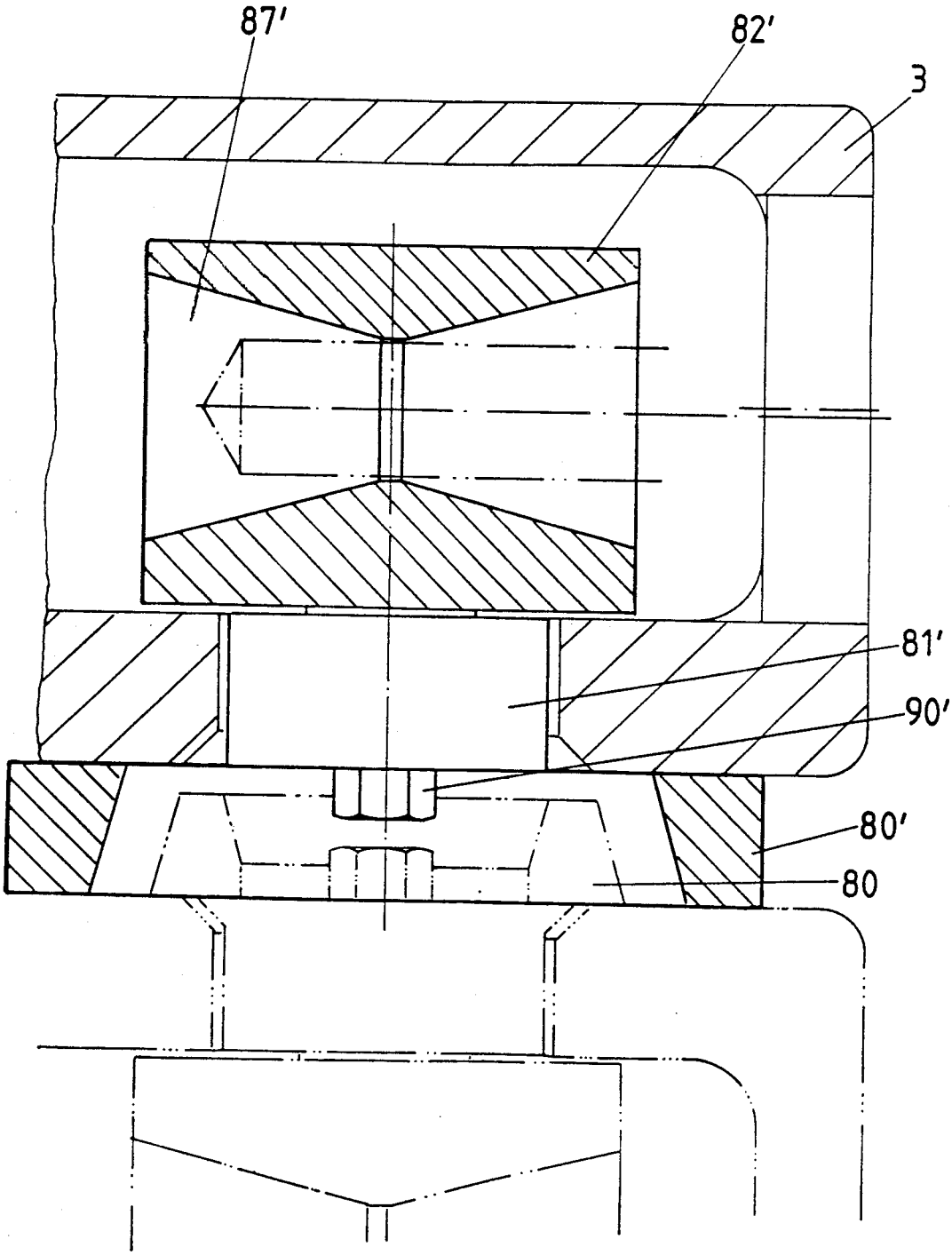
FIG. 24: In a partial view a blind twist lock inserted in a lower anchoring opening.
Figure 31:
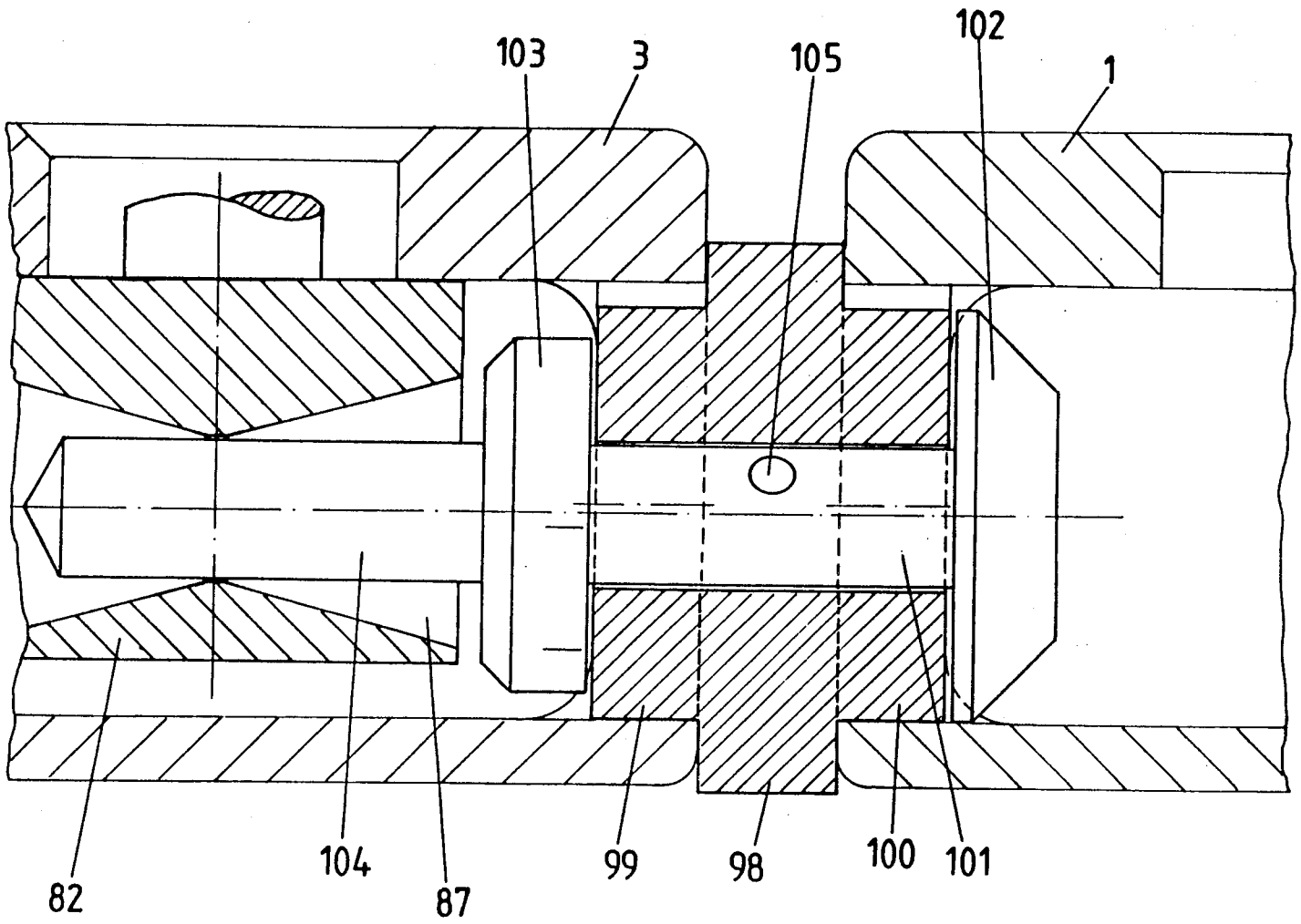
FIG. 31: In a partial section the lower head of an inserted blind twist lock of FIG. 22 and a transverse element in the form of a twist lock according to FIG. 16.
Figure 33:
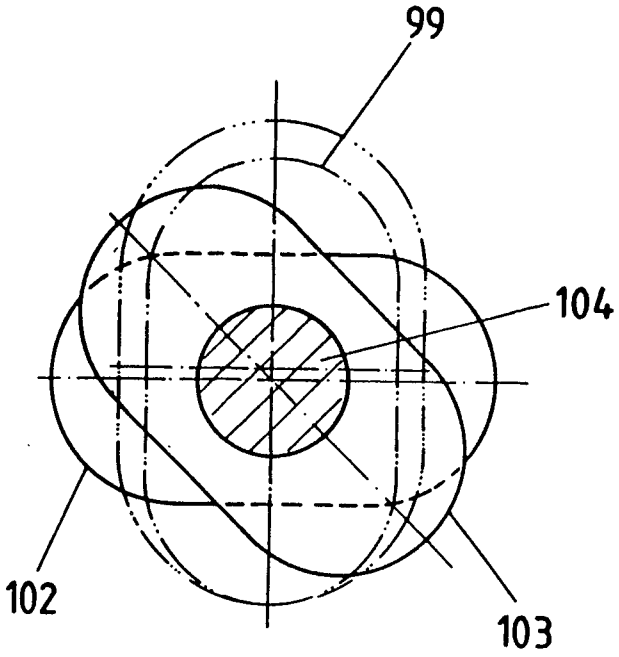
FIG. 33: The position of the heads of the twist lock of FIG. 31 in the locking position of FIG. 32.
Figure 32:
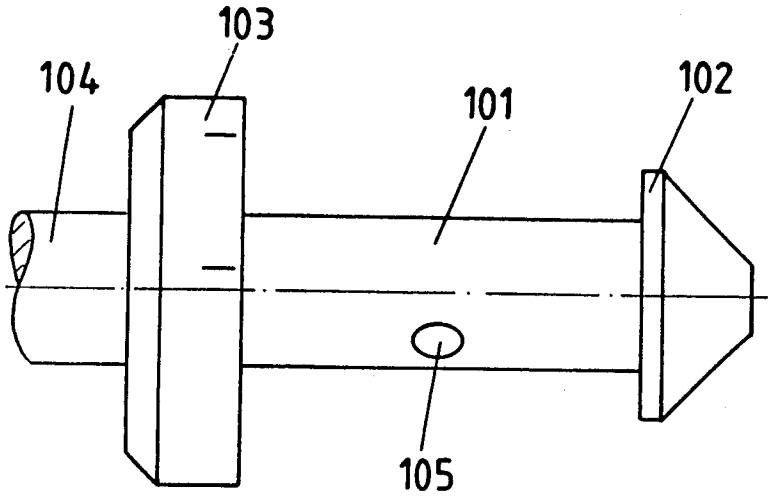
FIG. 32: The shaft or spindle of the twist lock of FIG. 31 with the heads provided thereon.

As shown in FIG. 5A, initially the lower container 3 of the lateral container unit 3, 3' is raised by means of a side stacker 50, whereof only the gripping part is diagrammatically shown, in order to insert blind twist locks 6, 7, which can e.g. be in the form of blind twist locks of the type shown in FIG. 24, in the four anchoring openings in its lower surface. Container 3 is then set down and in the anchoring openings in its upper surface are inserted middle twist locks 41, 42, such as those shown e.g. in FIGS. 34 and 35. Transverse elements 33, e.g. in the form of the twist locks shown in FIGS. 31 to 33 are inserted in the two lower anchoring openings of the side face of container 3 which, in the finished transportation unit, faces the lower container 1 of the central container unit. During insertion, e.g. through locking pins provided therein, they positively engage with the blind twist locks 6, so that the blind twist locks cannot be removed from the anchoring openings, without previously removing transverse elements 33.

Figure 5B:
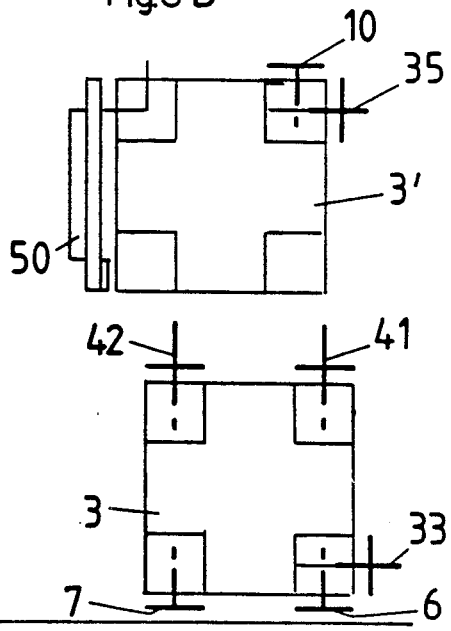

As indicated in FIG. 5B, using side loader 50, on the thus prepared container 3 is placed container 3', so that the upper portions of the middle twist locks 41, 42 engage with the anchoring openings in the lower surface of container 3' and can be locked in the engaged position. Thus, container units 3, 3' is formed and in it are then placed the transverse elements 34, e.g. in the form of twist locks, which engage with the lower heads of the middle twist locks 41.

In the upper right-hand corners of container 3' in FIG. 5B blind twist locks 10 are inserted before or after the joining together of containers 3, 3' and are locked by positive engagement through transverse elements 35 inserted in adjacent lateral anchoring openings and which can e.g. correspond as regards construction to transverse elements 33, 34.

Figure 5C:
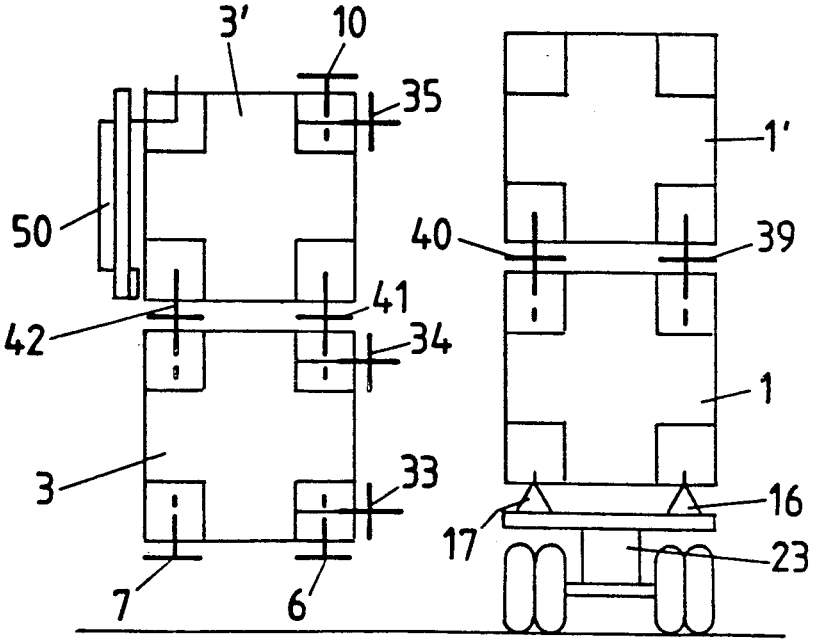
Figure 5D:
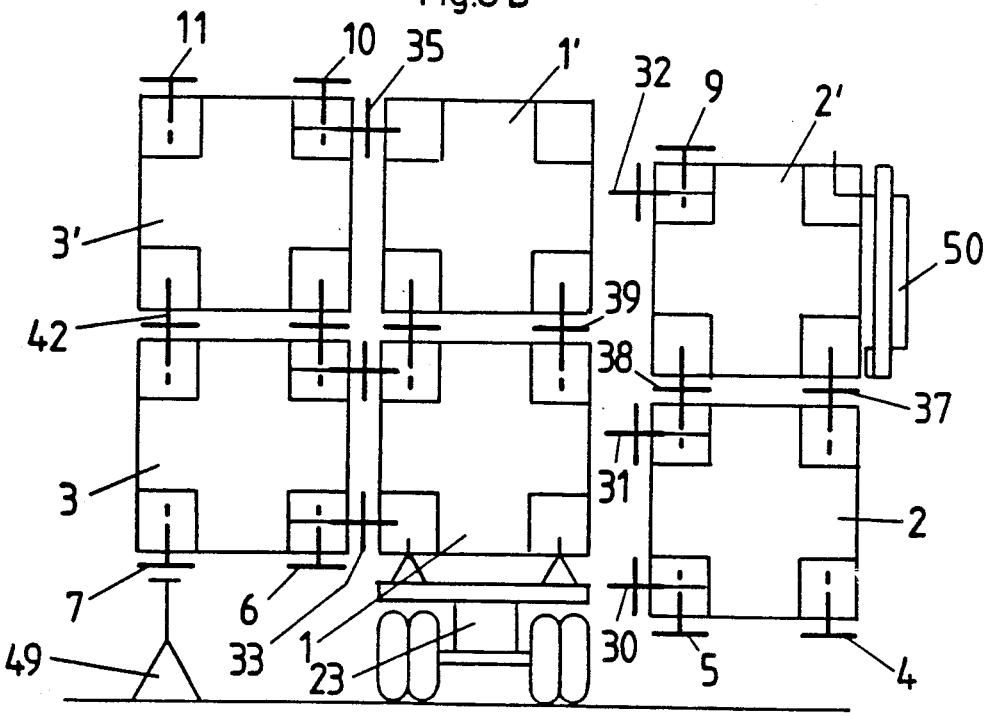

Container unit 3, 3' can then be connected to a prepared, central container unit 1, 1' (FIG. 5C). This prepared container unit 1, 1' rests on a vehicle 23 and is fixed thereto by means of twist locks 16, 17, which are in locking engagement with the anchoring openings in the lower surface of container 1. The two superimposed containers 1, 1' are joined by middle twist locks 39, 40, whose construction corresponds to middle twist locks 41, 42. Using side loader 50, container unit 3, 3' is moved up to thus prepared, central container unit 1, 1' and the transverse elements 33, 34, 35 are engaged with the four anchoring openings in one side wall of container 1 and with the upper anchoring openings in the superimposed side wall of container 1' and are locked in said engagement position. Prior to the moving away of the side loader supports 49 (FIG. 5D) are placed under the outer blind twist locks 7 of container unit 3, 3', in order to avoid tipping of the thus formed partial transportation unit.

The other lateral container unit 2,2' is now connected to the central container unit 1, 1'. Containers 2, 2' of container unit 2, 2' are connected in the same way as the containers of container unit 3, 3' by means of middle twist locks 37, 38 and are provided with blind twist locks 4, 5, 9 and in them are also inserted transverse elements 30, 31, 32 for connection to the container unit 1, 1' and which correspond to the transverse elements 33, 34, 35. The connection with the central container unit 1, 1' is performed in the same way by means of side loader 50, as the connection of container unit 3, 3' with container unit 1, 1', so that now container units 2, 2' and 3, 3' are positioned on either side of the central container unit 1, 1' and are coupled thereto by means of the anchoring openings provided in the side walls (FIG. 5E).

It is pointed out that the blind twist locks 8 and 11 are inserted in the outer anchoring openings in the upper surface of container 2' or 3' after removing the link with side loader 50.

Figure 5E:
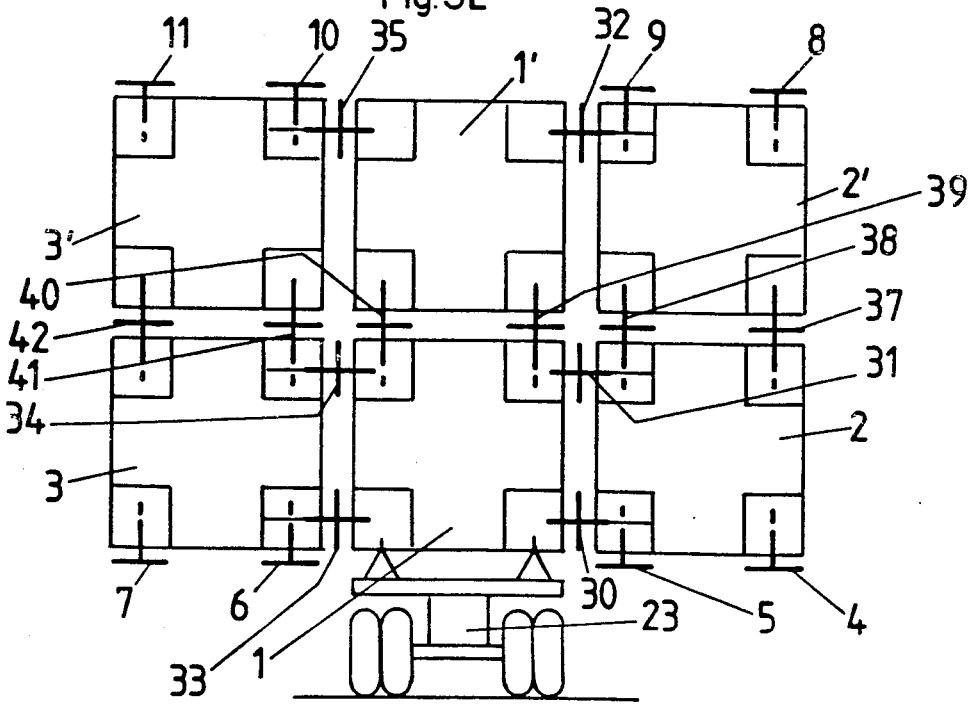
Figure 6:
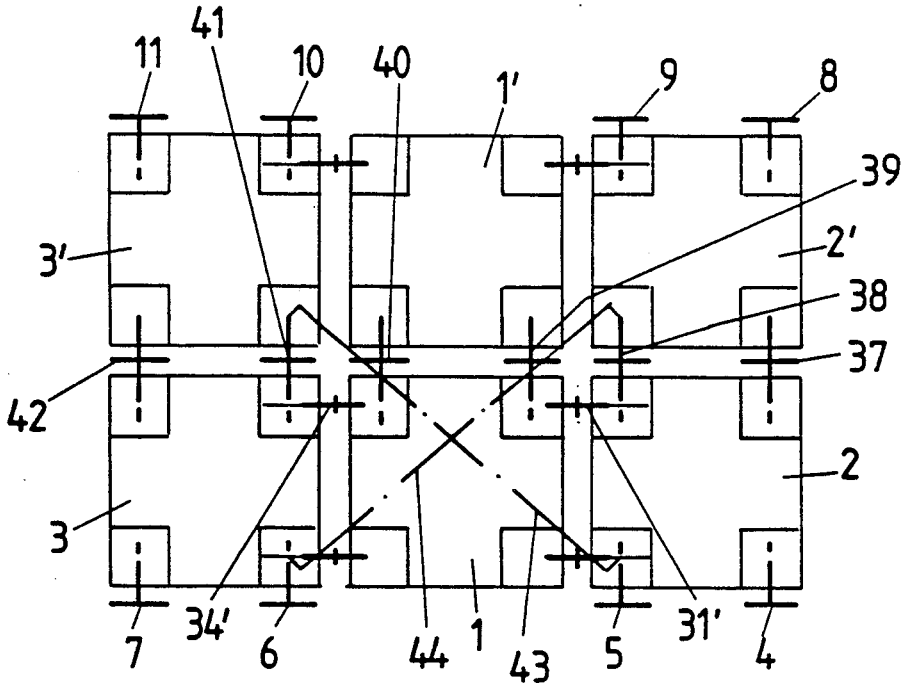
FIG. 6: A transportation unit according to FIG. 2 with diagrammatically indicated transverse elements locking only one side, together with diagonal lashings on the end faces.

As indicated in FIG. 6, a transportation unit according to FIG. 5E can additionally be held together by diagonal lashings 43, 44. As shown, these diagonal lashings are located on both end faces of the transportation unit and by engagement with the corresponding frontal anchoring openings couple the inner lower corner of container 2 to the inner lower corner of container 3', as well as the inner lower corner of container 3 to the inner lower corner of container 2'. Such lashings can e.g. be produced with the aid of lashing bars and locking screws and can alone absorb the transverse and diagonal forces within the transportation unit, so that the transverse elements coupling the container units need only be constructed in such a way that they take up the forces acting in the plane of the particular container side wall, i.e. prevent a vertical reciprocal displacement of the container units. Such a transverse element is e.g. shown in FIGS. 48 and 49.

Figure 7:
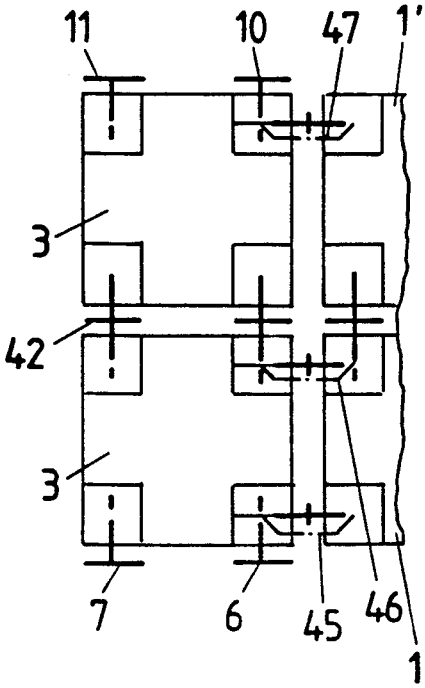
FIG. 7: A partial view of a transportation unit according to FIG. 6, but with cross lashings provided on the end faces.

FIG. 7 shows a transportation unit corresponding to FIG. 5E, in which clamps 45, 46, 47 are provided on end faces adjacent to the transverse elements and which serve as cross lashings. Suitable clamps are e.g. shown in the aforementioned catalogue. In this case coupling takes place in the horizontal direction by the clamps, so that a transverse element according to FIGS. 48 and 49 can be used.

Figure 8:
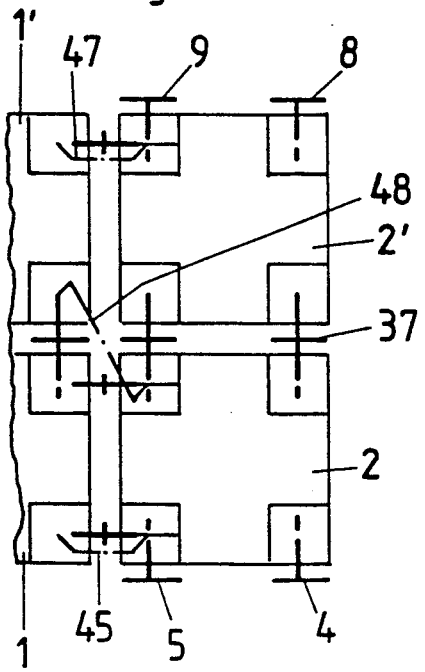
FIG. 8: A partial view of a transportation unit according to FIG. 7, but with additional diagonal lashings.

FIG. 8 shows a transportation unit corresponding to FIG. 5E with a combination of cross lashings constituted by clamps 45 and 47 according to FIG. 7 and diagonal lashings 48 located on the end face of the transportation unit between the inner upper corner of container 2 and the adjacent corner of container 1' as well as in not shown manner between the inner upper corner of container 3 and the adjacent corner of container 1'.

Figure 9:
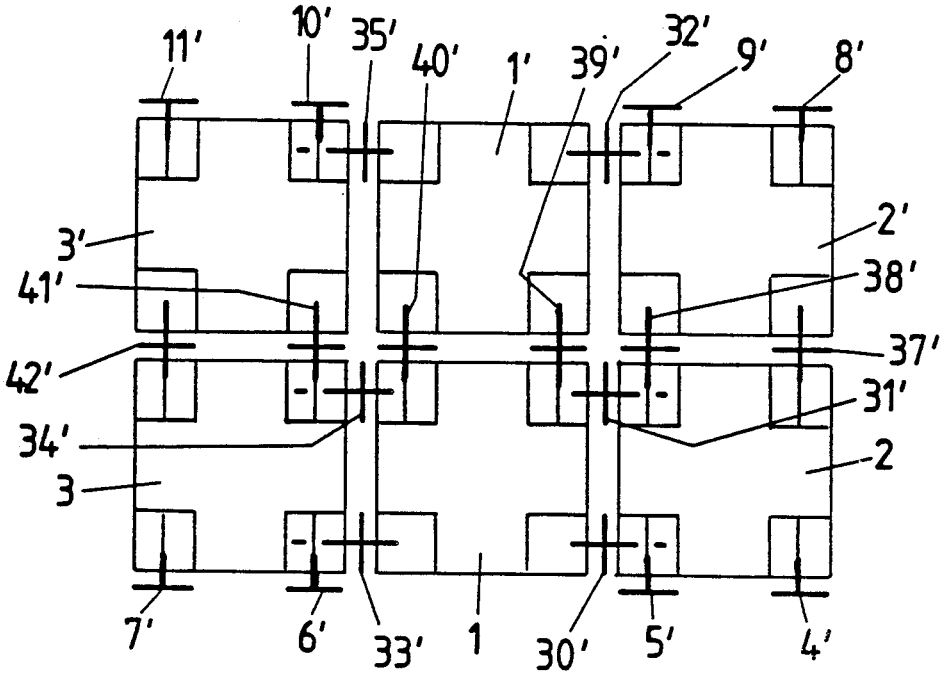
FIG. 9: A transportation unit according to FIG. 2 with transverse elements locked in position by blind twist locks and the middle twist locks of the outer container units.

The transportation unit according to FIG. 9 essentially corresponds to the transportation unit of FIG. 5E and the transverse elements, blind twist locks and middle twist locks are given the same reference numerals followed by an apostrophe.

Diverging from the transportation unit according to FIG. 5E, in the transportation unit according to FIG. 9 a coupling of the inner blind twist locks 5', 9' and 6', 10' and the inner middle twist locks 38', 41' of the outer container units 2, 2' to transverse elements 30', 31', 32' and 33', 34', 35' takes place in such a way that the blind twist locks and the lower portions of the middle twist locks secure the transverse elements in their locked position in the particular container so as to prevent unlocking, whilst in the case of the transportation unit according to FIG. 5E the transverse elements prevented an unlocking of the inner blind twist locks and the inner middle twist locks of the outer container units. It is possible to use for locking according to FIG. 9 e.g. transverse elements as shown in FIGS. 31 to 33 and blind twist locks as shown in FIGS. 25 to 28, the arrangement of the pins and bore being reversed. Thus, initially the lower containers 1, 2, 3 are interconnected and transverse elements 31' and 34' are inserted. This is followed by the stacking of containers 1', 2', 3'. For this purpose initially the middle twist locks 37', 38', 39', 40', 41' and 42' are inserted, so that the middle twist locks 38' and 41' come into locking engagement with transverse elements 31' and 34' and then containers 1', 2', 3' are stacked, or containers 1', 2', 3' are stacked with middle twist locks inserted in their lower anchoring openings.

Thus, with the construction according to FIG. 9, the individual container units 1, 1', 2, 2' and 3, 3' are only formed when the complete transportation unit has been installed.

Details regarding the nature of the insertion of the blind twist locks and a transverse element coming into locking engagement therewith are shown in FIGS. 10A to 10H and the blind twist lock can be constructed according to FIG. 24 and the transverse element corresponding to the twist lock of FIGS. 31 to 33.

Hereinafter a description is given of the insertion of the blind twist lock 6 in container 3 and the insertion of transverse element 33 into container 3, as well as the coupling thereof with container 1 (FIG. 5E), the remaining components obviously being installed in the same way.

For inserting the blind twist lock in a lower anchoring opening of container 3, with respect to its plate 52 head 53 of blind twist lock 6 is turned in the insertion position, so that the longitudinal axis of locking bore 54 is parallel to the adjacent lateral anchoring opening in container 3 (FIG. 10A). In this position, the longitudinal extension of head 53 is in the direction of the longitudinal extension of the lower anchoring opening, so that head 53 can be inserted into the anchoring opening (FIG. 10B). In this inserted position head 53 is rotated by 90°, so that it engages behind the edge of the anchoring opening and the longitudinal axis of the locking bore 54 is at right angles to the plane of the lateral anchoring opening (FIG. 10C).

In this position of the blind twist lock the transverse element 3, which is in the form of a twist lock with a plate 56, a rotary shaft or spindle 55 extending through the latter with locking heads 57, 58 provided on either end, as well as a locking pin 59 extending shaft 55 (FIG. 10D), is inserted into the adjacent lateral anchoring opening, the plate-like locking head 68 to be inserted being located in the vertical position, i.e. its longitudinal extension coincides with the direction of the longitudinal extension of the lateral anchoring opening of container 3 (FIG. 10E). During this insertion, which is performed until plate 56 engages on the outer wall of container 3, the locking pin 59 is inserted into the locking bore of head 53 of the blind twist lock 6, so that the head 53 cannot be turned in the insertion position and is instead kept in its locking position by positive engagement with locking pin 59. In order to bring the locking head 58 of transverse element 33 into a prelocking position, shaft 55 is rotated by approximately 45°, so that the plate-like locking head 57 of transverse element 33 comes into a position in which its longitudinal extension is in the direction of the longitudinal extension of the lateral anchoring opening of the container 3 (FIG. 10F). In this position, locking head 58 engages behind the lateral anchoring opening of container 5 at an angle of approximately 45° to the vertical, so that transverse element 33 cannot be removed from or drop out of this lateral anchoring opening.

In this position of transverse element 33 the outer container 3 is moved up to the central container 1 and the locking head 57 of transverse element 33 passes into the lower lateral anchoring opening of container 1 (FIG. 10G). By further rotation of shaft 55 by 90°, the locking head 57 comes into its locking position, in which its longitudinal extension extends substantially at right angles to the longitudinal extension of the lateral anchoring opening of container 1 and in which the locking head 58 has moved into its locking position, in which it engages behind the edge of the lower lateral anchoring opening of container 3 at an angle of 45° to the vertical, but 90° with respect to the position shown in FIG. 10G (FIG. 10H).

FIGS. 11A to 11H show the insertion of a blind twist lock according to FIGS. 22 and 23 and a transverse element according to FIGS. 31 to 33 in the vicinity of the upper corner of an upper container, whereby in this case is shown the insertion into the upper inner corner of container 3' and the coupling with the upper associated corner of container 1' of a transportation unit according to FIG. 5E. Identical or corresponding parts of the blind twist lock and transverse element are given the same reference numerals as in FIGS. 10A to 10H, but have an additional apostrophe.

As can be readily seen, the sequence of the insertion of blind twist lock 10 and transverse element 35, as well as the coupling with container 1' precisely corresponds to the sequence described relative to FIGS. 10A to 10H.

FIGS. 12A to 12D show in detail the assembly of a transportation unit according to FIG. 1 in accordance with FIGS. 10A to 10H and 11A to 11H. The sequence representation essentially corresponds to that of FIGS. 5A to 5E and the same reference numerals are used for the same parts. However, as the container units in the embodiment according to FIGS. 12A to 12D only comprise in each case one container and not, as in FIGS. 5A to 5E, two containers, the upper blind twist locks in FIGS. 12A to 12D also have an apostrophe.

The represented sequence of inserting and turning the blind twist lock and the transverse elements to be coupled therewith precisely corresponds to the sequence from FIGS. 10A to 10H and 11A to 11H, so that there is no need to explain this sequence again.

Figure 12C:
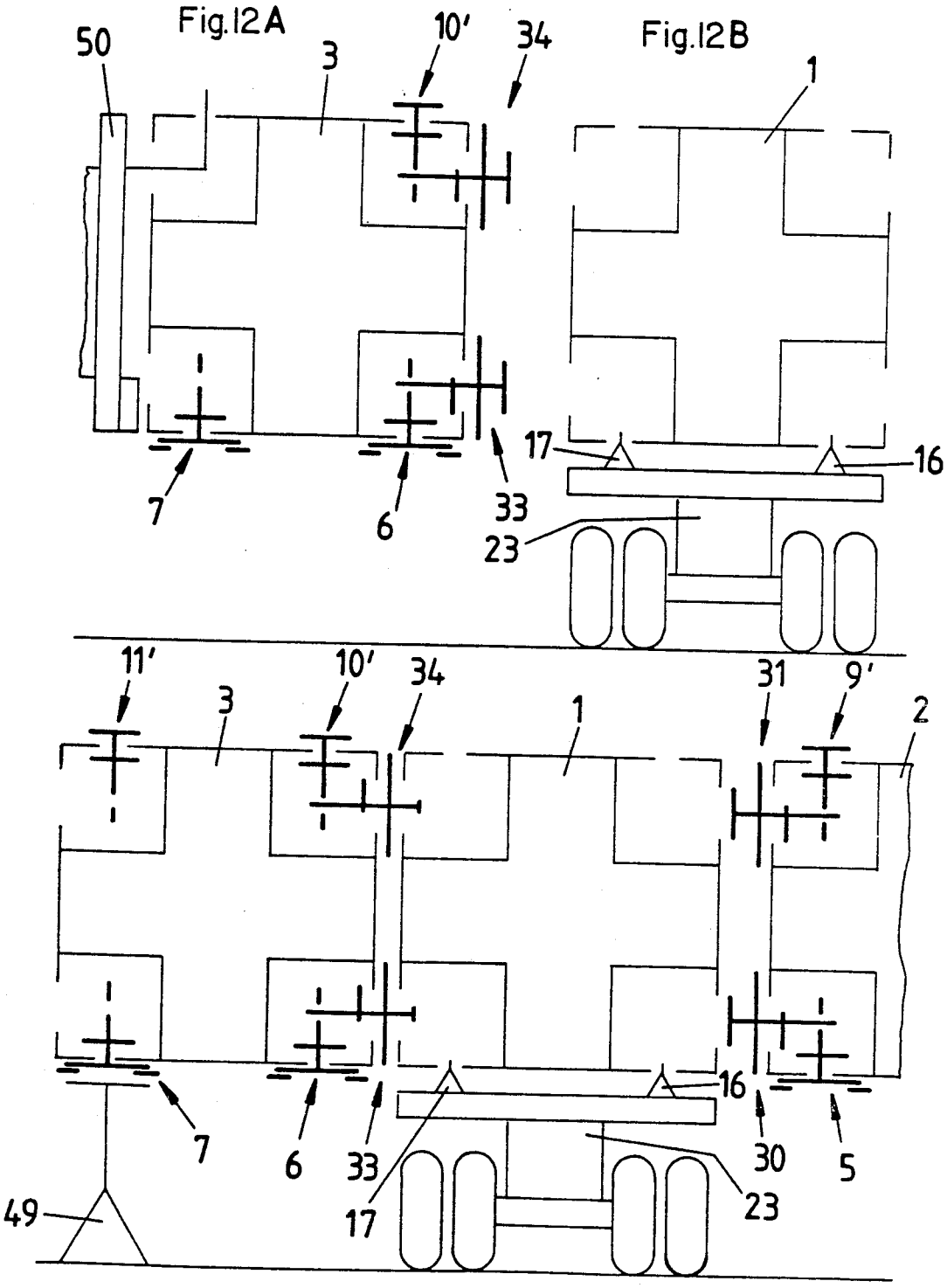
Figure 12D:
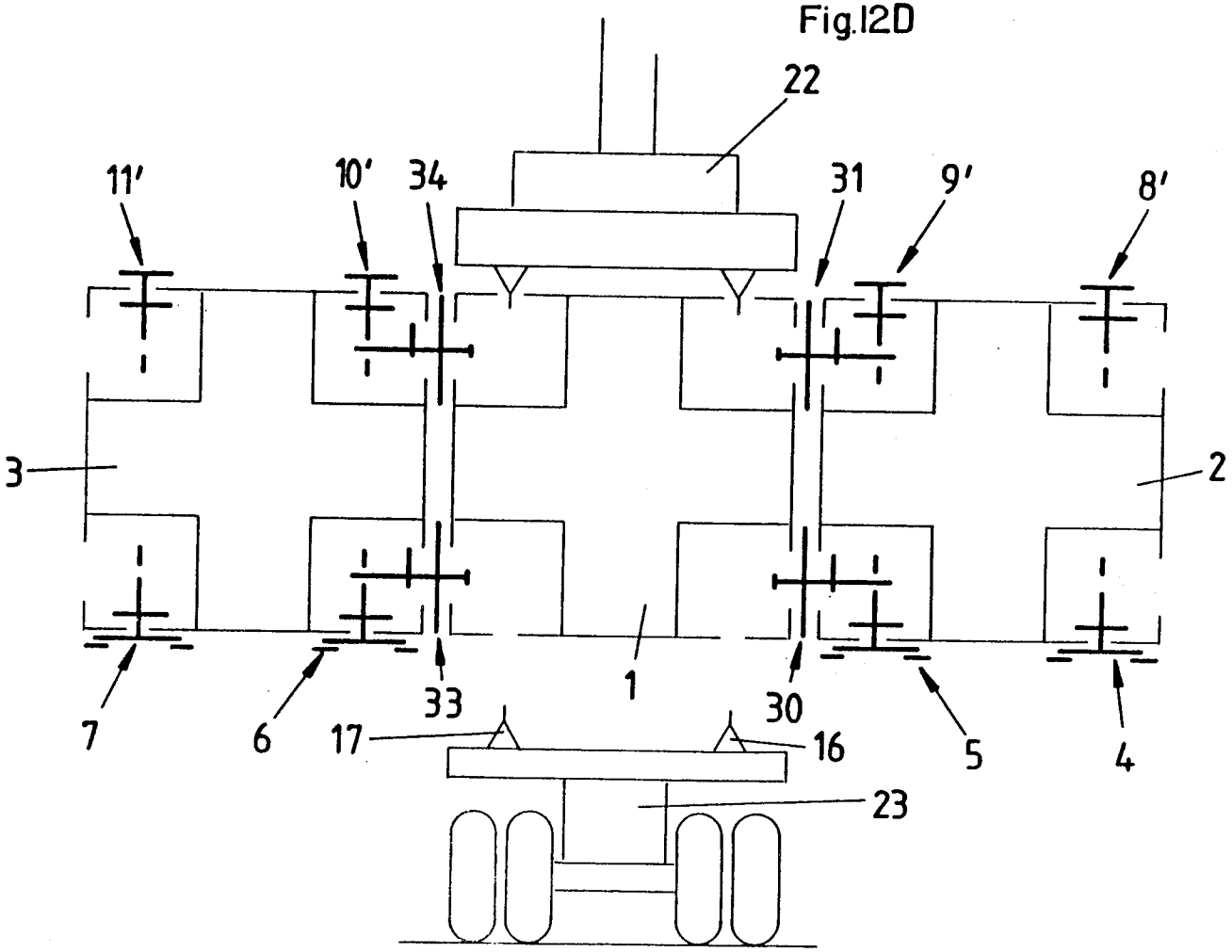
Figure 14H:
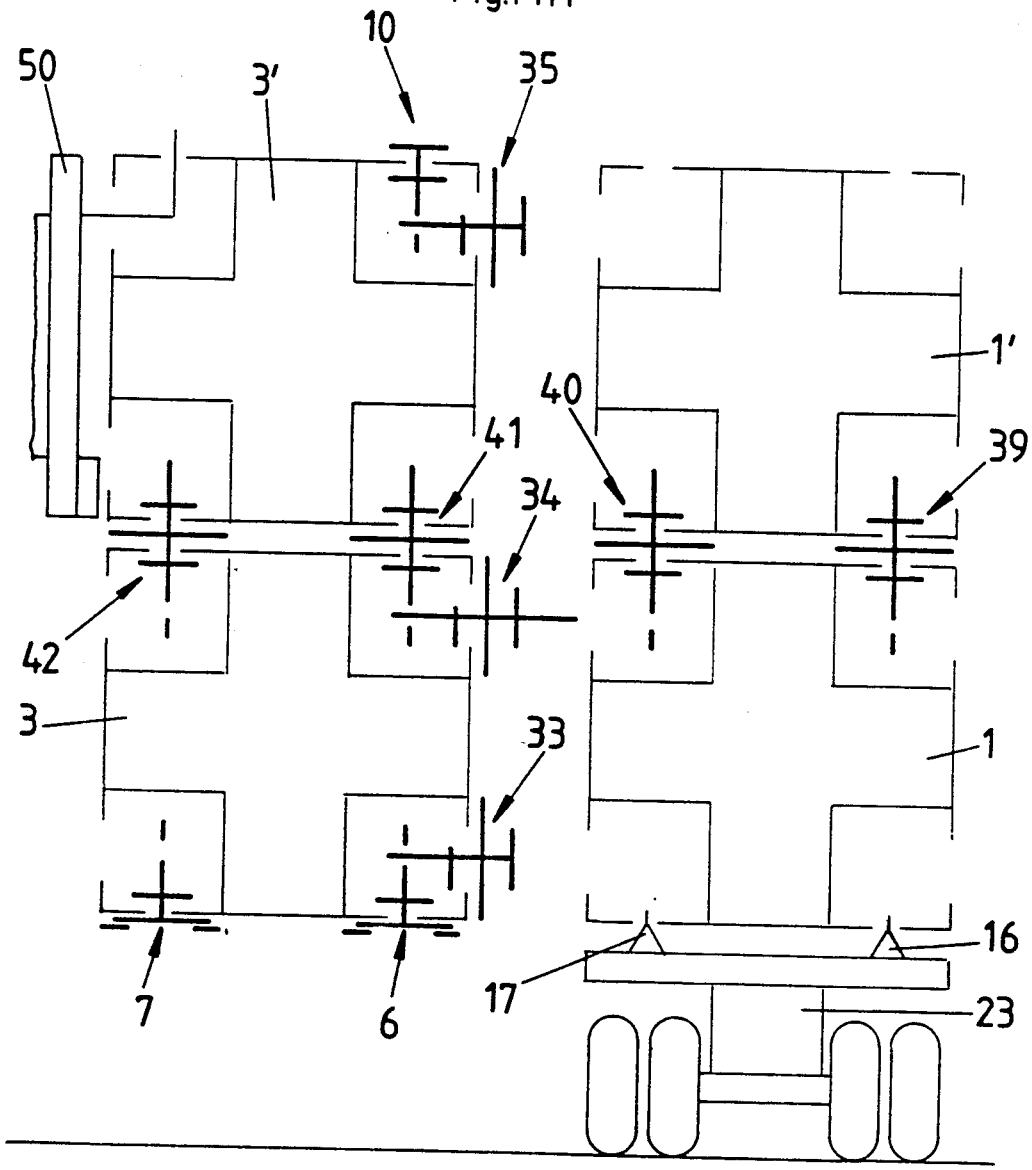
Figure 141:
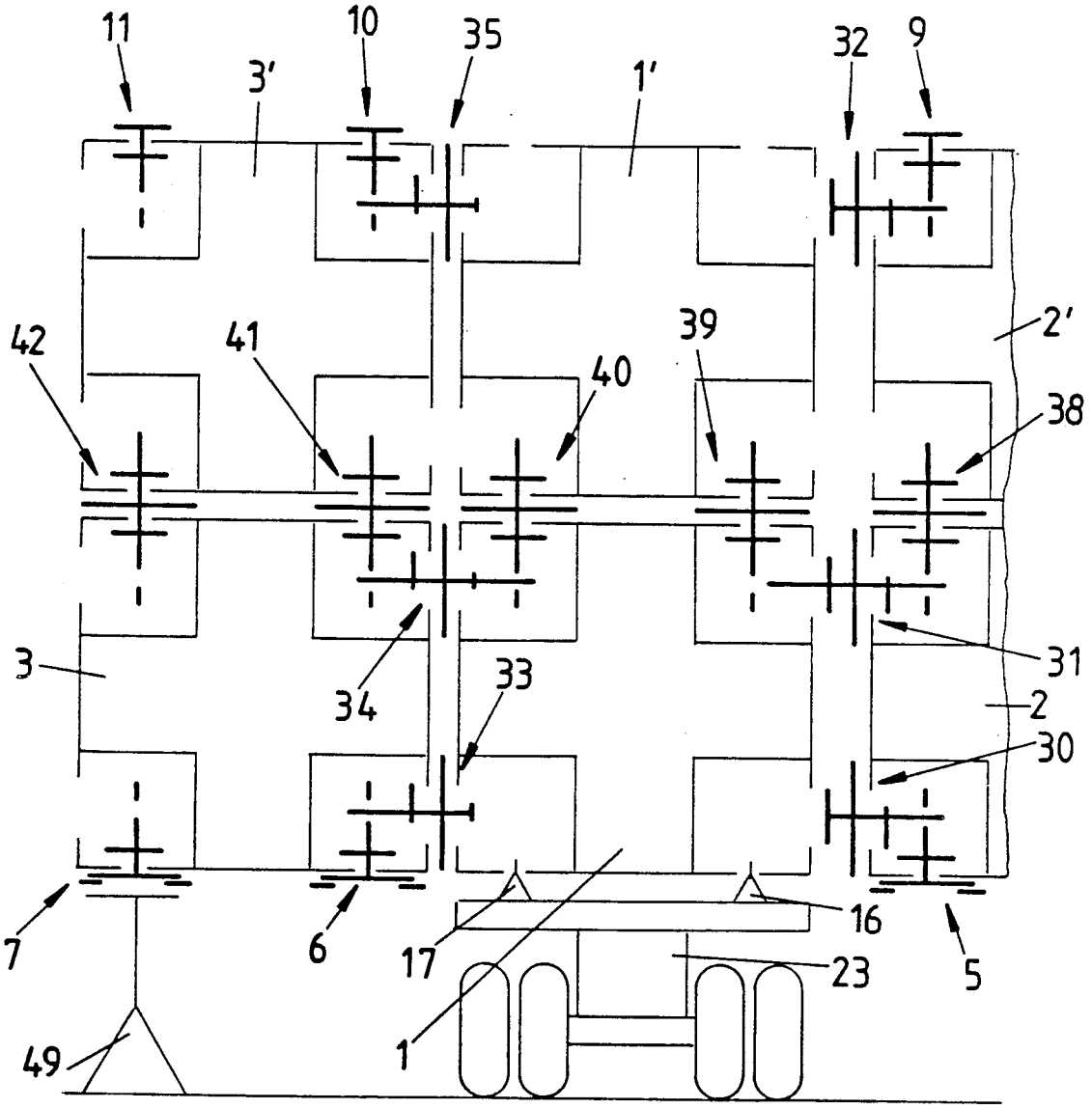

As can be gathered from FIG. 12D, the thus formed transportation unit can be gripped in the vicinity of the anchoring openings in the upper surface of central container 1 by a spreader 22 (FIG. 4) and after unlocking the twist locks 16, 17 located on vehicle 23 raising can take place and the transportation unit can be transported without any tipping or tilting risk as a result of the central engagement.

Figure 34:
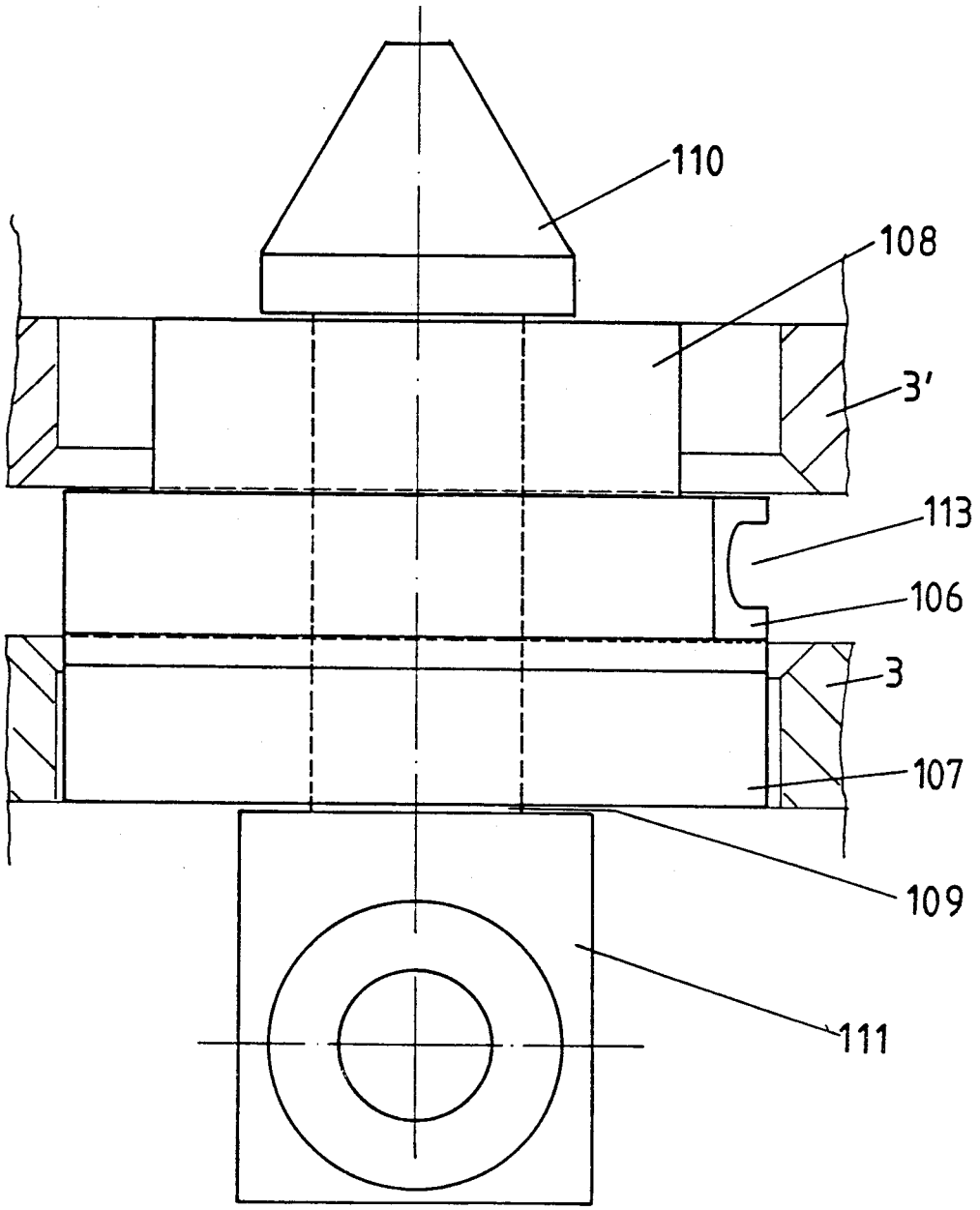
FIG. 34: A view of an inserted middle twist lock in its locking position.
Figure 35:
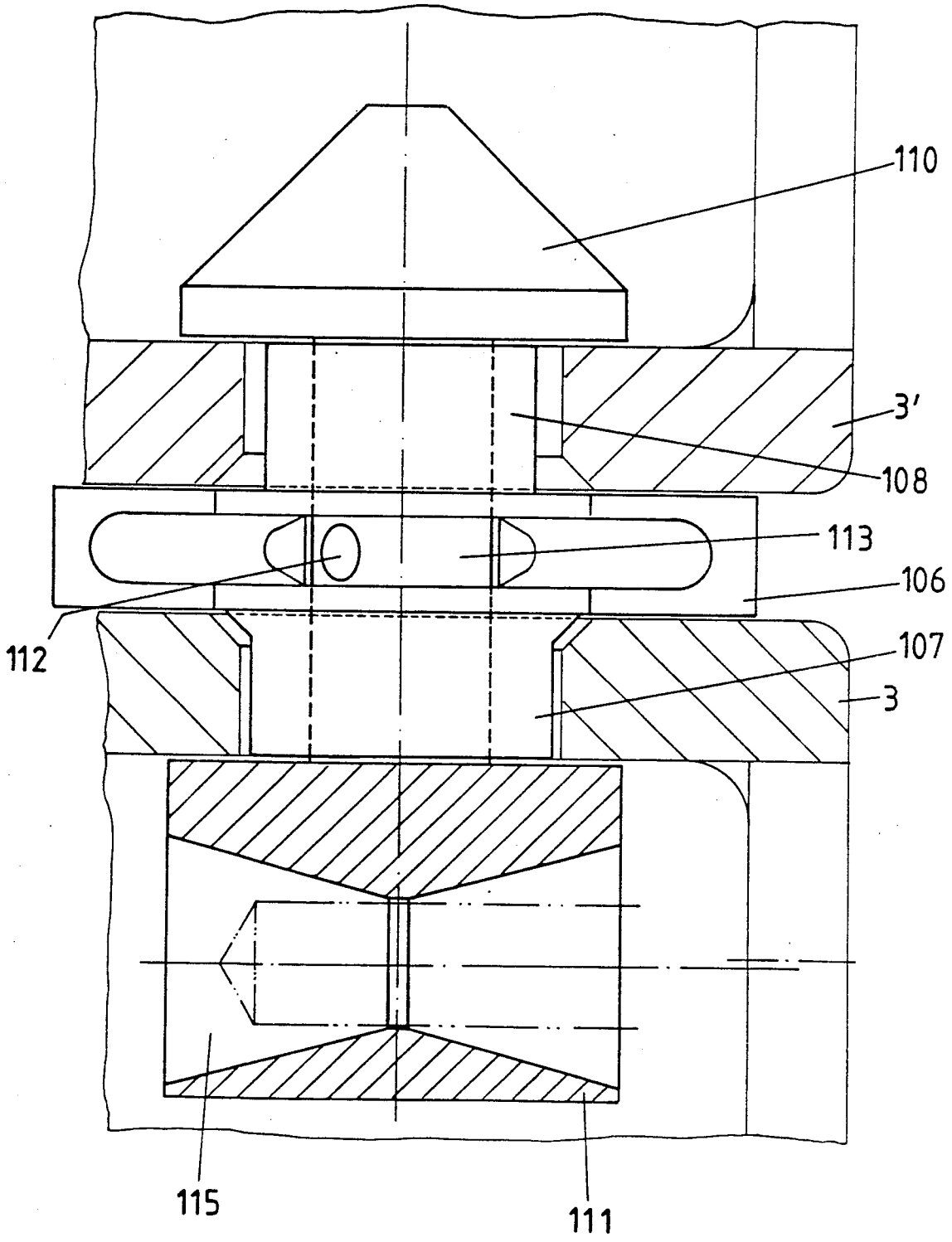
FIG. 35: The middle twist lock of FIG. 34 in a view turned by 90°.

As explained hereinbefore in conjunction with FIGS. 5A to 5E, in the case of a transporation unit having container units with more than one container, the individual superimposed containers of the container unit can be interconnected by middle twist locks, as shown e.g. in FIGS. 34 and 35. These individual, successive steps are illustrated in FIGS. 13A to 13H relative to the insertion and locking of middle twist lock 41 and transverse element 34 from FIGS. 5A to 5E.

The middle twist lock 41 has two locking heads 61, 63 located on a common axis extending through plate 60 and which are identically oriented, i.e. their longitudinal axes are parallel to one another. On locking head 61 is also provided a locking bore 62, whose longitudinal axis is parallel to the longitudinal axis of locking head 61, 63.

The insertion of the middle twist lock 41 in an anchoring opening in the upper surface of container 3 takes place in the manner shown in FIG. 20A, i.e. in that the locking head 61 having the locking bore 62, as is conventionally the case with twist locks, is inserted into the anchoring opening with a longitudinal extension in the direction of that of the anchoring opening. In this insertion position of locking head 61, the longitudinal axis of locking head 63 of the middle twist lock is also directed in the longitudinal extension of the anchoring opening, so that on stacking the upper container 3', locking head 63 can enter the associated anchoring opening in the lower surface of said container (FIG. 13B). The axis of twist lock 41 is now turned by 90°, so that locking heads 61 and 63 can come into their position engaging behind the associated anchoring openings and the axis of locking bore 62 is at right angles to the plane of the adjacent lateral anchoring opening.

Figure 39:
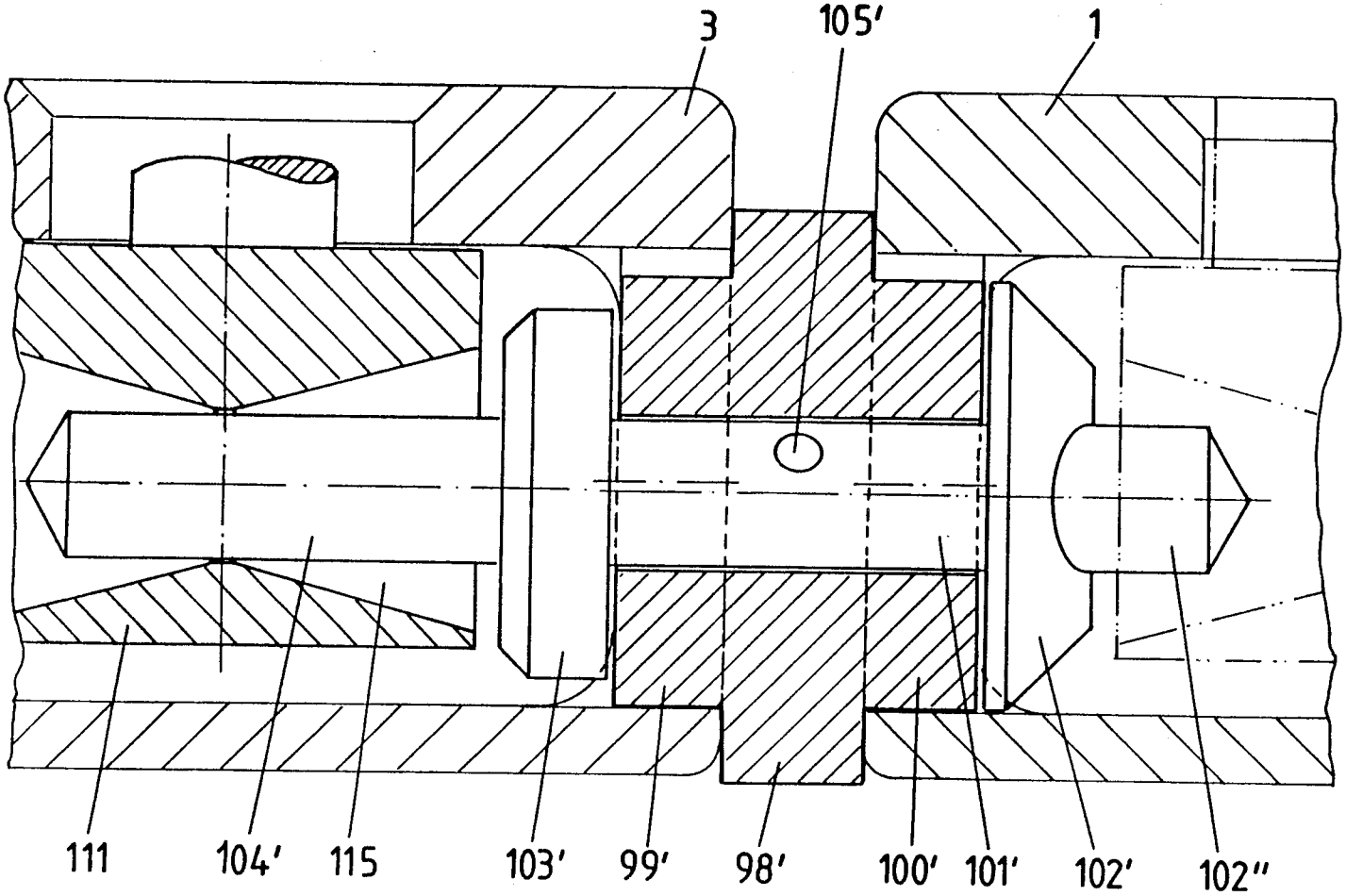
FIG. 39: A twist lock according to FIG. 31 serving as a transverse element, but with locking pins constructed on both heads and extending beyond the latter.

In the locking position of the middle twist lock 41 a transverse element 34 is inserted and which in this case is in the form of a twist lock according to FIG. 39. The construction of this twist lock essentially corresponds to the twist lock with a head according to FIGS. 31 to 33 and as used in conjunction with the embodiments of FIGS. 10A to 10H and 11A to 11H, but has on its shaft 65 extending through plate 66 in each case a locking pin 70, 69 extending beyond a locking head 67 and 68. As the arrangement of the locking heads 67, 68 and pin 69 coincides with the arrangement of the locking heads 57,58 and locking pin 59 in FIGS. 10A to 10H, this twist lock is also inserted in the same way, brought into locking engagement with the locking bore 62 of middle twist lock 41 and is locked in the manner described in conjunction with FIGS. 10A to 10H. The resulting position of the twist lock 34 in FIG. 13F precisely corresponds to the position of the twist lock forming the transverse element in FIG. 10F.

As shown in FIG. 10G, container 1 is then moved up and is in the present case coupled by means of the middle twist lock 40 with a container 1' to form a container unit. The middle twist lock 40 is constructed in precisely the same way as middle twist lock 41 and the same parts are given the same reference numerals, followed by an apostrophe.

On inserting twist lock 34 into the upper, lateral anchoring opening of container 1, locking pin 70 of twist lock 34 passes into the locking bore in head 61' of middle twist lock 40 and head 67 of twist lock 34 is positioned behind the lateral, upper anchoring opening of container 1, but initially in a position in which its longitudinal axis is parallel to the longitudinal extension of said anchoring opening (FIG. 13G).

By rotating by 90°, as described relative to FIGS. 10G and 10H, the locking heads 67, 68 then come into the locking position (FIG. 13H).

FIGS. 14A to 14I show in detail corresponding to FIGS. 10A to 10H, 11A to 11H, 12A to 12C and 13A to 13H the assembly of a transportation unit according to FIG. 2 in the steps according to FIGS. 5A to 5E, whilst using the same reference numerals as in FIGS. 5A to 5E.

The components used in each case correspond to those of FIGS. 10A to 10H, 11A to 11H and 13A to 13H.

In view of the explanations given regarding the previously mentioned drawings, there would appear to be no need for an additional description of the individual steps of FIGS. 14A to 14I.

Figure 15:
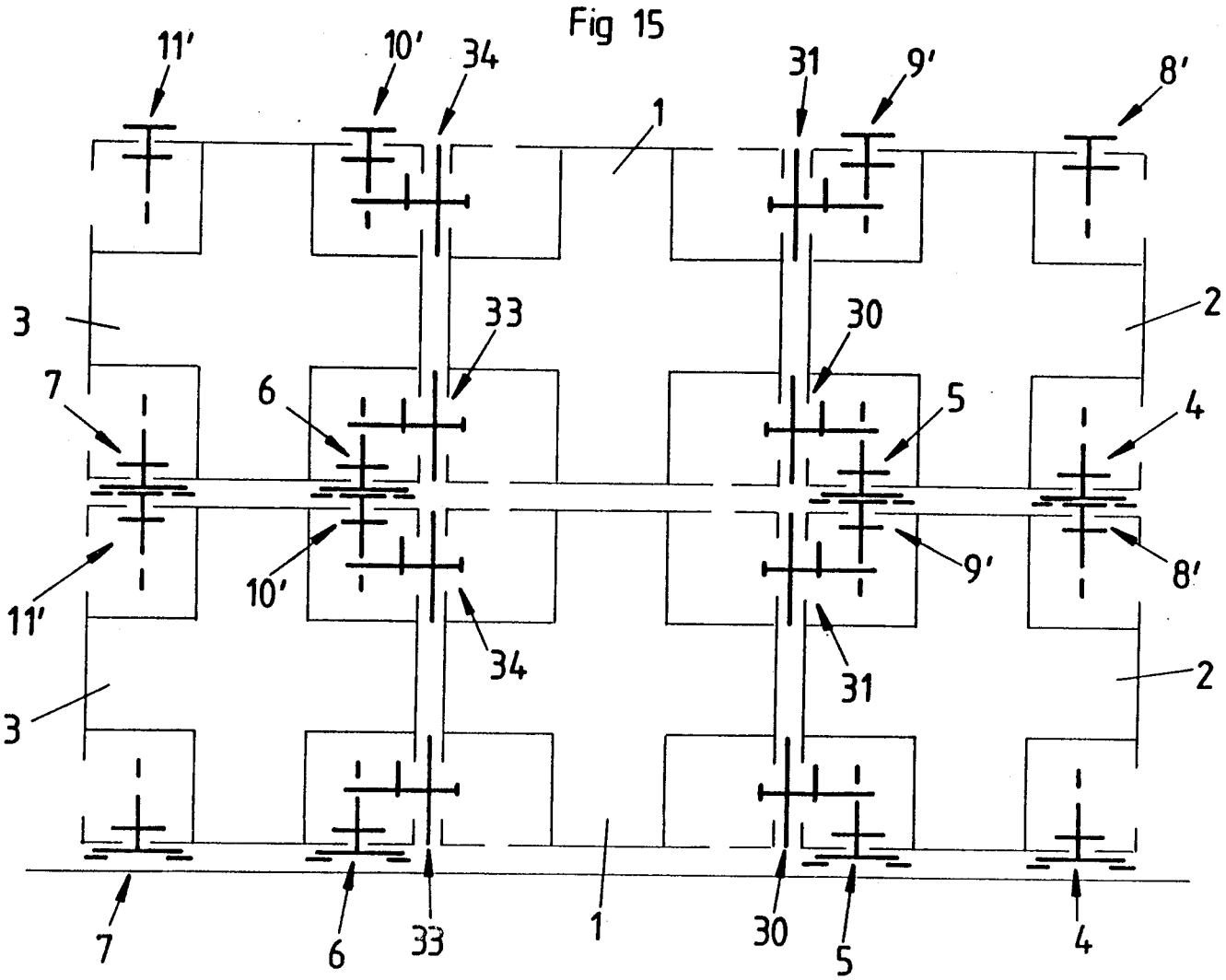
FIG. 15: Two superimposed transportation units, in each case constituted by three container units, each container unit comprising one container.

As stated hereinbefore, the blind twist locks to be inserted into the anchoring openings of the lower surfaces of a container have differently shaped plates as compared with the blind twist locks to be inserted into the anchoring openings in the upper surface of a container and the shape of said plates is e.g. indicated in FIGS. 22 to 24. On superimposing two transportion units, this construction of the plates leads to an arrangement as shown in FIG. 15. This comprises two identically construction transportation units according to FIG. 12D and the same parts as in the latter are given the same reference numerals.

It can be seen that the plates of the blind twist locks, 8',9', 10', 11' inserted in the upper surfaces of containers 2 and 3 of the lower transportation unit project into the plates having central openings of the blind twist locks 4, 5, 6, 7 inserted in the lower surfaces of the containers 2, 3 of the upper transportation unit, so that the latter with the plates of its lower blind twist locks 4, 5, 6, 7 is supported on the upper surfaces of containers 2, 3 of the lower transportation unit. The distance between the two transportation units is consequently solely determined by the height of the plates of the lower blind twist locks 4, 5, 6. Moreover, due to the engagement of the plates of the upper blind twist locks 8', 9', 10', 11' with the plates of the lower blind twist locks 4, 5, 6, 7, there is an additional securing to the two transportation units against any relative displacement in the plane of the lower surface of the upper transportation unit.

Whilst transverse elements according to FIG. 39 are used in FIGS. 13A to 13H and 14A to 14H for coupling adjacent containers in the vicinity of the middle twist locks, in the case of FIG. 16 a transverse element of the type shown in FIGS. 31 to 33 and 40 and 41 is used for this purpose and as was also used in FIGS. 10A to 10H and 11A to 11H. Thus, to facilitate understanding, alongside FIG. 16 are shown the FIGS. 11H and 10H as FIGS. 17 and 18.

In the arrangement according to FIG. 16, the middle twist locks 40 and 41 are shown in the position according to FIG. 13H, together with a transverse element in the form of a twist lock 34, whose basic construction corresponds to that of FIGS. 13D to 13H and which is also located in the position according to FIG. 13H, but in connection with which there is only a locking pin projecting beyond a locking head on one side. As this twist lock has the same construction as that used in FIGS. 17 and 18, the same reference numerals as in the latter are used. It can be seen that the locking pin 59 is in engagement with the locking bore of the middle twist lock 41, whilst there is no locking pin extending into the locking bore of middle twist lock 40. However, locking head 57 and locking head 61' of middle twist lock 40 can also be constructed in such a way that in the inserted state a rotation of locking head 61' is prevented (FIGS. 40 and 41), so that locking head 61' and therefore also locking head 63' cannot be rotated in the insertion position for as long as locking head 57 of twist lock 34 is located in the lateral anchoring opening of the lower container 1 of the central container unit 1, 1'.

Figure 45:
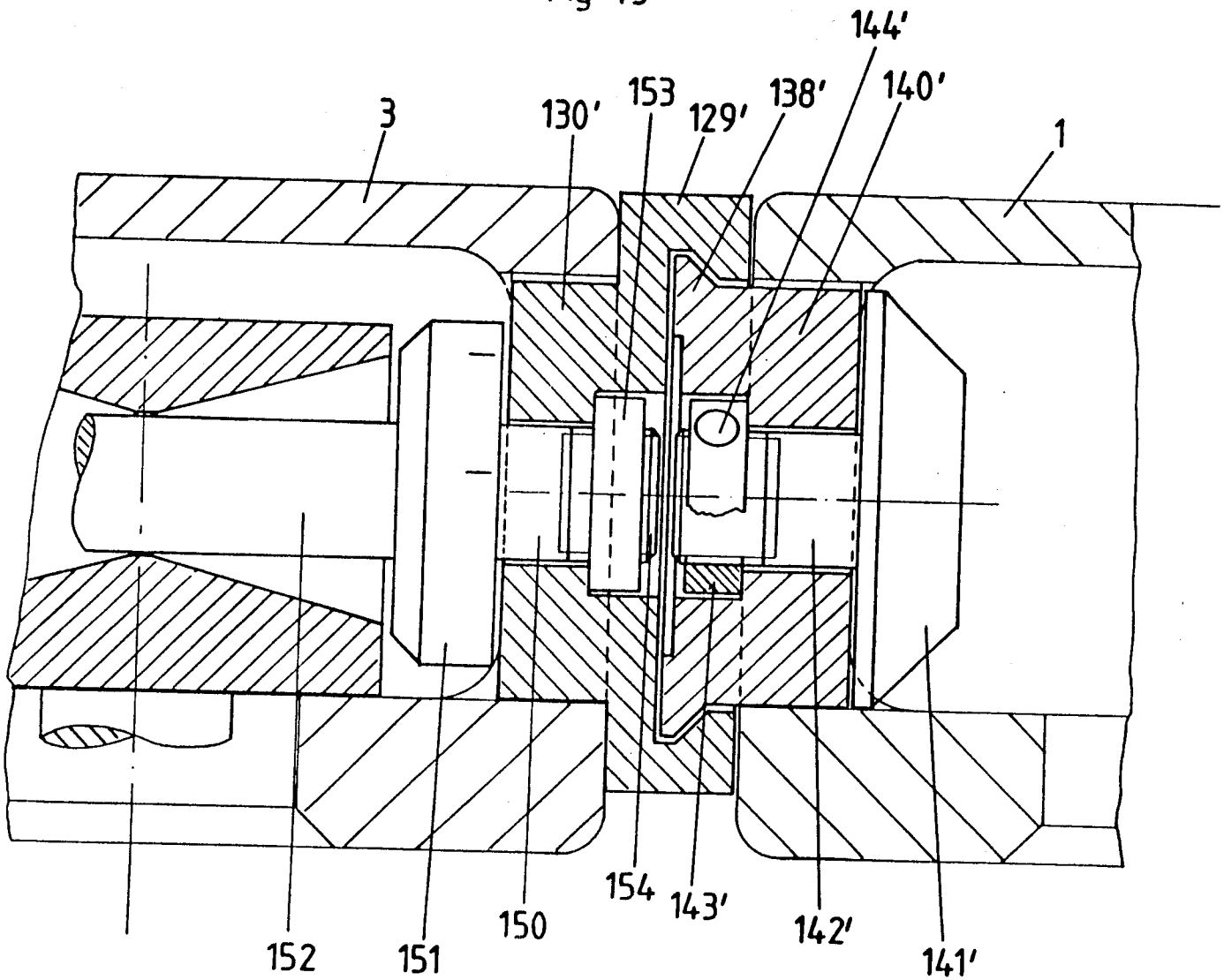
FIG. 45: A double function transverse element with locking heads constructed on both portions, as well as a locking pin provided on a portion and which engages with the head of a blind twist lock.

FIG. 19 shows in a representation corresponding to FIG. 10H the locking position of a double function transverse element, e.g. that of FIG. 45 inserted in the lower three lateral anchoring openings of the lower containers 1, 3 of two adjacent container units.

As shown, the double function transverse element 51 comprises two portions 71, 72, which are coupled together in a guide 73, such as a dovetail guide, so that they can be reciprocated to a limited extent in the direction of the longitudinal extension of the containers. A rotatable locking head 74 is located on portion 71 and is in the locked position in FIG. 19. The portion 72 is fitted a locking head 75, which can be rotated independently of locking head 74 and is also in the locking position in FIG. 19. A locking pin 76 extends beyond locking head 75 and is in engagement with the locking bore of the blind twist lock 56, as was described for locking pin 59 in conjunction with FIGS. 10A to 10H.

FIGS. 20 and 21 again show the middle twist lock 41 in its locking position, FIG. 20 being diagrammatically a side view, i.e. a view in the direction of the side faces of containers 3, 3' and FIG. 21 is an end view, i.e. the already shown view towards the end faces of containers 3, 3'. The locking heads 61 and 63 are in the previously described locking position.

A collar 64, 65 is present between each locking head 61, 63 and plate 60 (cf. also FIGS. 34 and 35). These collars are located in the inserted state in the vicinity of the associated anchoring openings and thus bring about a positioning in the planes of said openings. As indicated in FIG. 20, the dimensions of the lower collar 74 are essentially adapted to the dimensions of the associated anchoring openings, so that following insertion into the anchoring openings the middle twist lock is substantially non-displaceably positioned in the upper face of container 3 in the plane of the anchoring opening. This defines a clearly established position of the middle twist lock.

The upper collar 65 has much smaller dimensions than the lower collar 64, so that on placing container 3' on container 3, not only can there be any easy insertion of anchoring head 63 and collar 65, as wel as the anchoring heads and collars of the remaining middle twist locks inserted in the anchoring openings in the upper surface of container 3, but also no difficulties are caused by the spacings between the individual anchoring openings and also their dimensions differing within given tolerance ranges.

FIGS. 22 and 23 show the construction of a blind twist lock, as is e.g. inserted as the upper twist lock 10' into a container 3 of a lower transportation unit according to FIG. 15. This blind twist lock has a plate 80, to which is connected in one piece a collar 81, which is inserted in an anchoring opening in the upper surface of container 3 and whose shape essentially corresponds to that of the anchoring opening, whilst plate 80 is rectangular and, as shown, is supported in the edge regions of the anchoring opening on the upper surface of container 3. A central opening 83 extends through plate 80 and collar 81 and forms an annular shoulder 85. On the lower face of collar 81 is fixed a stop pin 86, which extends downwards and whose function will be explained hereinafter.

The length of the blind twist lock head 82 is less than the length of the anchoring opening and the head width is smaller than that of the anchoring opening, but the length of head 82 is larger than the width of the anchoring opening. To the top of head 82 is fixed a pin 89, which at its free end is in the shape of a hexagon 90 and has a threaded portion below it. In the represented fitted state, pin 89 extends into the central opening 83 of plate 80 and collar 81 and on its threaded portion is screwed a fixing plate 91, which is supported on the annular shoulder 85 of central opening 83. Fixing plate 91 is fixed in the usual way by means of a grub screw 97.

Between fixing plate 91 and the base of collar 81 is provided a helical spring 92, which surrounds pin 89. A bent end 93 of said helical screw engages with a bore 84 in the base of collar 81, whilst its other bent end 94 engages with a bore 95 in the fixing plate 91, which by positive engagement with the polygonal end of pin 89 is nonrotatably secured thereon. As a result of its support on collar 81 and therefore on plate 80 on the one hand and on fixing plate 91 on the other, helical spring 92 exerts a force on pin 89 and therefore on head 82, so that the latter is rotated clockwise in FIG. 23. This means that head 82, due to the non-rotary positioning of collar 81, is pressed into the anchoring opening of container 3 in the represented position in which it is prevented from further rotation by the force of spring 92 by engaging on the stop pin 86 fixed in collar 81.

In order to remove the blind twist lock according to FIGS. 22 and 23 from the anchoring opening in container 3, or also for inserting the same, by engagement by means of a corresponding tool on hexagon 90, head 82 is rotated counterclockwise against the force of spring 92 with respect to plate 80 and collar 81 in FIG. 23 until stop pin 86 engages in recess 88 in head 82 and thus prevents further rotation. In this position, the longitudinal extension of head 82 runs in the same direction as the longitudinal extension of collar 81, i.e. in a position rotated by 90° compared with that of FIGS. 22 and 23, so that the blind twist lock can be removed from the anchoring opening, or can be inserted into the latter. As soon as the rotating torque no longer acts on hexagon 90, head 82 is rotated back into the indicated position by the action of spring 92 and this represents the locking position of the blind twist lock.

As can be gathered from FIG. 22, head 82 of the blind twist lock has a locking bore 87, whose longitudinal axis extends at right angles to the rotation axis of head 82 and in the direction of the longitudinal extension thereof. As shown, into said locking bore extends a locking pin of a transverse element, as is diagrammatically indicated for transverse element 34 in FIG. 15. Locking bore 87 is a through-bore, which tapers towards the centre from either end. As a result of the tapered portions the insertion of the locking pin is made easier, whilst the symmetrical construction as a through-bore makes it possible to insert the blind twist lock into the anchoring opening in either of its two insertion positions.

As shown in FIG. 22, the central axis of the locking bore 87 with the blind twist lock inserted is positioned somewhat lower than the centre of the adjacent lateral anchoring opening. Thus, if a transverse element is inserted with its locking pin into the locking bore 87, then the transverse element is prevented from tilting as a result of the weight of its part projecting out of the lateral anchoring opening and keeps said part in a substantially horizontal position, which facilitates insertion into a lateral anchoring opening of another container.

FIG. 24 shows a simplified form compared with FIGS. 22 and 23 a blind twist lock for insertion into an anchoring opening in the lower surface of a container and it can e.g. be the blind twist lock 6 of container 3 of the upper transportation unit of FIG. 15. The same or corresponding parts of the blind twist lock in FIG. 24 are given the same reference numerals as in FIGS. 22 and 23, followed by an apostrophe.

The blind twist lock according to FIG. 24 inserted in the lower anchoring opening is located in the locking position, i.e. that corresponding to FIGS. 22 and 23. It differs from said blind twist lock solely through the construction on its plate 80', which has a much larger central opening than plate 80 in FIGS. 22 and 23. As indicated in FIGS. 22 to 24, this central opening is so large that plate 80 of the blind twist lock of FIGS. 22 and 23 fits completely into said central opening, so that the lower face of plate 80' of the blind twist lock rests on the upper face of the lower container, i.e. the dimensions of plate 80 of the upper blind twist lock do not influence the spacing between the two containers 3.

Also in the case of the blind twist lock according to FIG. 24, in the fitted state the central axis of the locking bore 87' in head 82' is lower than the centre of the adjacent lateral anchoring opening in order to keep the transverse element inserted with its locking pin in the horizontal position, as described relative to FIG. 22.

The blind insertion element shown in FIGS. 25 to 28 in the locked state inserted in an upper anchoring opening is also kept in its locked position by spring tension. In the drawings the blind twist lock parts corresponding to those of the blind twist lock of FIGS. 22 and 23 are given the same reference numerals, followed by a letter a.

Figure 28:
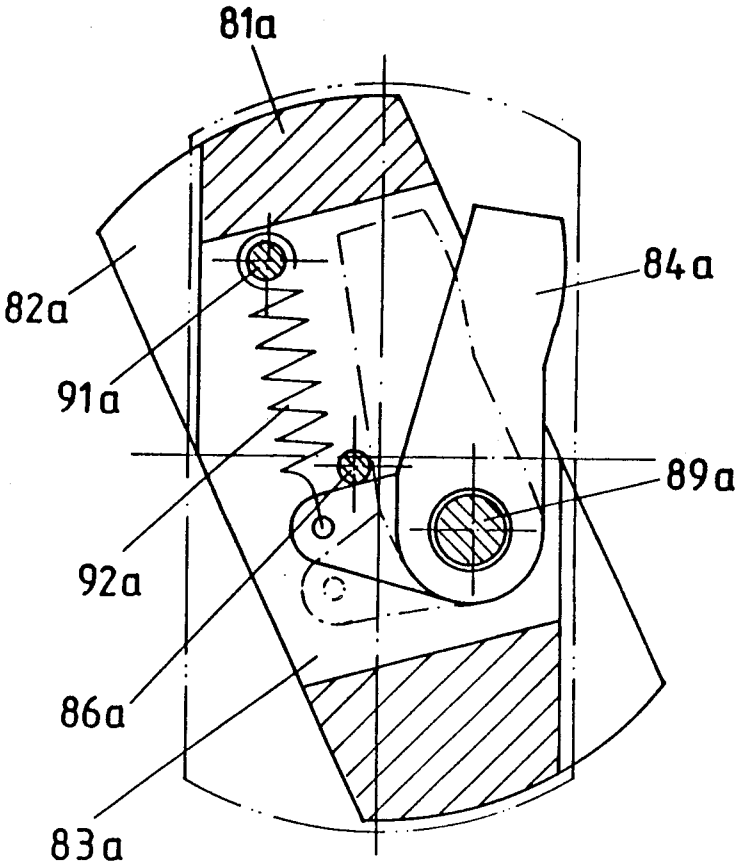
FIG. 28: A section along line 28—28 of FIG. 25.

The represented blind insertion element has a plate **80*a*, a collar 81*a* and a head 82*a*, which are all constructed in one piece. The head essentially has the shape of the anchoring opening shown in dot-dash line manner in FIGS. 26 and 28, whilst collar 81*a* is cut away in the vicinity of the diagonally facing portions of head 82*a* which in the locked state engage behind the edge region of the anchoring opening (FIG. 28). Thus, head 82*a* can be inserted in the anchoring opening in alignment therewith and can then be rotated into the position according to FIG. 28, in which it engages behind regions of the anchoring opening, whilst edge regions of collar 81*a*** engage on the opening edge.

Figure 27:
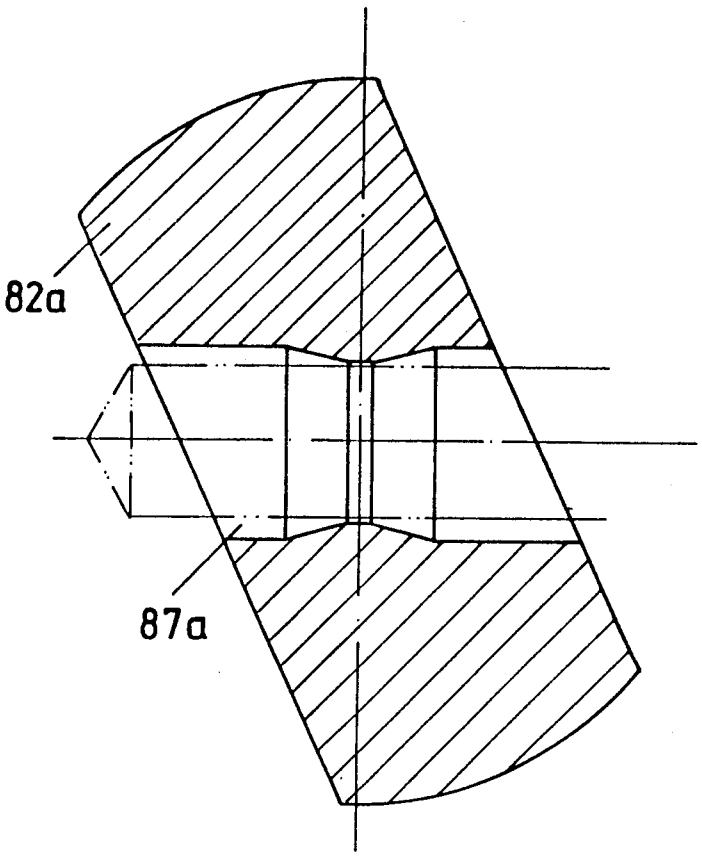
FIG. 27: A section along line 27—27 of FIG. 25.

Head **82*a* contains a through-bore 87*a* tapering towards the centre and which, as indicated in FIG. 27**, serves to receive a locking pin of a transverse element.

A substantially L-shaped supporting lever **84*a* is pivotably fixed to a stationary shaft 89*a* in a recess 83*a* in collar 81*a*. To the shorter leg of supporting lever 84*a* is fitted a helical spring 92*a*, whose other end is fixed to a stationary retaining pin 91*a*. A stationary pin 86*a* serves as a stop for limiting the pivoting movement of supporting lever 84*a* by the tension of spring 92*a***.

As has already been stated, the insertion element according to FIGS. 25 to 28 is inserted in the anchoring opening by aligning its head **82*a* with respect thereto, supporting lever 84*a* being pivoted counter to the tension of the spring into the position shown in dot-dash line FIG. 28. If supporting lever 84*a* is released in the inserted state, then it is pivoted by spring 92*a* into the position shown in FIGS. 26 and 28**, in which it is supported by the outside of its longer leg on the boundary wall of the anchoring opening and thus rotates the blind insertion element into the indicated locking position.

For the removal of the blind insertion element, it is merely necessary to again bring the supporting lever **84*a* into the dot-dash line position according to FIG. 28, e.g. by a corresponding rotation of the blind insertion element by engagement on plate 80*a*, collar 81*a* and head 82*a*** then being removable from the anchoring opening.

Figure 29:
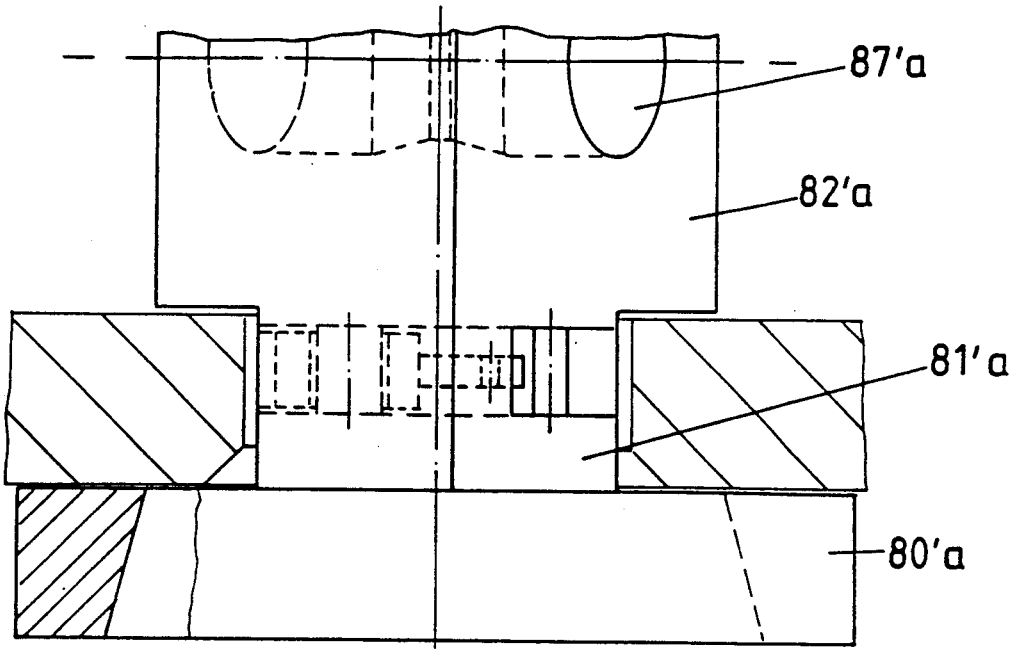
FIG. 29: Part of a blind insertion element, which is constructed in accordance with the blind insertion element of FIGS. 25 to 28, but inserted in a lower anchoring opening.
Figure 30:
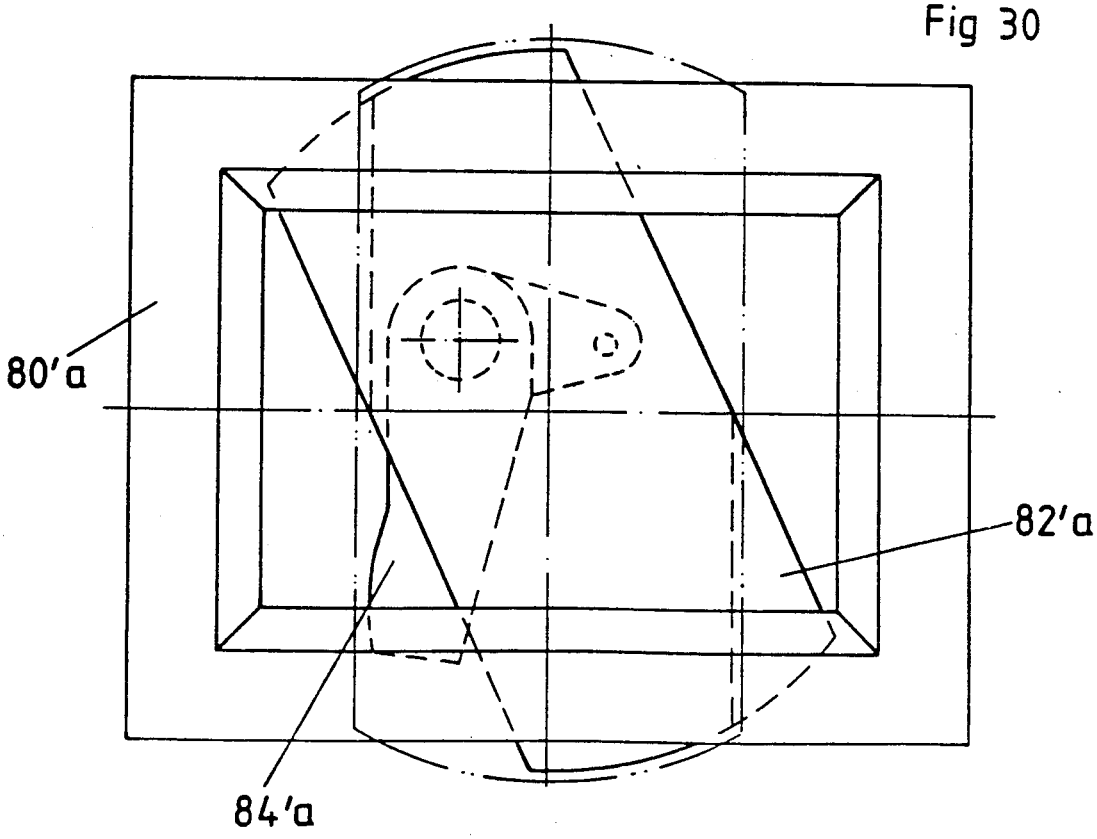
FIG. 30: A view of the blind insertion element of FIG. 29 from below and which is in the locking position.

FIGS. 29 and 30 show a blind insertion element corresponding to that of FIGS. 25 to 28 and which is inserted in a lower anchoring opening. Parts corresponding to those of FIGS. 25 to 28 are given the same reference numerals in FIGS. 29 and 30, followed by an additional apostrophe.

As can be readily seen, plate **80'*a* of the blind insertion element according to FIGS. 29 and 30 has a recess corresponding to that in plate 80' of the blind twist lock of FIG. 24, so that the superimposing of containers in the vicinity of said blind insertion elements takes place in the manner shown in FIG. 24** and as described in conjunction therewith.

A transverse element with a locking pin, as inserted in the indicated manner into locking bore 87 or locking bore 87' or locking bore **87*a* in the blind twist lock according to FIGS. 22 and 23 or 24 or a blind insertion element according to 25 to 28, as shown in FIGS. 31 to 33. The transverse element is in the form of a twist lock with a plate 98 and collars 99 and 100 constructed in one piece therewith and provided on opposite sides of plate 98. These collars extend in the manner indicated in FIG. 17 into upper anchoring openings in the side walls of the two lower containers 3 and 1 of adjacent container units. Through a central bore in the element constituted by plate 98 and collars 99, 100 passes a shaft or spindle 101, which in said central bore is freely rotatable and at the end adjacent to collar 100 carries a locking head 102 and adjacen to collar 99 a locking head 103. The two locking heads essentially have the circumferential shape of an anchoring opening, so that in the given position can be inserted into the same. However, on spindle 101 they are circumferentially displaced by approximately 45° with respect to their longitudinal extensions. In the extension of spindle 101, a locking pin 104 extends beyond the locking head 103 and in the arrangement according to FIG. 31 is inserted in a locking bore 87 of head 82 of a blind twist lock, which corresponds to the blind twist lock 10 of FIG. 17 and which is e.g. shown in FIGS. 22 and 23. Locking head 102 is constructed in such a way that it does not impede the insertion of the locking head of lifting equipment into the adjacent anchoring opening in the upper surface of container 1'**.

In order to insert the twist lock according to FIG. 31 into the lateral anchoring opening of container 3, the locking head 103 is brought into a position with respect to the collar 99 having essentially the same shape as the anchoring opening, in which the longitudinal extension of locking head 103 is parallel to the longitudinal extension of collar 99. In this position, the twist lock can be inserted in the lateral anchoring opening in container 3 and can be engaged with the locking bore 87 of the previously inserted blind twist lock. In this inserted position, spindle 101 is rotated by approximately 45°, so that the locking head 103 passes into a locking position, i.e. the locking head 103 is in a position rotated by 45° with respect to the vertical, in which it engages behind edge regions of the anchoring opening in such a way that the twist lock cannot drop out of the lateral anchoring opening of the container 3. In this prelocking position of locking head 103, locking head 102 is aligned in such a way that its longitudinal extension is parallel to the longitudinal extension of collar 100, also shaped in accordance with an anchoring opening, i.e. locking head 102 and collar 100 can be inserted in a lateral anchoring opening of the adjacent container 1.

When engagement has taken place between the lateral anchoring opening in container 1 and collar 100 with locking head 102, spindle 101 is further rotated in the direction of the previously performed rotation by a further 90°. For this purpose the collar contains a not shown recess, through which access is obtained to a bore in spindle 101. Into said bore 101 is inserted a lever, with the aid of which spindle 101 and conseqeuntly the two locking heads 102, 103 can be rotated and conventionally the shape of the recess limits the degree of the possible rotation. Following the further rotation by 90°, the locking head 103 is in its locking position shown in FIGS. 32 and 33, whilst locking head 102 is rotated in a horizontal position (FIGS. 32 and 33), so that both locking heads 102, 103 engage in locking manner behind the lateral anchoring openings of containers 1 and 3 indicated in dot-dash line manner in FIG. 33. Thus, containers 1 and 3 are detachably coupled together by means of locking heads 102, 103, as explained relative to FIG. 10.

FIGS. 34 and 35 show a middle twist lock, as is e.g. used as middle twist lock 41 in FIG. 16. This middle twist lock has a plate 106 and collars 108, 107 constructed in one piece therewith and arranged on opposite sides and, as described in conjunction with FIGS. 20 and 21, the lower collar 107 is adapted relatively precisely to the shape of the anchoring opening in the upper surface of container 3, whilst the dimensions of collar 108 are much smaller, so that it fits with clearance into the anchoring opening in the lower surface of container 3'. Through the unit formed by plate 116 and collars 107, 108 extends a shaft or spindle 109, to whose lower end is fixed a locking head 111 with a locking bore 115. The shape and construction of locking head 111 with the locking bore 115 provided therein correspond to the shape and construction of head 82 with the locking bore 87 of the blind twist lock of FIG. 22. At the other end of spindle 109 is fixed a locking head 110, which is shaped like a conventional twist lock locking head, i.e. its circumferential shape is adapted to that of the associated anchoring opening, so that in the case of alignment of its longitudinal extension parallel to the longitudinal extension of the adjacent collar, it can be inserted together with the latter into the anchoring opening.

In the position shown in FIGS. 34 and 35, the middle twist lock is locked, i.e. the longitudinal extensions of locking heads 111 and 110, which are parallel to one another, are at right angles to the longitudinal extension of the anchoring openings.

Plate 106 contains a circumferentially directed cutout 113, through which is accessible an opening 112 in spindle 109. By engaging a tool in opening 112, the spindle 109 can be moved between the represented position and a position rotated by 90° thereto, in which the longitudinal extensions of locking heads 111 and 110 are parallel to the longitudinal extensions of collars 107, 108, so that the middle twist lock can be removed from the anchoring openings.

Figure 36:
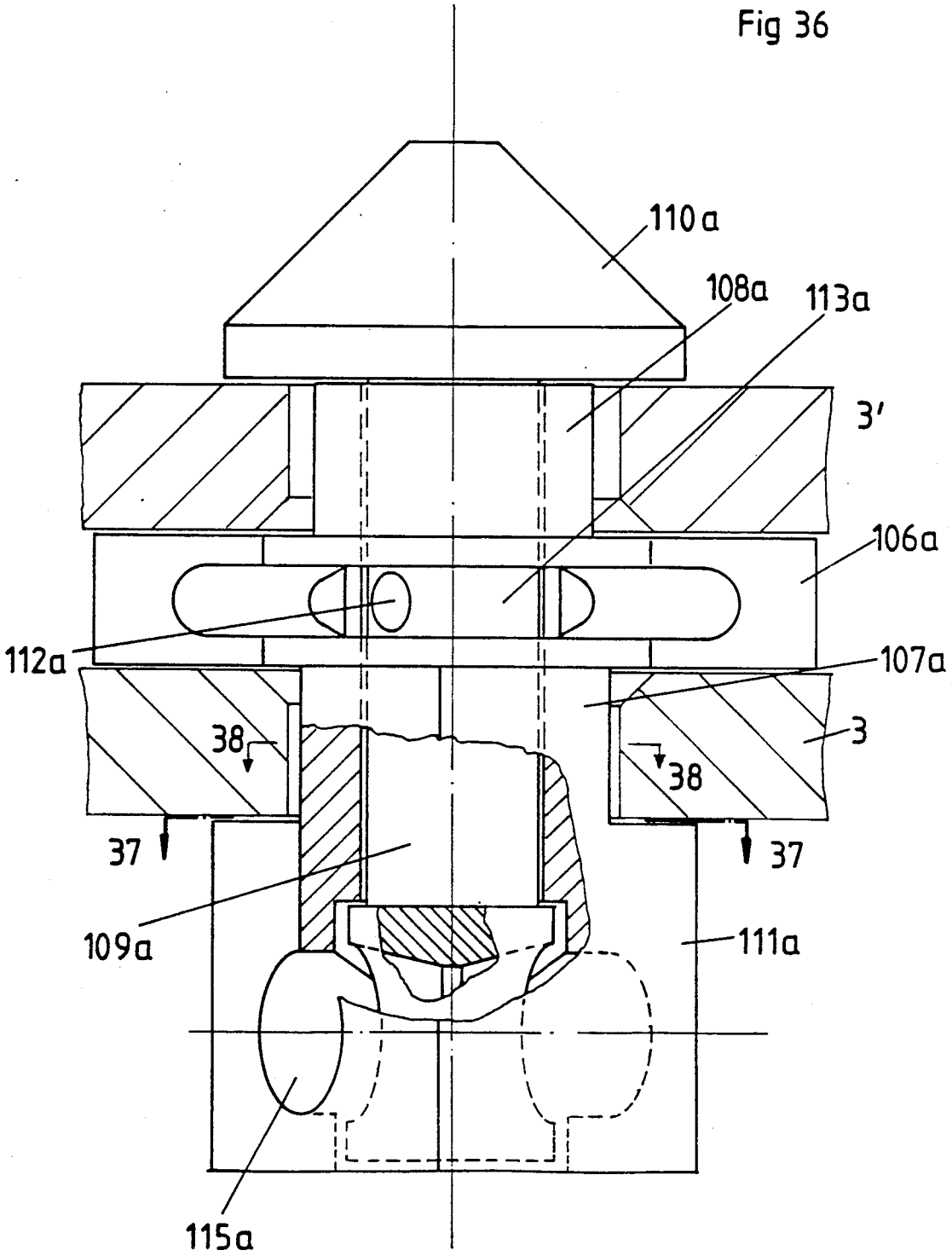
FIG. 36: In a view similar to FIG. 35, a different middle twist lock.
Figure 38:
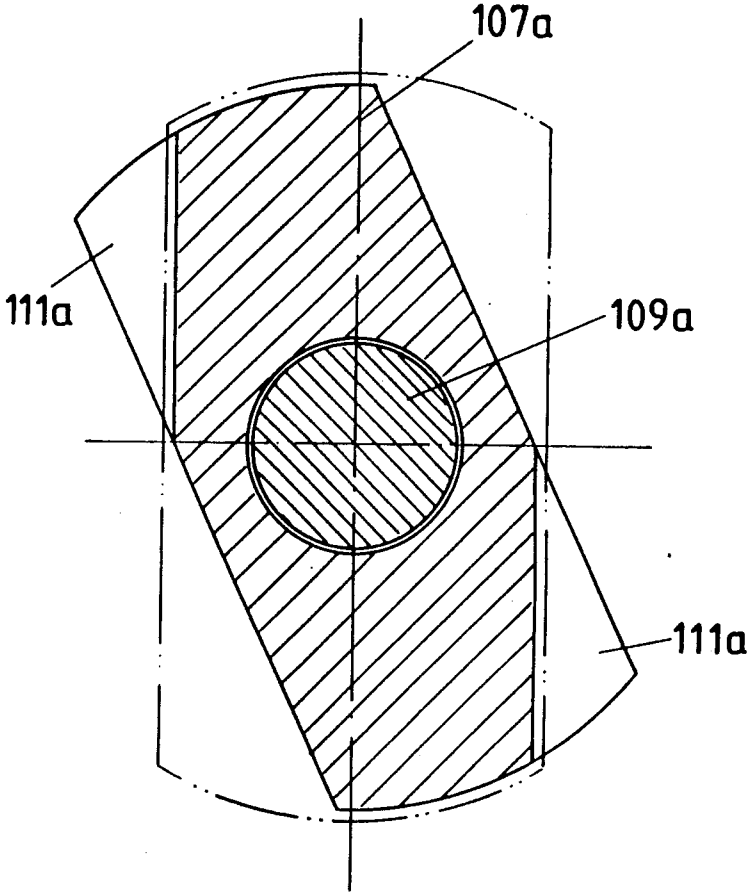
FIG. 38: A section along line 38—38 of FIG. 36.
Figure 37:
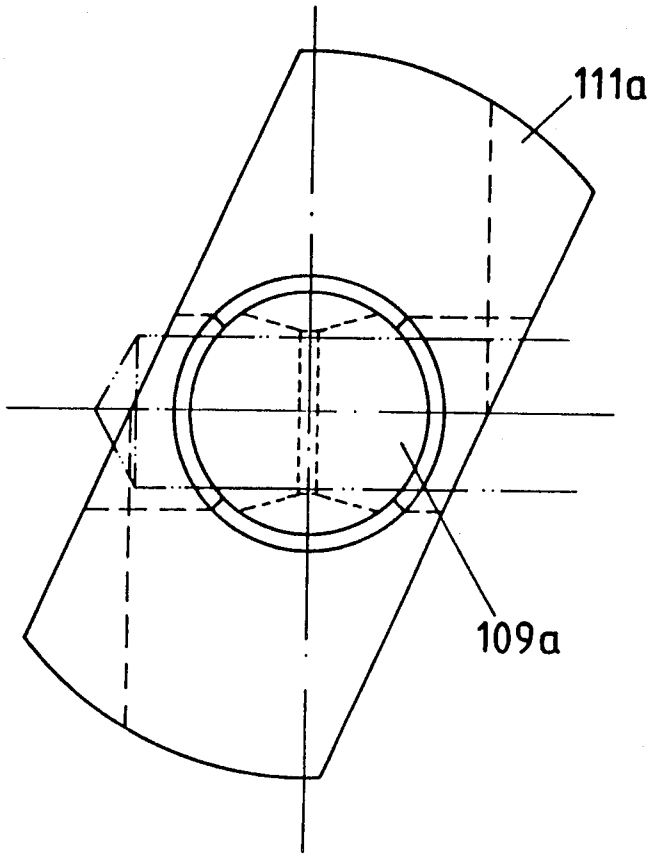
FIG. 37: The middle twist lock of FIG. 35 in a view from below as a partial representation.

A differently constructed middle twist lock is shown in FIGS. 36 to 38 and corresponding parts thereof are given the same reference numerals as in FIGS. 34 and 35, followed by the letter a.

In the case of the middle twist lock according to FIGS. 36 to 38, plate **106*a*, upper collar 108*a* and lower collar 107*a* are constructed in one piece with locking head 111*a*. Through the latter extends a shaft or spindle 109*a*, which carries at its upper end a locking head 110*a*. Spindle 109*a* can be passed through a bore in the lower locking head 111*a* shown in FIG. 36 until it engages with an annular shoulder on a bore step. Spindle 109*a* of the locking head 110*a* is then fixed to the upper end. Spindle 109*a* can be turned by means of an inserted tool via an opening 112*a* located therein and accessible through a cutout 113*a* in collar 106*a*, so that locking head 110*a* is movable between an insertion position and a locking position. Spindle 109*a* extends into the locking head 111*a* and is provided at its lower end with a through-bore which, when locking head 110*a* is in the locked position, is aligned with bores 115*a* in locking head 111*a* and consequently forms a through-bore corresponding to the through-bore 115 in the middle twist lock according to FIGS. 34 and 35. A locking pin inserted in the latter prevents a rotation of the upper locking head 110*a*** out of the locking position and into the insertion position.

Figure 25:
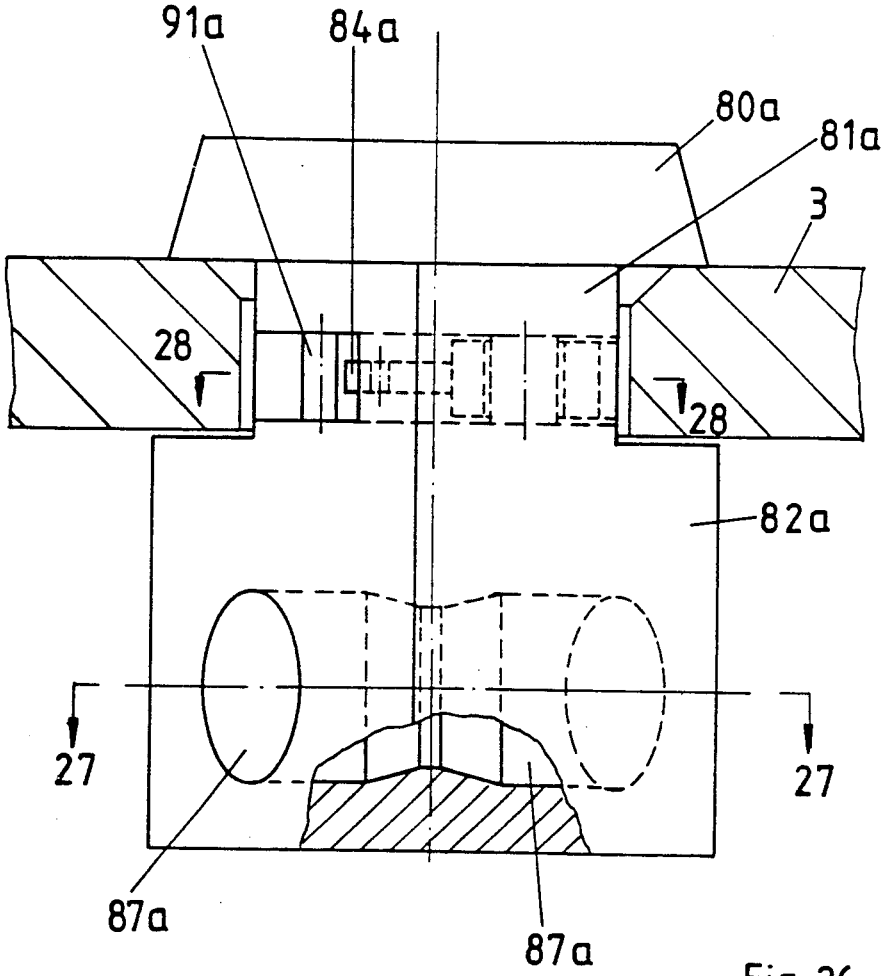
FIG. 25: Partly broken away, a blind insertion element inserted in an upper anchoring opening.
Figure 26:
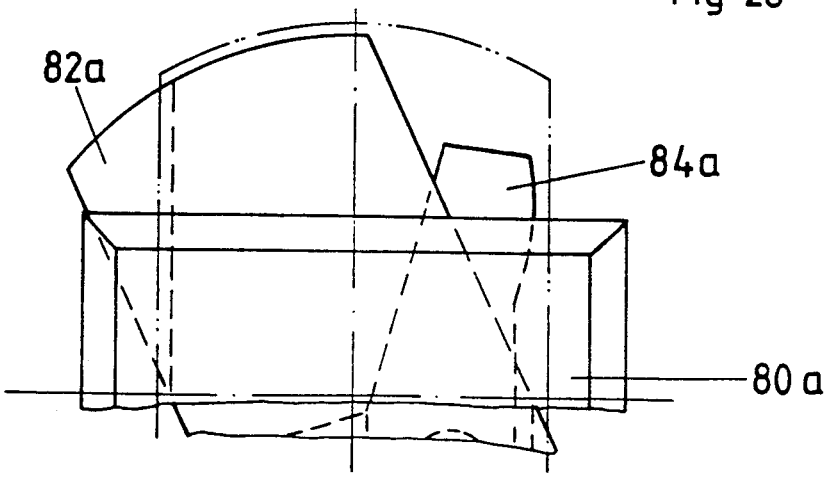
FIG. 26: In a partial plan view the head of the blind insertion element of FIG. 25 in the locking position.

Plate **106*a*, collar 107 and locking head 111*a* are otherwise constructed in the same way as the plate, collar and locking head of the blind twist lock according to FIG. 25 and can therefore be inserted in container 3 by aligning locking head 111*a* with the anchoring opening and can then be brought by rotation into the locking position shown in FIG. 38, in which the locking head 111*a* with diagonally facing regions enages behind the anchoring opening, whilst collar 107*a* engages on the boundary wall of the anchoring opening. In this locking position, the upper collar 108*a* is aligned in such a way that it can be inserted into an anchoring opening when locking head 110*a*** is in the insertion position.

In accordance with the construction of the middle twist lock according to FIGS. 34 and 35, the middle twist lock according to FIGS. 36 to 38 also has an upper collar **108*a* with smaller dimensions than the lower collar 107a, so that the displacement described in conjunction with FIGS. 20 and 21** is possible.

FIG. 39 shows a twist lock serving as a transverse element, whose basic construction corresponds to that of FIG. 31 and the same parts are given the same reference numerals as in the latter, but followed by an apostrophe.

Unlike in the case of the twist lock of FIG. 31, the twist lock of FIG. 39 has as the extension of the locking head 102', a locking pin 102", which extends coaxially to spindle 101' and is somewhat shorter than the locking pin 104' provided on the opposite side. The additional locking pin 102" serves, as is shown in dot-dash line manner in FIG. 39, to prevent the rotation out of the locking position of the lower locking head of a middle twist lock inserted in the adjacent anchoring opening in the upper surface of container 1 by engagement with the locking bore provided in its locking head. The fitting and function of such a twist lock has already been described in conjunction with twist locks 31 and 34 in FIGS. 14D to 14I.

In the representations according to FIGS. 40 and 41, there are partial views of the locking head 102 of the twist lock of FIG. 31 in the locking position. The turning circle K indicated in broken line manner in FIG. 41 of the lower locking head of a middle twist lock located in the locking position (FIGS. 34 and 35) passes through the locking head 102, so that the locking head of the middle twist lock cannot be turned out of its locking position, because during this turning movement it engages on locking head 102. Thus, the associated middle twist lock can only be removed if beforehand the twist lock having the locking head 102 has been removed from the adjacent anchoring opening.

Figures 42, 43:
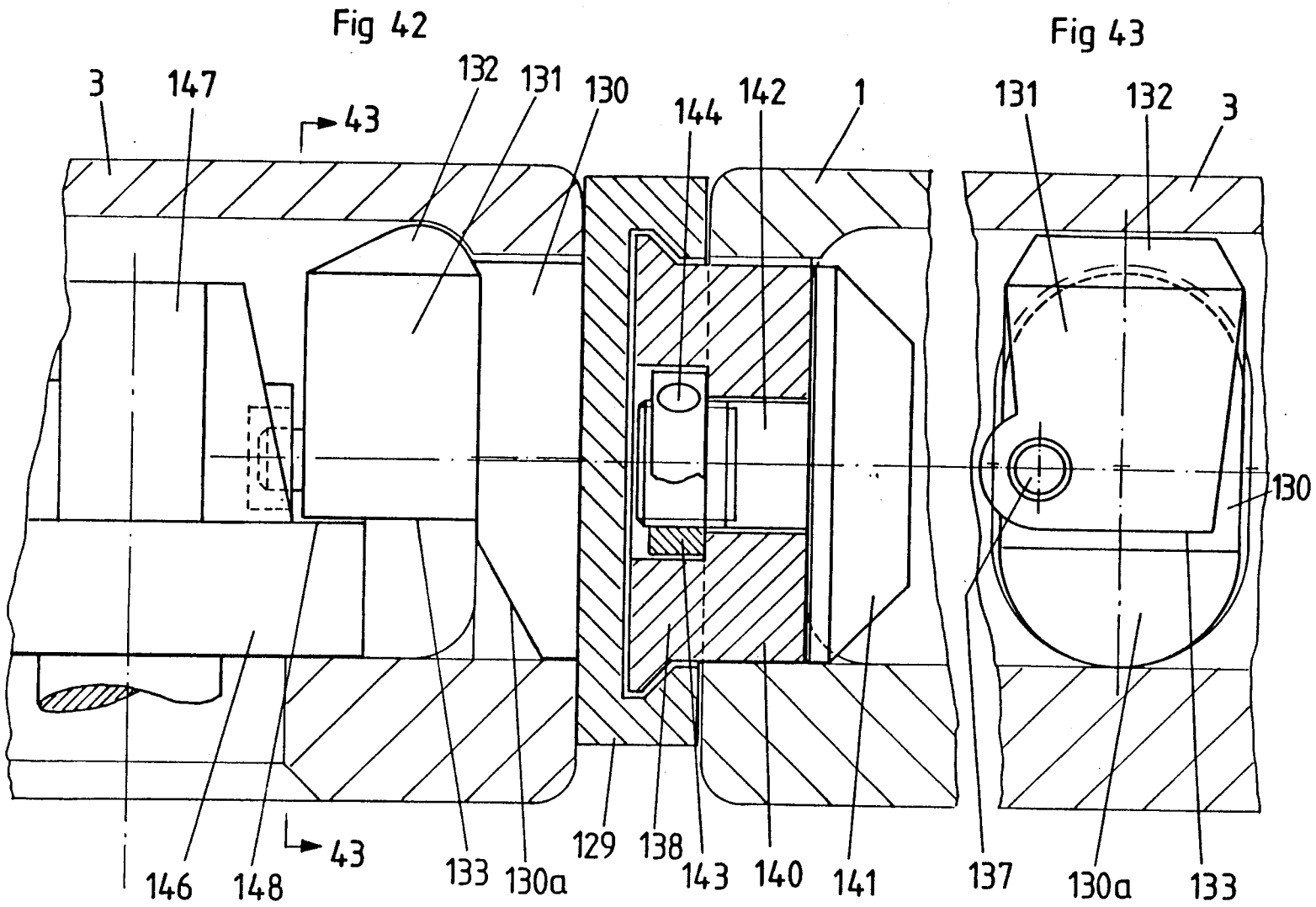
FIG. 42: Partly in section and partly as a view a transverse element coupling two containers in the form of a double function transverse element, as well as a blind twist lock head engaging with a portion of said transverse element.
FIG. 43: A part section along line 43—43 of FIG. 42.
Figure 44:
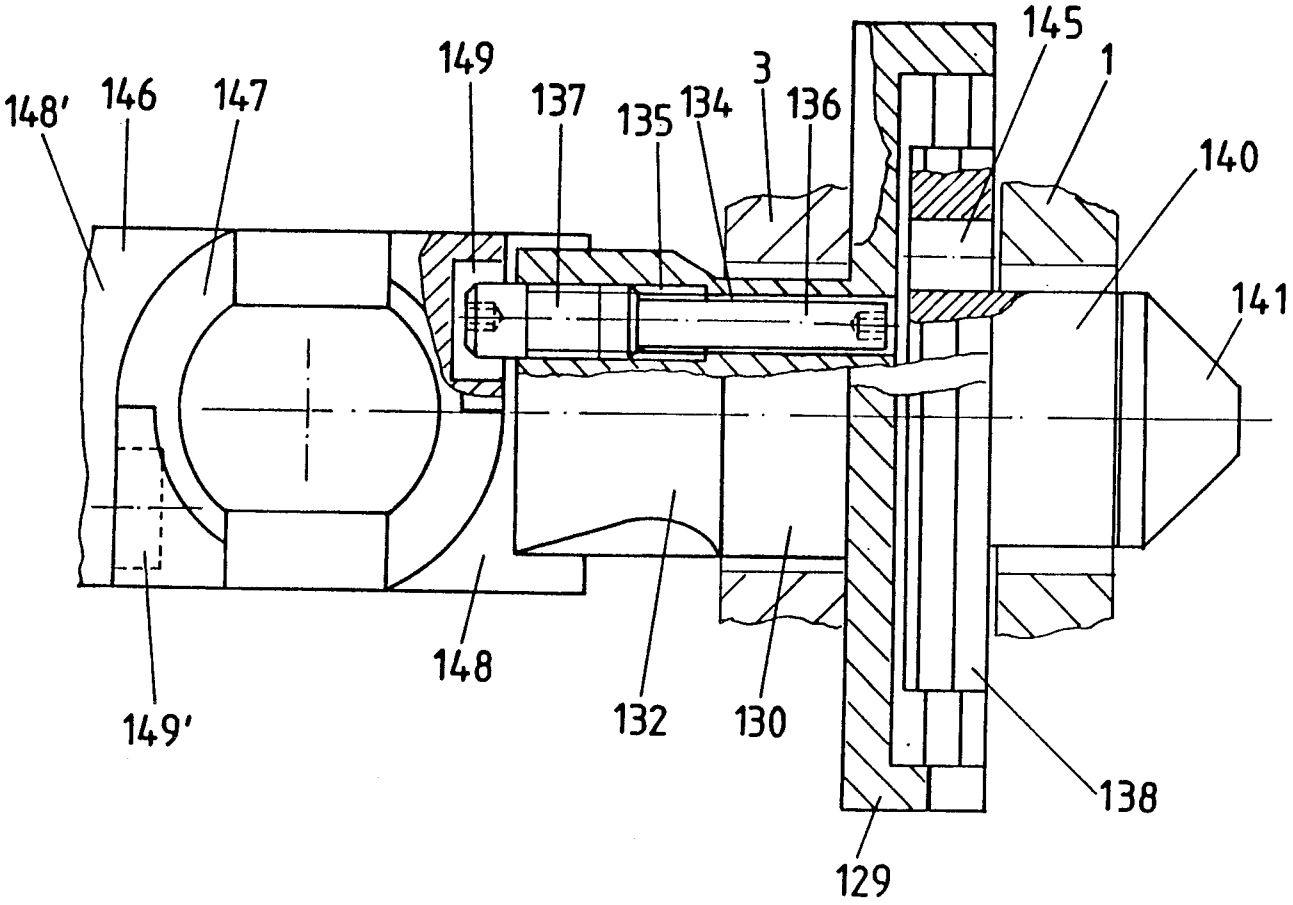
FIG. 44: The arrangement of FIG. 42 in a partly broken away partial view from above.

A double function transverse element as used e.g. as the double function transverse element 51 in FIG. 19 is shown in FIGS. 42 to 44. This double function transverse element comprises two parts which are interconnected by a dovetail guide 129, 138. To the mount 129 of the dovetail guide serving as the double function transverse element plate is connected a collar 130, whose shape is essentially adapted to that of a lateral, lower anchoring opening of container 3, but in the lower region has a bevel 130a, whose function will be described hereinafter. To collar 130 is connected a supporting element 131 having an upwardly extending projection 132 which, as is particularly shown in FIG. 42, engages behind the edge region above the anchoring opening. On the underside of supporting element 131 is provided a supporting face 133, which is horizontal in the fitted state and which is supported on a supporting face 148 on the head of a blind twist lock which is still to be described.

The inserted portion 138 of the dovetail guide and therefore the associated component is reciprocable to a limited extent in the dovetail guide, because the receiving guide portion 129 is closed at its ends, as shown in the plan view of FIG. 44. To this inserted guide portion 138 is connected a collar 140, whose circumferential shape essentially corresponds to the circumferential shape of the lower, lateral anchoring opening of container 1 (FIG. 42). Through collar 140 extends a shaft or spindle 142, which is prevented from axial displacement in a recess in the inserted guide portion 138 by means of a threaded bush 143 which is screwed on to its end. At the end of spindle 142 remote from the inserted guide 138 is fixed a locking head 141, whose shape e.g. corresponds to that of locking head 102 in FIG. 31. In the position shown in FIGS. 42 and 44, the locking head 141 is located in the insertion position. By rotating by means of a tool which, by a not shown cutout, can be engaged with the bore 144 in the threaded bush 143, spindle 142 can be turned and consequently locking head 141 can be brought into its locking position displaced by 90°.

As can in particular be seen from the partly broken away plan view of FIG. 44, a bore 134, which in the vicinity of the supporting part 131 is in the form of a tapped hole, extends through the receiving guide 129, collar 130 and supporting part 131 parallel to spindle 142. Into said bore is screwed a bolt element 136 with its threaded portion 137. The inserted guide 138 has a bore 145 running parallel to spindle 142 and with the inserted guide 138 displaced downwards until engaging on the boundary of guide 138 in FIG. 44 is aligned with bore 134. Thus, in this position, through bore 145 by engagement with a not shown tool, bolt element 136 can be so turned in the reception recess at the end of bolt element 136 that it either projects above the supporting part in the manner shown in FIGS. 42 and 44, or it is completely screwed into the same, so that then the free end of bolt 136 is located in bore 145 and the inserted guide 138 is non-displaceable.

As can be seen in FIGS. 42 and 44, the represented double function transverse element can e.g. be used in conjunction with a blind twist lock, whose head is constructed differently from those of the previously described blind twist locks (in the sectional representation of FIG. 43 the blind twist lock head has been omitted for simplification purposes). The blind twist lock head has a supporting region 146, which can be connected in the same way as the head of the previously described blind twist locks to the not shown collar and the not shown plate and which is shown in the locking position in FIGS. 42 and 44. From supporting region 146 extends a tapering head portion 147. Between the latter and the bearing region 146 are constructed two diagonally, homologously facing, horizontal supporting faces 148, 148', supporting face 133 of supporting part 131 being supported on supporting face 148, as shown in FIG. 42. Recesses 149, 149' are provided on diagonally facing sides of head portion 147. In the represented state, the free end of threaded portion 137 of bolt element 136 extends into recess 149 and therefore prevents the rotation of the blind twist lock head.

For fitting the double function transverse element shown in FIGS. 42 to 44, the bolt element 136 is brought into the position in which it does not project over the supporting part 131 and instead extends into the bore 145. In this position and with the blind twist locks still not inserted, supporting part 131 is inserted in the corresponding lateral, lower anchoring opening of container 3 and brought into the position according to FIG. 42, the insertion into the position where portion 132 engages behind the upper edge region of the anchoring opening is made possible by bevel 130a on collar 130, which permits the insertion of supporting part 131 in an arcuate movement from bottom to top. If the supporting part 131 is located in the represented position, the blind twist lock is inserted, so that supporting face 133 of supporting part 131 is supported on supporting face 148 of supporting region 146 of the blind twist lock head and the double function transverse element consequently can no longer be removed from the anchoring opening in container 3.

By rotation bolt 136 is now displaced in such a way that it extends into the recess 149 in the blind twist lock head (FIGS. 42 and 44), so that on the one hand the blind twist lock is prevented from rotation and therefore cannot be removed from the anchoring opening and on the other bolt 136 passes out of the region of opening 145, so that the inserted guide 138 can be displaced within the dovetail guide.

In this position and with the head 141 in the insertion position, locking head 141 and collar 140 are inserted into a lower anchoring opening of container 1. If locking head 141 and collar 140 are in engagement with the particular associated anchoring opening in container 1, the longitudinal extension of the latter can be displaced with respect to container 3 to the extent in which the inserted guide 138 is displaceable within the receiving guide 129. This permits an adaptation to the different positions of the upper lateral anchoring openings of container 1, as well as the lateral anchoring openings of further containers possibly belonging to this container unit and which are caused by tolerances.

The movement of locking head 141 into the locking position takes place by engaging a tool in bore 144 (FIG. 42) enabling the locking head 141 to be rotated into a position in which it engages behind facing edge regions of the anchoring opening in container 1.

Figure 47:
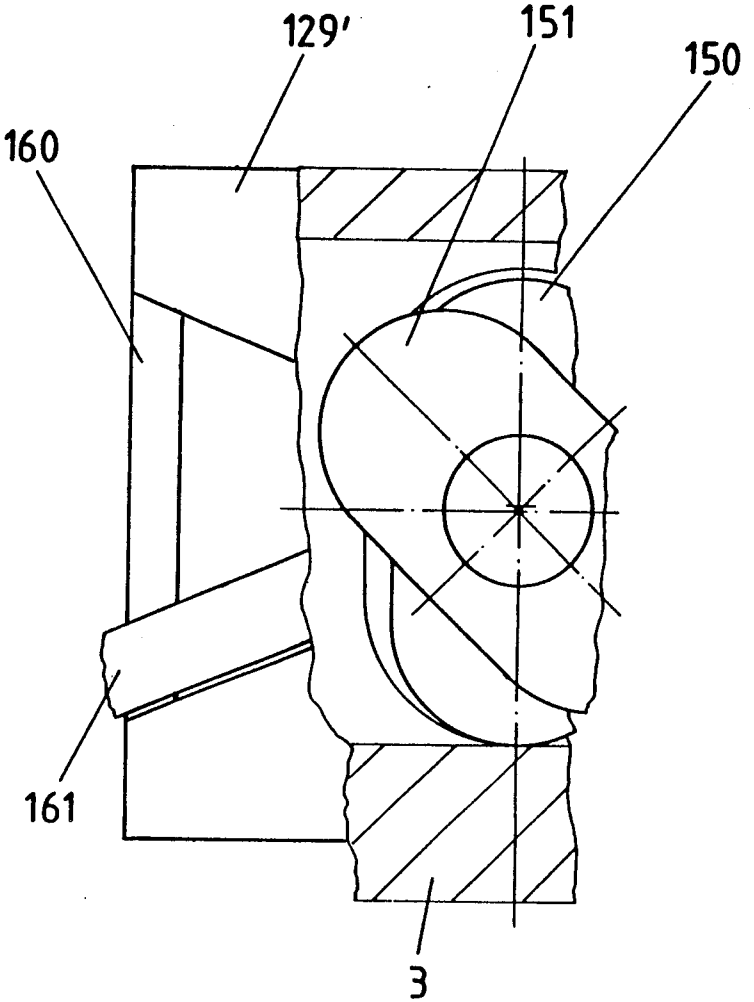
FIG. 47: Partly broken away an end view of the double function transverse element of FIG. 45.
Figure 46:
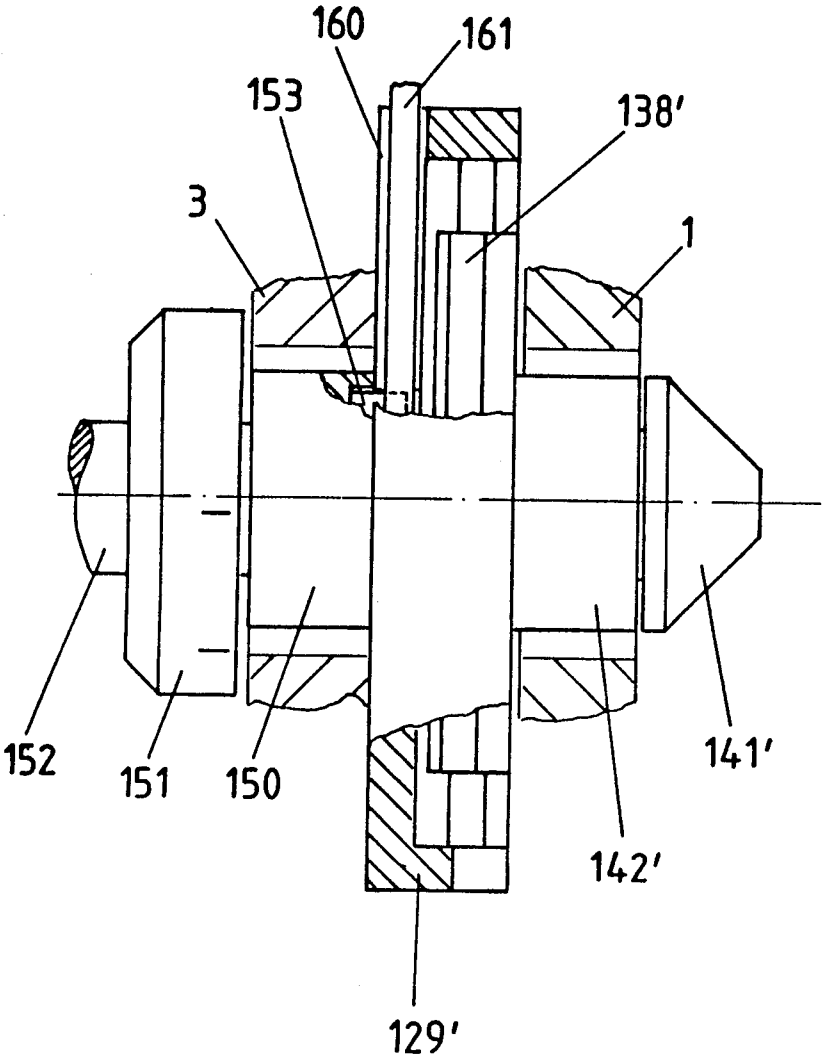
FIG. 46: In a partial representation and partly broken away, the central region of the double function transverse element of FIG. 45 in a position turned by 90°.

FIGS. 45 to 47 show a double function transverse element, which is partly similar to the same element in FIGS. 42 to 44 and in which identical or corresponding parts are given the same reference numerals, followed by an apostrophe.

As can be seen, that part of the double function transverse element of FIG. 45 having the inserted guide 138' is constructed in the same way as the part of the double function transverse element having the inserted guide 138 in FIGS. 42 to 44, so that said part will not be described again.

The other part of the double function transverse element has a receiving guide 129' which, as regards the construction of the dovetail guide, coincides with the receiving guide 129 in FIGS. 42 to 44. To the receiving guide 129' is connected a collar 130', whose shape corresponds to collar 99 in FIG. 31. Through the unit constituted by the receiving guide 129' and collar 130' extends a rotatably held shaft or spindle 150, which carries a locking head 151 and a locking pin 152, which correspond to locking head 103 and locking pin 104 in FIG. 31, locking pin 152 in this case engaging with the head of a blind twist lock, as shown in FIG. 24. Spindle 150 is prevented from rotating by means of a fitted threaded ring, which is prevented from rotating on spindle 150 by a not shown grub screw and cannot be removed from the receiving guide 129' in the direction of collar 130', because torus 153 engages on an annular shoulder of collar 150.

Locking head 151 can be rotated between the insertion position and the locking position in the same way as locking head 141' by means of a lever 161, which is inserted through a recess 160 in the receiving guide 129' in a not shown bore in torus 153 and in the represented position locking head 151 is in the locking position.

The insertion of the double function transverse element according to FIGS. 45 to 47 in a lower, lateral anchoring opening of container 3 and the engagement with the head of the blind twist lock takes place in the same way as described relative to FIG. 32, whilst the coupling with container 1 is performed in the manner explained relative to FIGS. 42 to 44.

For joining adjacent conainer units, it is also possible to use transverse elements which are able to take up the forces occurring during the coupling of adjacent containers or container units and which act in the plane of the particular container side wall, whereas the transverse and diagonal forces are solely taken up by the diagonal and/or transverse lashings provided on the end faces of the container units (cf. FIGS. 6 to 8). Such a transverse element is shown in FIGS. 48 and 49 and in the case of FIG. 49 a lateral, upper anchoring opening of container 1 is shown in dot-dash manner.

Figure 48:
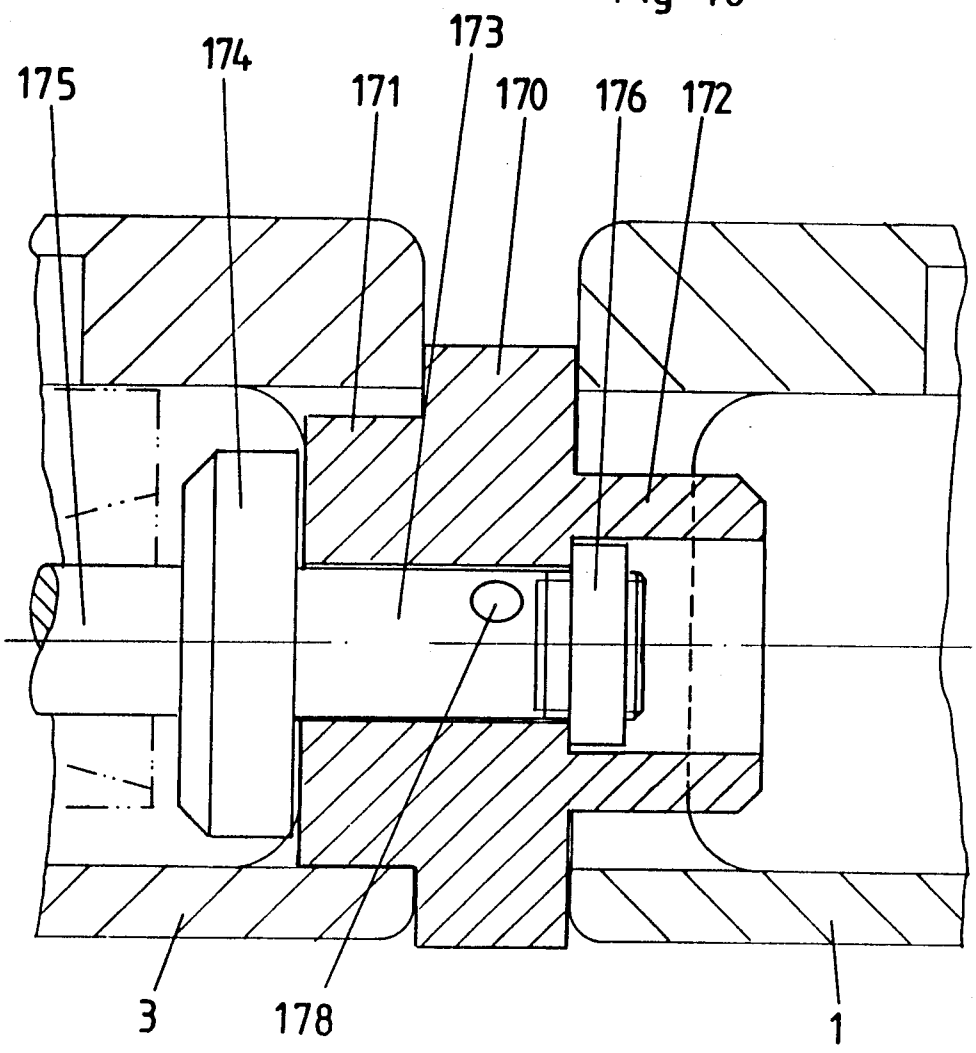
FIG. 48: A further transverse element.
Figure 49:
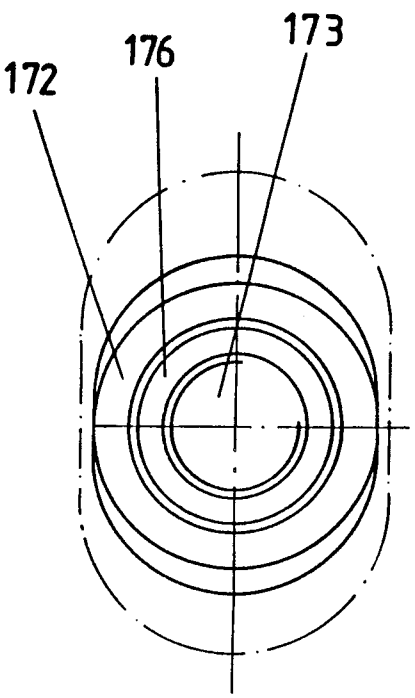
FIG. 49: An end view of the transverse element of FIG. 48.

The transverse element according to FIGS. 48 and 49 can e.g. be the transverse element 34' of FIG. 6, which is in positive engagement with the lower locking head of the middle twist lock 41, which can e.g. be a middle twist lock according to FIGS. 34 and 35.

The represented transverse element has a plate 170, to which is connected in one piece at one side a collar 172 which, as shown in FIG. 48, is extended in pin-like manner over the associated anchoring opening, so that in the inserted state it projects over the anchoring opening in container 1. At the side of plate 170 opposite to collar 172 is engaged a collar 171 also constructed in one piece with plate 170. Through plate 170 and collar 171 extends a rotary shaft or spindle 173, which carries on its area adjacent to collar 171 a locking head 174 over which extends a pin 175. This spindle is fixed by means of a threaded ring 176 in a similar manner to spindle 150 of the double function transverse element of FIGS. 45 to 47. In the spindle is provided a bore 178, into which it can extend by means of a not shown cutout in plate 170 a lever, with the aid of which the spindle 173 is rotated and consequently the locking head 174 can bemoved between an insertion position and a locking position.

As can in particular be gathered from FIG. 49, with its pin-like extension, collar 172 roughly has a width corresponding to the width of the lateral anchoring opening, whereas its height is much less than the anchoring opening height. Thus, there can be a height compensation of the tolerances of the position off the lateral anchoring openings.

The transverse element according to FIGS. 48 and 49, if used e.g. as transverse element 34' of FIG. 6, is inserted in the upper, lateral anchoring opening of container 3, so that pin 175 engages with the through-bore in the lower locking head of the middle twist lock 41. Locking head 174 is then turned into its locking position. On combining container units 1, 1' and 3, 3', collar 172 passes into the corresponding lateral, upper anchoring opening of container 1, so that after fitting clamps and/or lashing bores or ropes on the end faces of the container units, the transverse element absorbs the forces occurring in the plane of the side wall of container 1 adjacent to container 3, whilst the lashings on the end faces of the container units hold together the latter.

It is pointed out that e.g. the transverse element according to FIGS. 48 and 49 can also be used in the described manner for coupling in the vicinity of the upper, lateral anchoring openings of the upper containers, e.g. containers 1' and 3' in FIG. 2. Pin 175 then engages with the locking head of a blind twist lock, e.g. according to FIGS. 22 and 29, or a blind insertion element according to FIGS. 25 to 28. When there is no blind twist lock or insertion element, pin 175 can in itself prevent the engagement of a locking head of lifting equipment in this area.

As has already been stated, frequently difficulties occur during the assembly of container units because the lateral anchoring openings of the individual containers are displaced within the permitted tolerances. A preferred possibility for overcoming this problem when assembling two container units is shown in FIGS. 50 to 55.

Figures 50, 51:
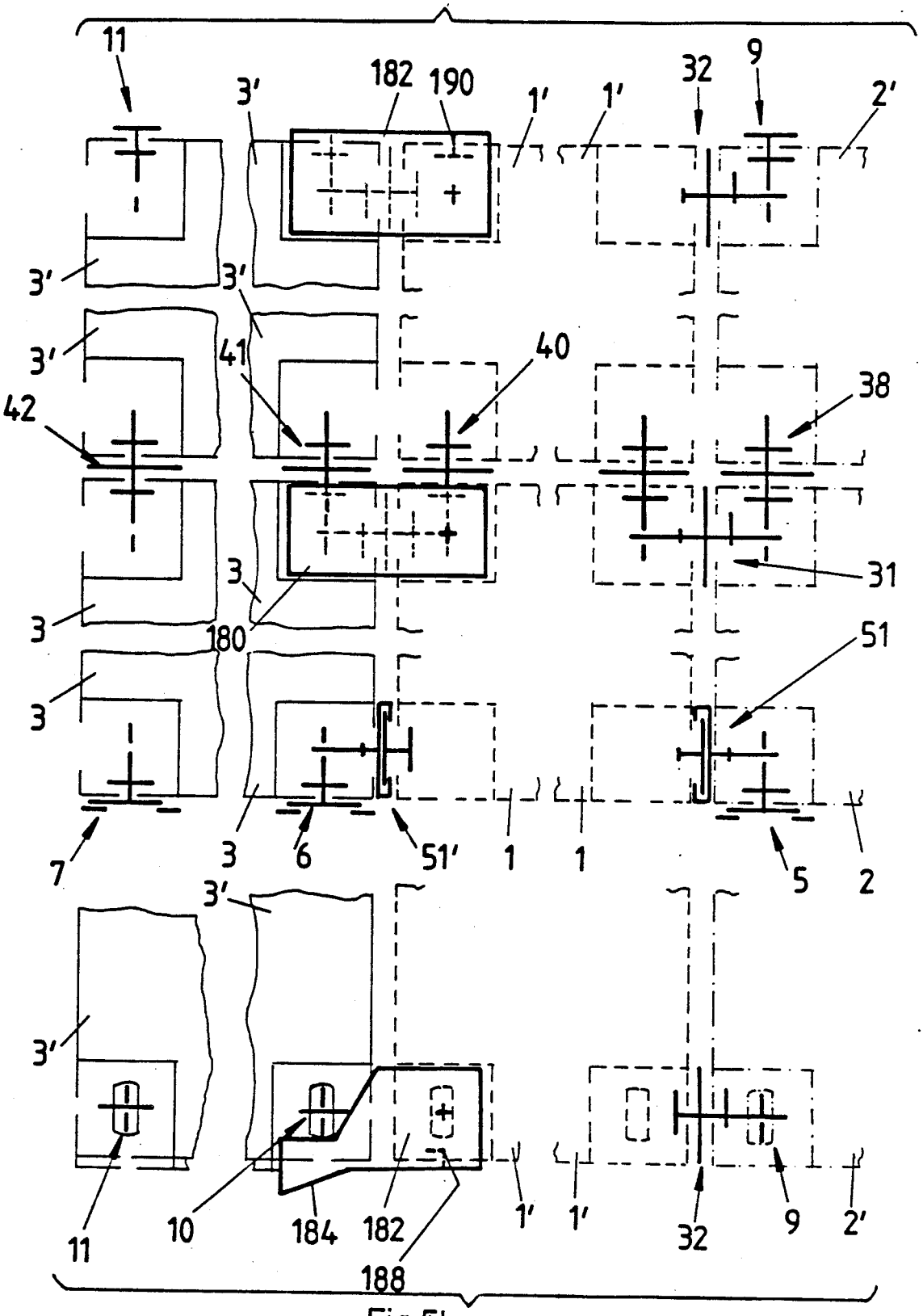
FIG. 50: A partial front view of a transportation unit with guide elements for combining and aligning two container units.
FIG. 51: A partial plan view of the transportation unit of FIG. 50.

FIG. 50 diagrammatically shows a transportation unit essentially corresponding to that of FIG. 14I, in which the outer container unit 2,2' is already coupled to container unit 1, 1' by transverse elements 31, 32 brought into the locking position, e.g. the transverse elements according to FIGS. 39 and 31, as well as double function transverse elements 51, e.g. according to FIGS. 45 to 47.

Figures 52, 53, 54, 55:
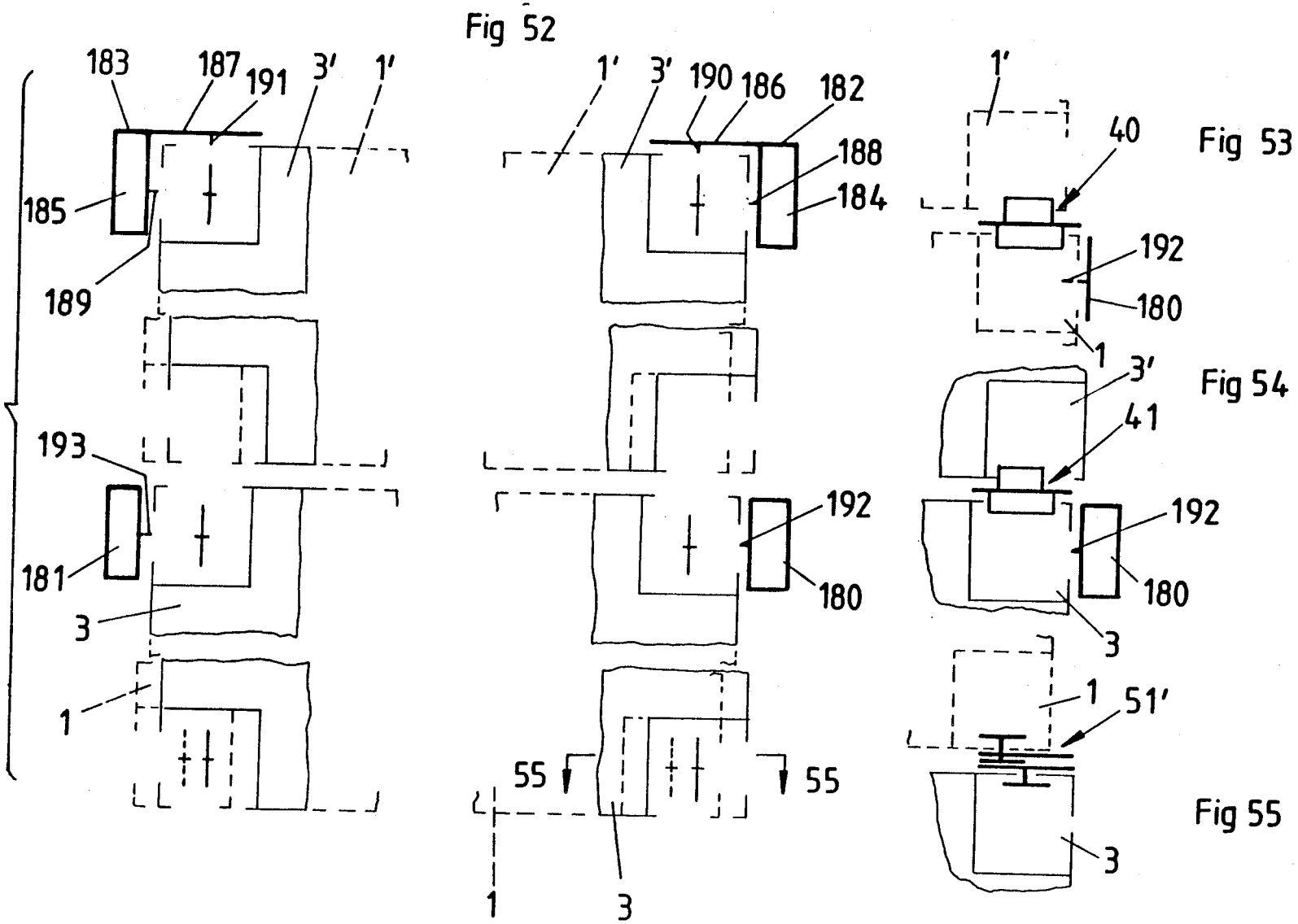
FIG. 52: Diagrammatically a partial side view of the container unit carrying the guide elements.
FIGS. 53 and 54: Two different positions of the containers of a container unit in the vicinity of corner fittings coupled by middle twist locks.
FIG. 55: A section along line 55—55 of FIG. 53.

For connecting container unit 1, 1' to container unit 3, 3', to the upper corner fittings of containers 1, 1' in the vicinity of the container end faces are fixed guide elements 180, 181 and 182, 183, whereof elements 180, 181 are fitted to container 1 by retaining elements 192, 193, which are not shown and extend into the upper frontal anchoring openings of container 1, whilst guide elements 182, 183 are fixed to container 1' by retaining elements 190, 191 engaging in anchoring openings provided in the upper surface of container 1' and retaining elements 188, 189 engaging in frontal anchoring openings (FIG. 52). For this purpose retaining elements 182, 183 have plate portions 186, 187 resting on the upper surface of container 1 and which, as shown in FIG. 51, project over the side wall of container 1', but are cut out in such a way that the adjacent blind twist locks (10 in FIG. 51) located in the upper surface of container 3' remain outside the region of plate portions 186, 187 on moving up the container unit 3, 3'.

As can in particular be gathered from FIG. 51, each guide element has a guidance face which slopes outwards and extends twoards container unit 3, 3' in FIG. 51. Thus, guide member 182 has a guidance face 184, guide member 183 has a guidance face 185 (FIG. 52) and guide members 180, 181 are correspondingly constructed.

In the side view according to FIG. 52 and also in FIGS. 50 and 51, containers 1, 1' of the central container unit are shown in broken line form and containers 3,3' of the lateral container unit in continuous line form. It can be seen that the guide members 180, 181 reciprocally align the upper end face regions of containers 1 and 3 and guide elements 182, 183 reciprocally align the upper end face regions of containers 1' and 3' on moving container units 3, 3' up to container units 1, 1', so that the transverse elements (e.g. 34 and 35 according to FIG. 14I) with their ends projecting out of the anchoring openings of containers 3, 3' are precisely aligned with the associated anchoring openings of containers 1, 1' and can consequently be inserted in them.

This alignment can lead to a displacement of the lower region of container 1' or 3' with respect to container 1 or 3 in the direction of the longitudinal extension of the containers, which is made possible by the smaller dimensions of the upper collar of the middle twist lock 40 or 41 indicated in FIGS. 53 and 54 and explained in conjunction with FIGS. 34 to 48. This displacement does not lead to additional problems, because no transverse elements are inserted in the lower, lateral anchoring openings of containers 1' and 3'.

A corresponding displacement or misalignment of anchoring openings can also occur in the lower areas of the containers 1 and 3 due to the positions of the lateral anchoring openings diverging within the tolerance range on aligning the upper areas of said containers. This is shown in FIG. 52, in which the lower, lateral anchoring openings of container 3 are displaced to the right with respect to the lateral anchoring openings of container 1. As shown in FIG. 55, this displacement is compensated through the use of double function transverse elements 51', whose two parts are displaced reciprocally in the direction of the longitudinal extension of the containers.

After aligning container units 1, 1' and 3, 3' and the engagement of the different transverse elements, the latter are locked, so that the lateral container unit 3, 3' is firmly, but detachably connected with container unit 1, 1'.

It is pointed out that guide elements 180, 181 can remain on the transportation unit during transportation, but it is essential to remove guide members 182, 183, so that the anchoring openings in the upper surface of container unit 1, 1' are free for engaging the locking heads of lifting equipment.

What is claimed is:

1. A transportation unit formed from a plurality of container units (1, 1'; 2, 2'; 3, 3') comprising ISO containers (e.g. 1, 1', 2, 2', 3, 3') whose side faces are juxtaposed by the detachable coupling of end fittings by means of coupling elements (e.g. 31, 32, 51) extending into anchoring openings, comprising an uneven number of container units (1, 1'; 2, 2'; 3, 3'), which are interconnected by means of coupling elements (31, 32, 51) comprising transverse elements, anchoring openings in an upper surface of a central container unit (1, 1') being left free so as to permit the engagement of locking heads of lifting equipment (e.g. 22), whilst upper anchoring areas provided in the plane of upper surfaces of container units positioned laterally of the central container unit are blocked against the penetration of locking heads of lifting equipment and are at least partially closed and supporting elements are inserted in lower anchoring openings provided in the plane of lower surfaces of the container units positioned laterally of the central container unit.

2. A transportation unit formed from a plurality of container units (1, 1'; 2, 2'; 3, 3') comprising ISO containers (e.g. 1, 1', 2, 2', 3, 3') whose side faces are juxtaposed by the detachable coupling of end fittings by means of coupling elements (e.g. 31, 32, 51) extending into anchoring openings, comprising an uneven number of container units (1, 1'; 2, 2'; 3, 3'), which are interconnected by means of coupling elements (31, 32, 51) comprising transverse elements, where anchoring openings in an upper surface of a central container unit (1, 1') are left free to permit the engagement of locking heads of lifting equipment, whilst upper anchoring areas provided in the plane of upper surfaces of the container units (2, 2', 3, 3') positioned laterally of the central container unit are blocked against the penetration of locking heads of lifting equipment and are at least partly closed.

3. A transportation unit according to claim 1, wherein blind insertion elements (e.g. 8, 9, 10, 11, 4, 5, 6, 7) are inserted in anchoring openings provided in at least one of the upper and lower surfaces of the lateral container units (e,g, 2, 2', 3, 3').

4. A transportation unit according to claim 3, wherein the blind insertion elements are blind twist locks.

5. A transportation unit according to one of claims 1 to 4, wherein the anchoring openings present in a lower surface of the central container unit (1, 1') are left free to permit the engagement of anchoring elements (16, 17).

6. A transportation unit according to claim 5, wherein at least some of the transverse elements (e.g. 30, 31, 32, 33, 34, 35), at least in the area of one of the container units (1, 1', 2, 2', 3, 3') coupled by them are in positive engagement with an auxiliary element (e.g. 5, 38, 9, 6. 41, 10) extending through an anchoring opening of a corner fitting into which said at least some transverse elements extend.

7. A transportation unit as in claim 1, further comprising transvese elements in the form of double function transverse elements in engagement with anchoring openings, located at one height, of adjacent containers of the container units, said double function transverse elements permit a limited displacement of the containers coupled by them in a direction parallel to a longitudinal extension of their side walls.

8. A transportation unit according to claim 7, wherein the double function transverse elements (51) are inserted in lower, lateral anchoring openings.

9. A transportation unit according to claim 8, wherein transverse elements in the form of twist locks (e.g. 31, 34) are provided, which are locked by at least one end in an anchoring opening, are inserted in lateral anchoring openings of the containers (1, 2, 3) coupled by the double function transverse elements (51).

10. A transportation unit according to claim 9, wherein further containers (1', 2', 3') of the container units (1, 1'; 2, 2'; 3, 3') are coupled together by two transverse elements (32, 35) at the same height.

11. A transportation unit according to claim 10, comprising three container units (e.g. 1, 1'; 2, 2'; 3, 3').

12. A transportation unit according to claim 11, wherein as auxiliary elements for the transverse elements (e.g. 30, 33) inserted in the lower, lateral anchoring openings of the container units (e.g. 1, 1'; 2, 2'; 3, 3'), blind twist locks (5, 6) are inserted into anchoring openings of lateral surfaces of the container units (2, 2', 3, 3') positioned laterally of the central container unit (1, 1').

13. A transportaion unit according to claim 12, wherein as auxiliary elements for the transverse elements (32, 35) inserted in the upper, lateral anchoring openings of the container units (e.g. 1, 1'; 2, 2'; 3, 3'), blind twist locks (9, 10) are inserted in the upper surfaces of the container units (2, 2'; 3, 3') positioned laterally of the central container unit (1, 1').

14. A transportation unit according to claim 13, wherein the blind twist locks (e.g. 6) have in their heads (52) a bore (54) and wherein the adjacent transverse element (33) with a pin (59) projecting in an extension of its longitudinal axis extends into the bore (54) in the head (52) of said blind twist lock (6).

15. A transportation unit according to claim 14, wherein the bore (e.g. 87) in the head (82) of the blind twist lock tapers from the opening side facing the transverse element towards the centre of the head.

16. A transportation unit according to claim 15, wherein the longitudinal axis of the bore (87) in said head (82) of the inserted blind twist lock is positioned somewhat lower than the centre of the adjacent, lateral anchoring opening.

17. A transportation unit according to claim 13, wherein one portion of the transverse element comprising a double function transverse element engages with its head (131, 132) behind the upper edge region of the anchoring opening receiving it and is supported with a substantially horizontal supporting face (133) on a step (146) on the head (147) of the blind twist lock in the locking position.

18. A transportation unit according to claim 17, wherein the double function transverse element with an axially displaceable pin (136) engages with a recess (149) in the blind twist lock head.

19. A transportation unit according to claim 1, wherein each container unit consists of one container (1, 2, 3).

20. A transportation unit according to claim 1, wherein each container unit comprises at least two superimposed containers (1, 1', 2, 2', 3, 3'), which are in each case interconnected at all four corners by middle twist locks (38, 39, 40, 41, 42).

21. A transportation unit according to claim 20, wherein each middle twist lock (e.g. 41) has a lower head (61, 62) constructed in accordance with the head (43', 54') of a blind twist lock (10) and which serves as an auxiliary element for the positive engagement with the adjacent transverse element (e.g. 31, 34).

22. A transportation unit according to claim 21, wherein the circumferential turning circle (K) of the lower head of the middle twist lock passes through the head (102) of the transverse element when the latter is in the fitted state.

23. A transportation unit according to claim 22, wherein the collar (64) of the middle twist lock adjacent to the lower head (61, 62) has a greater width and length that the collar adjacent to the upper head (63).

24. A transportation unit according to claim 1, wherein to the end faces of adjacent container units (e.g. 1, 1', 2, 2', 3, 3') are fitted tensile stress-absorbing coupling elements (43, 45, 46) in a sloping and/or horizontal manner.

25. A transportation unit according to claim 1, wherein anchoring openings present in a lower surface of the central container unit are left free to permit the engagement of anchoring elements.

26. A transportation unit according to claim 25 wherein anchoring openings present in a lower surface of the central container are left free to permit the engagement of anchoring elements.

27. A transportation unit comprising a plurality of container units (1, 1', 2, 2', 3, 3'), comprising ISO containers (e.g. 1, 1', 2, 2', 3, 3'), juxtaposed at their side faces by the detachable coupling of corner fittings by means of coupling elements (e.g. 31, 32, 51) including transverse elements extending into anchoring openings of corner fittings comprising: an uneven number of container units (1, 1', 2, 2', 3, 3'), which are interconnected and wherein anchoring openings in an upper surface of a central container unit (1, 1') are left free to permit the engagement of lifting heads of lifting equipment (e.g. 22) and that at least some of the transverse elements (e.g. 30, 31, 32, 33, 34, 35) at least in the area of one of the container units (1, 1', 2, 2', 3, 3') coupled by them, are in positive engagement with an auxiliary element (e.g. 5, 38, 9, 6, 41, 10) at least partly located in the cavity of a corner fitting receiving one of said transverse elements.

28. A method for combining into a transportation unit an odd number of laterally adjoining container units, each of which comprises at least one ISO container located in each of at least one corresponding container tier, and in which each ISO container comprises a rectangular, box-like member having a horizontal upper wall and a horizontal lower wall, two vertical opposite walls and two vertical opposite end walls provided at longitudinally opposite ends of said side walls, which walls of each container, in respective sets of three, meet one another at four lower corners and four upper corners, of which each upper corner is provided with an ISO upper corner fitting having an upper anchoring opening through said upper wall into a upper corner fitting cavity, a side anchoring opening through a respective said side wall into said upper corner fitting cavity, and an end anchoring opening through a respective said end wall into said upper corner fitting cavity, and of which each lower corner is provided with an ISO lower corner fitting having a lower anchoring opening through said lower wall into a lower corner fitting cavity, a side anchoring opening through a respective said side wall into said lower corner fitting cavity, and an end anchoring opening through a respective said end wall into said lower corner fitting cavity, and wherein in each container unit, if multi-tier each upper container is arranged in substantially superimposed juxtaposition with a respective lower container with the lower wall of the upper container disposed in facial confrontation with the upper wall of the respective lower container and mechanically interconnected by corner elements projecting from lower corner fittings of the upper container into upper corner fittings of the lower container through respective ones of said anchoring openings, so that the transportation unit includes a central container unit adjoined in one lateral direction by at least one lateral container unit and adjoined in an opposite lateral direction by at least one lateral container unit, said method comprising:

arranging equal numbers of said lateral container units in series with said central container unit and on opposite sides of said central container unit, all these container unit being disposed in side-by-side facially confronting juxtaposition, with two upper and two lower corner fittings involving one side wall of each more medial container laterally adjoining respective ones of two upper and two lower corner fittings involving a facially confronting side wall of a respective more lateral said container in a respective same tier;

installing in at least some of the resulting sets of two laterally adjoining corner fittings through respective said openings into respective said cavities a respective transverse coupling element, and reversibly manipulating each installed transverse coupling element for detachably coupling respective corner fittings together so as to prevent substantial relative vertical and horizontal movements and substantial transverse movement between the respective containers;

while leaving all four of said upper anchoring openings of the four said upper corner fittings of the uppermost said container in said central container unit free, inserting locking head entry-blocking devices in at least some of the upper corner fittings of the uppermost said containers in said lateral container units, for preventing lifting engagement by respective locking heads of lifting equipment for preventing lifting of said transportation unit, as a unit, from said lateral container units; and inserting support elements in said at least some of lower anchoring openings of the lower corner fittings of the lowermost said containers in said lateral container units, for thereby preventing these lower anchoring openings from receiving engaging anchoring elements.

29. The method of claim 28, further including:

leaving all four of said lower anchoring openings of the four said lower corner fittings of the lowermost said container in said central container unit free for receivingly engaging anchoring elements.

30. The method of claim 28, further comprising:

installing, through another respective said opening of at least some of said sets of laterally adjoining corner fittings other than those through which said transverse coupling elements are installed, respective auxiliary elements; and reversibly manipulating said auxiliary elements into engagement with respective said transverse coupling elements for preventing reverse manipulation of the respective said transverse coupling elements, unless the respective auxiliary elements are first reversely manipulated for disengaging them from the respective said transverse coupling elements.

31. The method of claim 28, further comprising:

fitting at least one double-ended, elongated tensile stress-absorbing coupling element between respective end anchoring openings of two said corner fittings in two of said container units at one end of said transportation unit for providing a tensile connection between respective containers at said one end.

32. The method of claim 31, wherein:

said step of fitting comprises fitting between two container units disposed in laterally adjoining relation.

33. The method of claim 32, wherein:

said step of fitting comprises fitting between end anchoring openings disposed at a common level and extending said tensile stress-absorbing element horizontally across said one end.

34. The method of claim 32, wherein:

said step of fitting comprises fitting between end anchoring openings disposed at different levels and extending said tensile stress-absorbing elements obliquely across said one end.

35. The method of claim 34, wherein:

said step of fitting comprises fitting between end anchoring openings disposed in different tiers of said containers.

36. The method of claim 31, wherein:

said step of fitting comprises fitting between two container units which are laterally spaced from one another by at least one intervening said container unit.

37. The method of claim 36, wherein:

said step of fitting comprises fitting between end anchoring openings disposed at different levels and extending said tensile stress-absorbing element obliquely across said one end.

38. The method of claim 37, wherein:

said step of fitting comprises fitting between end anchoring openings disposed in different tiers of said containers.

39. The method of claim 38, wherein:

said step of fitting comprises fitting two said tensile stress-absorbing coupling elements arranged in an X pattern on each said end of said transportation unit.

40. The method of claim 28, wherein said step of installing transverse coupling elements comprises installing twist-two-lock elements which are reversibly locked by being twisted about respective transversely-extending axes and which, when locked prevent substantial relative horizontal longitudinal movement between the respective containers at said other level.

41. The method of claim 28, wherein said step of installing transverse coupling elements includes leaving at least some of said sets of two laterally adjoining lower corner fittings in a tier of said containers next-uppermost in relation to said lowermost tier unoccupied by said tansverse coupling elements whereas all said sets of two laterally adjoining upper corner fittings have said transverse coupling elements installed and reversibly manipulated therein for detachably coupling respective laterally adjoining upper corner fittings together.

42. The method of claim 28, wherein said step of arranging includes arranging only one lateral container unit on each side of said central container unit.

43. The method of claim 30, wherein said step of installing respective auxiliary elements includes installing at least some blind twist locks by inserting the same in respective upper anchoring openings of respective upper corner fittings in a respective uppermost tier of respective said containers only in said lateral container units.

44. The method of claim 30, wherein said step of installing auxiliary elements includes installing at least some auxiliary elements constituted by middle twist locks inserted in respective said openings in respective pairs of vertically aligned upper and lower said corner fittings in respective vertically adjoined tiers of said containers.

45. The method of claim 41, further comprising:

prior to performing said arranging step as to at least one said lateral container unit the containers of which are to be disposed in side-by-side facially confronting relationship with corresponding containers of said central container unit providing, the upper corner fittings involving a respective one sidewall of a container in at least one tier in said central container unit which, as a result of said arranging step, is to become disposed in said confronting relationship with a respective sidewall of a respective container in said one lateral contianer unit, with respective guide elements for engaging features provided on said respective container of said one lateral container unit as said arranging step is being conducted, and thereby tending to align corresponding said anchoring openings of said central container unit and said one lateral container unit.

46. The method of claim 28, further comprising providing the transverse coupling elements connecting respective said corner fittings in one level in one said tier of containers as double-function transverse coupling elements, which, after manipulation to detachably couple respective corner fittings together, continue to permit limited relative horizontal longitudinal movement between the respective containers at said level.

47. A method for combining into a transportation unit an odd number of laterally adjoining container units, each of which comprises at least one ISO container located in each of at least one corresponding container tier, and in which each ISO container comprises a rectangular, box-like member having a horizontal upper wall and a horizontal lower wall, two vertical opposite side walls and two vertical opposite end walls provided at longitudinally opposite ends of said side walls, which walls of each container, in respective sets of three, meet one another at four lower corners and four upper corners, of which each upper corner is provided with an ISO upper corner fitting having an upper anchoring opening through said upper wall into a upper corner fitting cavity, a side anchoring opening through a respective said side wall into said upper corner fitting cavity, and an end anchoring opening through a respective said end wall into said upper corner fitting cavity, and of which each lower corner is provided with an ISO lower corner fitting having a lower anchoring opening through said lower wall into a lower corner fitting cavity, a side anchoring opening through a respective said side wall into said lower corner fitting cavity, and an end anchoring opening through a respective said end wall into said lower corner fitting cavity, and wherein in each container unit, if multi-tier each upper container is arranged in substantially superimposed juxtaposition with a respective lower container with the lower wall of the upper container disposed in facial confrontation with the upper wall of the respective lower container and mechanically interconnected by corner elements projecting from lower corner fittings of the upper container into upper corner fittings of the lower container through respective ones of said anchoring openings, so that the transportation unit includes a central container unit adjoined in one lateral direction by at least one lateral container unit and adjoined in an opposite lateral direction by at least one lateral container unit, said method comprising:

arranging equal numbers of said lateral container units in series with said central container unit and on opposite sides of said central container unit, all these container units being disposed in side-by-side facially confronting juxtaposition, with two upper and two lower corner fittings involving one side wall of each more medial container laterally adjoining respective ones of two upper and two lower corner fittings involving a facially confronting side wall of a respective more lateral said container in a respective same tier;

installing of at least some of the resulting sets of two laterally adjoining corner fittings through respective said openings into respective said cavities a respective transverse coupling element, and reversibly manipulating each installed transverse coupling element for detachably coupling respective corner fittings together so as to prevent substantial relative vertical and horizontal movements and substantial relative transverse movement between the respective containers, while leaving all four of said upper anchoring openings of the four said upper corner fittings of the uppermost said container in said central container unit free; and inserting locking head entry-blocking devices in at least some of the upper corner fittings of the uppermost said containers in said lateral container units, for preventing lifting engagement by respective locking heads of lifting equipment for preventing lifting of said transportation unit, as a unit, from said lateral container units.

48. The method of claim 47, further comprising:

fitting at least one double-ended, elongated tensile stress-absorbing coupling element between respective end anchoring openings of two said corner fittings in two of said container units at each of the two ends of said transportation unit for providing a tensile connection between respective containers at said ends.

49. The method of claim 48, wherein:

said step of fitting comprises fitting between two container units disposed in laterally adjoining relation.

50. The method of claim 49, wherein:

said step of fitting comprises fitting between end anchoring openings disposed at a common level and extending said tensile stress-absorbing element horizontally across said one end.

51. The method of claim 49, wherein:

said step of fitting comprises fitting between end anchoring openings disposed at different levels and extending said tensile stress-absorbing elements obliquely across said one end.

52. The method of claim 51, wherein:

said step of fitting comprises fitting between end anchoring openings disposed in different tiers of said containers.

53. The method of claim 48, wherein:

said step of fitting comprises fitting between two container units which are laterally spaced from one another by at least one intervening said container unit.

54. The method of claim 53, wherein:

said step of fitting comprises fitting between end anchoring openings disposed at different levels and extending said tensile stress-absorbing element obliquely across said one end.

55. The method of claim 54, wherein:

said step of fitting comprises fitting between end anchoring openings disposed in different tiers of said containers.

56. The method of claim 55, wherein:

said step of fitting comprises fitting two said tensile stress-absorbing coupling elements arranged in an X pattern on each said end of said transportation unit.

57. The method of claim 47, wherein said step of inserting locking head entry-blocking devices comprises inserting respective blind insertion elements.

58. The method of claim 57 further comprising removable securing the inserted blind insertion elements in place by twisting them about respective vertical axes.

59. A method for combining into a transportation unit an odd number of laterally adjoning container units, each of which comprises at least one ISO container located in each of at least one corresponding container tier, and in which each ISO container comprises a rectangular, box-like member having a horizontal upper wall and a horizontal lower wall, two vertical opposite side walls and two vertical opposite end walls provided at longitudinally opposite ends of said side walls, which walls of each container, in respective sets of three, meet one another at four lower corners and four upper corners, of which each upper corner is provided with an ISO upper corner fitting having an upper anchoring opening through said upper wall into a upper corner fitting cavity, a side anchoring opening through a respective said side wall into said upper corner fitting cavity, and an end anchoring opening through a respective said end wall into said upper corner fitting cavity, and of which each lower corner is provided with an ISO lower corner fitting having a lower anchoring opening through said lower wall into a lower corner fitting cavity, a side anchoring opening through a respective said side wall into said lower corner fitting cavity, and an end anchoring opening through a respective said end wall into said lower corner fitting cavity, and wherein in each container unit, if multi-tier each upper container is arranged in substantially superimposed juxtaposition with a respective lower container with the lower wall of the upper container disposed in facial confrontation with the upper wall of the respective lower container and mechanically interconnected by corner elements projecting from lower corner fittings of the upper container into upper corner fittings of the lower container through respective ones of said anchoring openings, so that the transportation unit includes a central container unit adjoined in one lateral direction by at least one lateral container unit and adjoined in an opposite lateral direction by at least one lateral container unit, said method comprising:

arranging equal numbers of said lateral container units in series with said central container unit and on opposite sides of said central container unit, all these container units being disposed in side-by-side facially confronting juxtaposition, with two upper and two lower corner fittings involving one side wall of each more medial container laterally adjoining respective ones of two upper and two lower corner fittings involving a facially confronting side wall of a respective more lateral said container in a respective same tier;

installing in at least some of the resulting sets of two laterally adjoining corner fittings through respective said openings into respective said cavities a respective transverse coupling element, and reversibly manipulating each installed transverse coupling element for detachably coupling respective corner fittings together so as to prevent substantial relative vertical and horizontal movements and substantial relative transverse movement between the respective containers; and inserting support elements in at least some of said lower anchoring openings of the lower corner fittings of the lowermost said containers in said lateral container units, for thereby preventing these lower anchoring openings from receivingly engaging anchoring elements.

60. The method of claim 59, further comprising:

fitting at least one double-ended, elongated tensile stress-absorbing coupling element between respective end anchoring openings of two said corner fittings in two of said container units at each of the two ends of said transportation unit for providing a tensile connection between respective containers at said ends.

61. The method of claim 60, wherein:

said step of fitting comprises fitting between two container units disposed in laterally adjoining relation.

62. The method of claim 61, wherein:

said step of fitting comprises fitting between end anchoring openings disposed at a common level and extending said tensile stress-absorbing element horizontally across said one end.

63. The method of claim 61, wherein:

said step of fitting comprises fitting between end anchoring openings disposed at different levels and extending said tensile stress-absorbing elements obliquely across said one end.

64. The method of claim 63, wherein:

said step of fitting comprises fitting between end anchoring openings disposed in different tiers of said containers.

65. The method of claim 60, wherein:

said step of fitting comprises fitting between two container units which are laterally spaced from one another by at least one intervening said container unit.

66. The method of claim 65, wherein:

said step of fitting comprises fitting between end anchoring openings disposed at different levels and extending said tensile stress-absorbing element obliquely across said one end.

67. The method of claim 66, wherein:

said step of fitting comprises fitting between end anchoring openings disposed in different tiers of said containers.

68. The method of claim 67, wherein:

said step of fitting comprises fitting two said tensile stress-absorbing coupling elements arranged in an X pattern on each said end of said transportation unit.

69. The method of claim 59, wherein said step of inserting locking head entry-blocking devices comprises inserting respective blind insertion elements.

70. The method of claim 69, further comprising removable securing the inserted blind insertion elements in place by twisting them about respective vertical axes.

71. A method as in claim 59, further including:

leaving all four of said lower anchoring openings of the four said lower corner fittings of the lowermost said container in said central container unit free for receivingly engaging anchoring elements.

72. A method for combining into a transportation unit an odd number of laterally adjoining container units, each of which comprises at least one ISO container located in each of at least one corresponding container tier, and in which each ISO container comprises a rectangular, box-like member having a horizontal upper wall and a horizontal lower wall, two vertical opposite side walls and two vertical opposite end walls provided at longitudinally opposite ends of said side walls, which walls of each container, in respective sets of three, meet one another at four lower corners and four upper corners, of which each upper corner is provided with an ISO upper corner fitting having an upper anchoring opening through said upper wall into a upper corner fitting cavity, a side anchoring opening through a respective said side wall into said upper corner fitting cavity, and an end anchoring opening through a respective said end wall into said upper corner fitting cavity, and of which each lower corner is provided with an ISO lower corner fitting having a lower anchoring opening through said lower wall into a lower corner fitting cavity, a side anchoring opening through a respective said side wall into said lower corner fitting cavity, and an end anchoring opening through a respective said end wall into said lower corner fitting cavity, and wherein in each container unit, if multi-tier, each upper container is arranged in substantially superimposed juxtaposition with a respective lower container with the lower wall of the upper container disposed in facial confrontation with the upper wall of the respective lower container and mechanically interconnected by corner elements projecting from lower corner fittings of the upper container into upper corner fittings of the lower container through respective ones of said anchoring openings, so that the transportation unit includes a central container unit adjoined in one lateral direction by at least one lateral container unit and adjoined in an opposite lateral direction by at least one lateral container unit, said method comprising:

arranging equal numbers of said lateral container units in series with said central container unit and on opposite sides of said central container unit, all these container units being disposed in side-by-side facially confronting juxtaposition, with two upper and two lower corner fittings involving one side wall of each more medial container laterally adjoining respective ones of two upper and two lower corner fittings involving a facially confronting side wall of a respective more lateral said container in a respective same tier;

installing, in at least some of the resulting sets of two laterally adjoining corner fittings through respective said openings into respective said cavities, respective auxiliary elements;

installing through another respective said opening in at least some of said sets of laterally adjoining corner fittings through respective said openings into respective said cavities a respective transverse coupling element so that it comes in positive engagement with the adjacent auxiliary element while leaving all four of said upper anchoring openings of the four said upper corner fittings of the uppermost said container in said central container unit free for lifting engagement by respective locking heads of lifting equipment for lifting said transportation unit, as a unit, from said four upper corner fittings.

73. A method as in claim 72, wherein said step of installing auxiliary elements includes installing at least some middle coupling elements.

74. A method as in claim 72, wherein said step of installing auxiliary elements includes installing at least some blind locking elements.

75. The method of claim 72, wherein said step of installing auxiliary elements includes installing at least some support elements.

76. A method according to claim 72, wherein said step of installing a respective transverse coupling element comprises installing a respective transverse element so that a pin of each said respective transverse element comes into positive engagement with a bore defined in each said respective auxiliary element whereby each said respective transverse element is held in a defined position.

77. A method as in claim 76, further comprising reversibly manipulating each installed transverse coupling element for detachably coupling respective corner fittings together so as to prevent substantial relative vertical movement and substantial relative transverse movement between the respective containers.

* * * * *